US007631440B2

(12) United States Patent
Keen et al.

(10) Patent No.: US 7,631,440 B2
(45) Date of Patent: Dec. 15, 2009

(54) SHOE WITH ANATOMICAL PROTECTION

(75) Inventors: Martin Keen, Jamestown, RI (US); Stephen D. Opie, Arlington, MA (US)

(73) Assignee: The Timberland Company, Stratham, NH (US)

( * ) Notice: Subject to any disclaimer, the term of this patent is extended or adjusted under 35 U.S.C. 154(b) by 557 days.

(21) Appl. No.: 11/448,967

(22) Filed: Jun. 7, 2006

(65) Prior Publication Data

US 2007/0011914 A1 Jan. 18, 2007

Related U.S. Application Data

(63) Continuation-in-part of application No. 11/328,593, filed on Jan. 10, 2006, now Pat. No. 7,347,012, which is a continuation-in-part of application No. 11/195,214, filed on Aug. 2, 2005, now Pat. No. 7,320,189, which is a continuation-in-part of application No. 11/182,970, filed on Jul. 15, 2005, now Pat. No. 7,287,342.

(51) Int. Cl.
*A43C 11/00* (2006.01)

(52) U.S. Cl. ..... 36/50.1

(58) Field of Classification Search ..... 36/50.1, 36/50.5, 58.5, 58.6
See application file for complete search history.

(56) References Cited

U.S. PATENT DOCUMENTS 58,364 A 10/1866 Adams
114,340 A 5/1871 Prusha et al.

(Continued)

FOREIGN PATENT DOCUMENTS

CH 168117 3/1934

(Continued)

OTHER PUBLICATIONS

Wiley's Water Ski Pro Shop, www.wileyski.com/wakeboards/boots-and-bindings-668.htm, retrieved from internet May 2, 2006.

(Continued)

*Primary Examiner*—Ted Kavanaugh
(74) *Attorney, Agent, or Firm*—Lerner, David, Littenberg, Krumholz & Mentlik, LLP

(57) ABSTRACT

The present invention provides a floating anatomical protector for use in articles of footwear, and is particularly suited for footwear employing a wraparound lacing system. The floating anatomical protector preferably does not directly contact the superstructure of the article of footwear when worn. Instead, the lacing or other fastening system retains the floating anatomical protector in place over the wearer's foot and/or leg. For instance, the instep region of the foot, the shin, Achilles heel, calf, etc. may be covered by the floating anatomical protector. Multiple segments or separate protectors may be used. The lace may run between different layers of the floating anatomical protector. Also, the floating anatomical protector may directly contact the wearer's skin, or it may be used in conjunction with a bootie, sock or other intermediate material.

18 Claims, 40 Drawing Sheets

U.S. PATENT DOCUMENTS

| | | | | |
|---|---|---|---|---|
| D35,490 | S | | 12/1901 | Hatheway |
| D37,359 | S | | 2/1905 | Borchardt |
| 1,022,808 | A | | 4/1912 | Woods |
| 1,088,309 | A | | 2/1914 | Weidt |
| 1,197,783 | A | | 9/1916 | Winbray |
| 1,211,542 | A | | 1/1917 | Carolin |
| 1,355,827 | A | | 10/1920 | Finneran |
| 1,386,684 | A | | 6/1921 | Bradford |
| 1,683,465 | A | | 9/1928 | Hill |
| 2,143,556 | A | | 1/1939 | Hodaly |
| 2,169,337 | A | | 8/1939 | Davis |
| D135,155 | S | | 3/1943 | Huff |
| 2,390,685 | A | | 12/1945 | Benson |
| 2,496,782 | A | | 2/1950 | Engel |
| D158,653 | S | | 5/1950 | Fenlason |
| D163,359 | S | | 5/1951 | Braun |
| 2,551,723 | A | | 5/1951 | Camero |
| D163,615 | S | | 6/1951 | Laughlin |
| 2,590,648 | A | | 3/1952 | Pitz |
| 2,724,913 | A | | 11/1955 | Russell |
| 2,773,317 | A | | 12/1956 | Helle |
| 2,801,478 | A | | 8/1957 | Gilbert |
| 3,002,297 | A | | 10/1961 | Neilson |
| 3,121,962 | A | | 2/1964 | Gullo |
| 3,193,950 | A | | 7/1965 | Liou |
| 3,663,679 | A | | 5/1972 | Barre et al. |
| 4,107,857 | A | | 8/1978 | Devlin |
| 4,227,322 | A | | 10/1980 | Annovi |
| 4,245,408 | A | | 1/1981 | Larser et al. |
| 4,294,023 | A | | 10/1981 | Banford |
| 4,366,631 | A | | 1/1983 | Larsen et al. |
| 4,530,171 | A | | 7/1985 | Zabala |
| 4,535,554 | A | | 8/1985 | De Obaldia |
| 4,592,154 | A | | 6/1986 | Oatman |
| 4,616,430 | A | | 10/1986 | McQuiggin |
| 4,619,058 | A | | 10/1986 | Gumbert |
| 4,670,998 | A | | 6/1987 | Pasternak |
| 4,794,706 | A | | 1/1989 | Puckhaber et al. |
| 4,860,464 | A | | 8/1989 | Misevich et al. |
| 4,920,666 | A | | 5/1990 | Marega et al. |
| 4,942,678 | A | | 7/1990 | Gumbert |
| 5,117,567 | A | * | 6/1992 | Berger ..... 36/50.1 |
| 5,184,378 | A | | 2/1993 | Batra |
| 5,269,078 | A | | 12/1993 | Cochrane |
| 5,271,130 | A | | 12/1993 | Batra |
| 5,291,671 | A | | 3/1994 | Caberlotto et al. |
| 5,349,764 | A | | 9/1994 | Posner |
| 5,355,596 | A | | 10/1994 | Sussmann |
| 5,363,571 | A | | 11/1994 | Montfort |
| 5,371,957 | A | | 12/1994 | Gaudio |
| 5,381,609 | A | * | 1/1995 | Hieblinger ..... 36/50.1 |
| 5,438,767 | A | | 8/1995 | Stein |
| D363,815 | S | | 11/1995 | Lucarelli |
| 5,467,537 | A | | 11/1995 | Aveni et al. |
| 5,651,195 | A | * | 7/1997 | Clancy ..... 36/11.5 |
| 5,657,557 | A | | 8/1997 | Hull et al. |
| 5,659,982 | A | | 8/1997 | Muraoka et al. |
| 5,678,325 | A | | 10/1997 | Davidowitz et al. |
| 5,678,329 | A | | 10/1997 | Griffin et al. |
| 5,718,066 | A | | 2/1998 | Chemello et al. |
| D392,453 | S | | 3/1998 | Bathum |
| 5,737,854 | A | | 4/1998 | Sussmann |
| 5,755,046 | A | | 5/1998 | Dodge |
| D394,947 | S | | 6/1998 | Avar |
| 5,761,832 | A | | 6/1998 | George |
| 5,785,909 | A | | 7/1998 | Chang et al. |
| 5,791,021 | A | * | 8/1998 | James ..... 36/50.1 |
| D399,342 | S | | 10/1998 | Carlson |
| 5,836,090 | A | | 11/1998 | Smith |
| 5,873,183 | A | | 2/1999 | Posner |
| D406,688 | S | | 3/1999 | Winters et al. |
| 5,884,419 | A | | 3/1999 | Davidowitz et al. |
| 5,943,793 | A | | 8/1999 | Clements |
| 5,992,057 | A | | 11/1999 | Monti |
| 6,029,376 | A | | 2/2000 | Cass |
| 6,052,920 | A | | 4/2000 | Bathum |
| 6,052,921 | A | | 4/2000 | Oreck |
| 6,088,936 | A | | 7/2000 | Bahl |
| 6,122,845 | A | | 9/2000 | Menghi |
| 6,128,834 | A | | 10/2000 | Vecchiola et al. |
| 6,128,835 | A | | 10/2000 | Ritter et al. |
| D433,220 | S | | 11/2000 | Fogg |
| 6,148,544 | A | | 11/2000 | Keen et al. |
| D440,033 | S | | 4/2001 | Neely |
| D441,175 | S | | 5/2001 | Ritter et al. |
| 6,237,249 | B1 | | 5/2001 | Aguerre |
| 6,237,250 | B1 | | 5/2001 | Aguerre |
| 6,282,817 | B1 | | 9/2001 | Curet |
| 6,286,233 | B1 | | 9/2001 | Gaither |
| 6,324,773 | B1 | | 12/2001 | Gaither |
| 6,360,454 | B1 | | 3/2002 | Dachgruber et al. |
| 6,378,230 | B1 | | 4/2002 | Rotem et al. |
| 6,467,194 | B1 | | 10/2002 | Johnson |
| 6,493,965 | B1 | | 12/2002 | Bathum |
| 6,499,234 | B2 | | 12/2002 | Manzi |
| D475,180 | S | | 6/2003 | Cosentino |
| 6,606,803 | B1 | | 8/2003 | Ritter et al. |
| 6,615,512 | B2 | | 9/2003 | Sink |
| 6,637,130 | B2 | | 10/2003 | Urie et al. |
| 6,689,300 | B2 | | 2/2004 | Chang |
| 6,694,641 | B1 | | 2/2004 | Gill |
| D487,334 | S | | 3/2004 | Issler |
| D487,613 | S | | 3/2004 | Urie et al. |
| 6,701,644 | B2 | | 3/2004 | Oorei et al. |
| 6,754,983 | B2 | | 6/2004 | Hatfield et al. |
| 6,787,089 | B2 | | 9/2004 | Liu |
| D505,250 | S | | 5/2005 | Adams et al. |
| D509,049 | S | | 9/2005 | McClaskie |
| D511,883 | S | | 11/2005 | Matis |
| D513,838 | S | | 1/2006 | Birkenstock |
| D514,294 | S | | 2/2006 | Matis |
| D515,299 | S | | 2/2006 | Burg |
| D517,302 | S | | 3/2006 | Ardissono |
| 7,287,342 | B2 | | 10/2007 | Keen |
| 7,320,189 | B2 | | 1/2008 | Clark et al. |
| 7,347,012 | B2 | | 3/2008 | Clark et al. |
| 2001/0025434 | A1 | | 10/2001 | Fellouche |
| 2002/0002781 | A1 | | 1/2002 | Bouvier |
| 2002/0078597 | A1 | | 6/2002 | Burt |
| 2003/0024135 | A1 | | 2/2003 | Liu |
| 2003/0041477 | A1 | | 3/2003 | Liu |
| 2003/0041478 | A1 | | 3/2003 | Liu |
| 2003/0066207 | A1 | | 4/2003 | Gaither |
| 2003/0131496 | A1 | | 7/2003 | Nakano |
| 2003/0167655 | A1 | | 9/2003 | Sussman |
| 2003/0182820 | A1 | | 10/2003 | Fuerst et al. |
| 2003/0226286 | A1 | | 12/2003 | Pochatko |
| 2004/0128863 | A1 | | 7/2004 | Hong et al. |
| 2004/0172851 | A1 | | 9/2004 | Curet |
| 2004/0181972 | A1 | | 9/2004 | Csorba |
| 2004/0226190 | A1 | | 11/2004 | Elkington et al. |
| 2004/0244226 | A1 | | 12/2004 | Farys et al. |
| 2004/0250445 | A1 | | 12/2004 | Pritchett |
| 2004/0250452 | A1 | | 12/2004 | Farys |
| 2004/0255486 | A1 | | 12/2004 | Pawlus et al. |
| 2005/0022427 | A1 | | 2/2005 | Kerns et al. |
| 2005/0060914 | A1 | | 3/2005 | Fuerst |
| 2005/0257399 | A1 | | 11/2005 | Yu |
| 2005/0268485 | A1 | | 12/2005 | Sakai |
| 2005/0274040 | A1 | | 12/2005 | Fuerst |

FOREIGN PATENT DOCUMENTS

| | | |
|---|---|---|
| EP | 0301187 | 2/1989 |
| EP | 1 611 810 | 1/2006 |
| EP | 1 743 540 | 1/2007 |
| FR | 1026527 | 4/1953 |
| FR | 1037244 | 9/1953 |
| FR | 1049937 | 1/1954 |
| FR | 1204224 | 1/1960 |
| FR | 1281619 | 12/1961 |
| FR | 2 783 678 | 3/2000 |
| JP | 08131201 | 5/1996 |
| WO | WO-2004/043184 | 5/2004 |
| WO | WO-2005/009163 | 2/2005 |
| WO | WO-2005011424 | 2/2005 |
| WO | 2005/102091 | 11/2005 |

OTHER PUBLICATIONS

Xtreme Wakesports, www.anythingxtreme.com/HO-Sports-Orbit-2005-Bindings-P8324C3035.aspx, retrieved from internet May 2, 2006.

Scarpa Vision, www.scarpa.co.uk/rock/vision.html, retrieved from internet May 2, 2006.

MountainTools, www.redshift.com/~mtweb/cat/rclimb/rshoes/LaSportivaTora ClimbingShoes.htm, retrieved from internet May 2, 2006.

Moosjaw Outpost, www.moosejwaoutpost.com/moosejaw/product.asp?s_ID=3&dept_id=10112&pf_id=100171, retrieved from internet May 2, 2006.

* cited by examiner 4B-4B 14A-14A 14B-14B 14B-14B

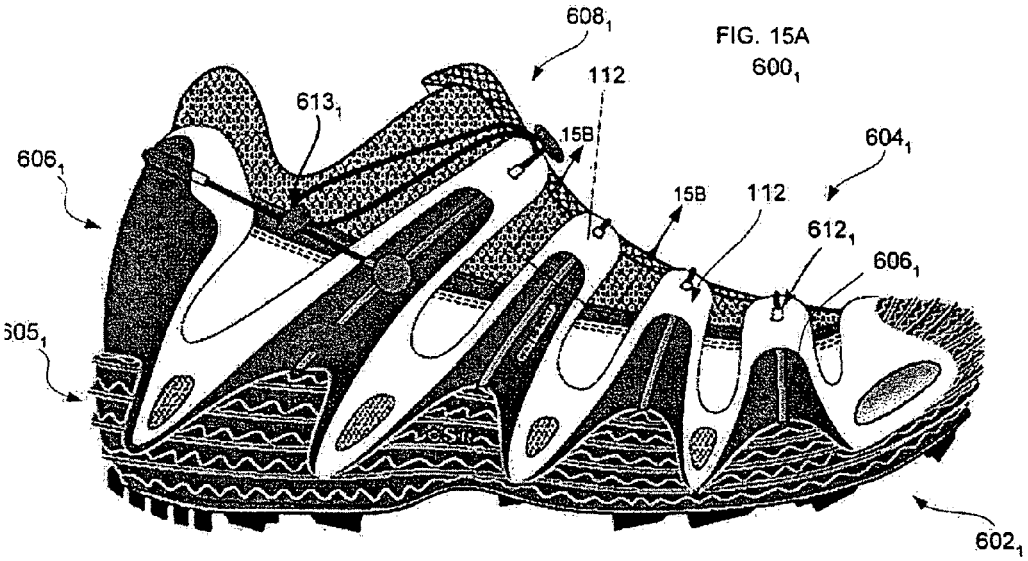
FIG. 15A
600$_1$
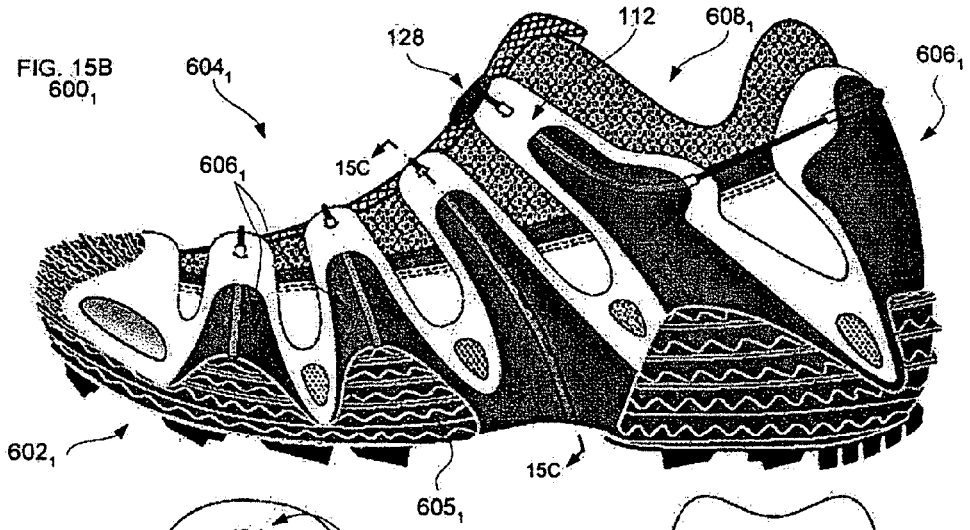
FIG. 15B
600$_1$
FIG. 15E
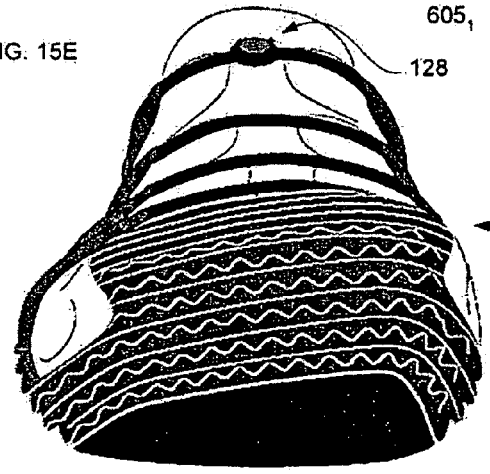
FIG. 15F
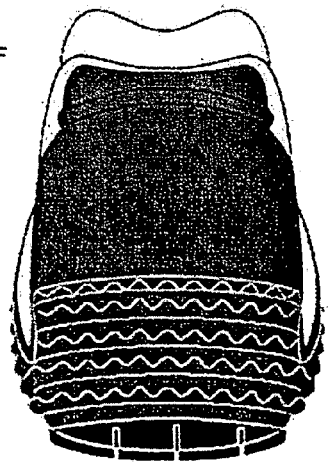

15C-15C 15B-15B 15A-15A

600$_2$

600$_2$

600$_3$

600$_3$ $600_4$
$608_4$
128
$612_4$
$626_4$
126
$604_4$
$606_4$
$606_4$
$602_4$ $600_4$
$604_4$
$626_4$
124
$606_4$
$602_4$

FIG. 19A
FIG. 19H
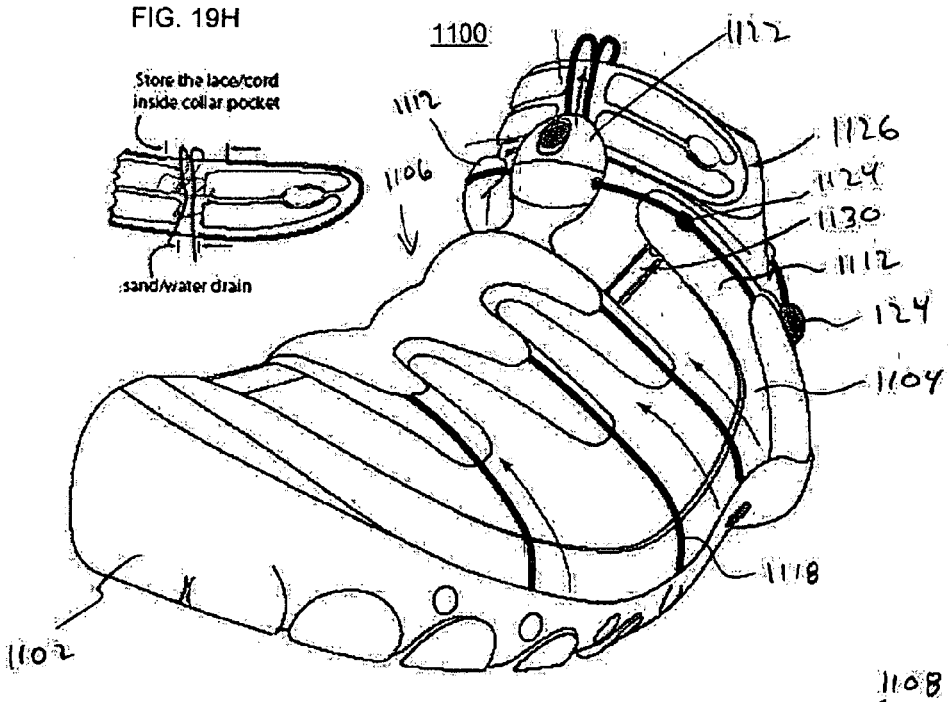
FIG. 19B
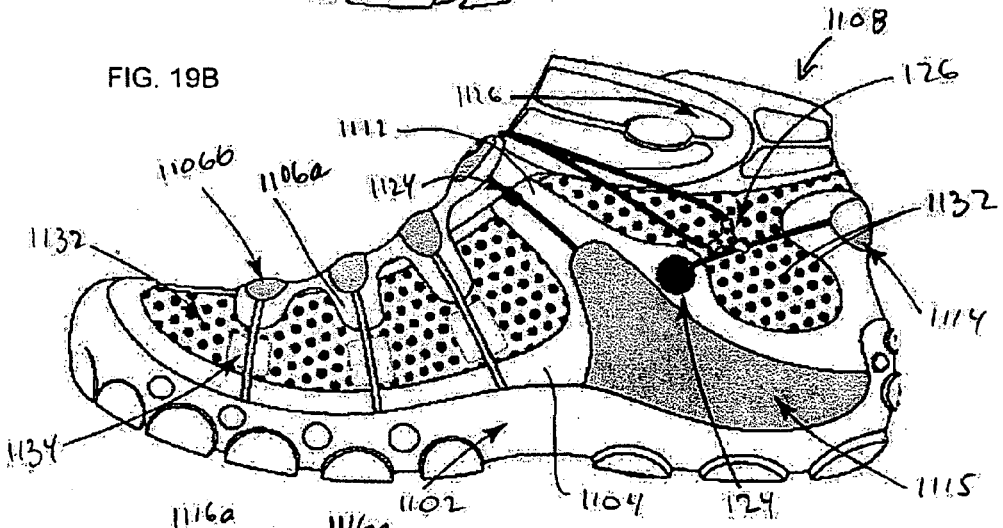
FIG. 19C
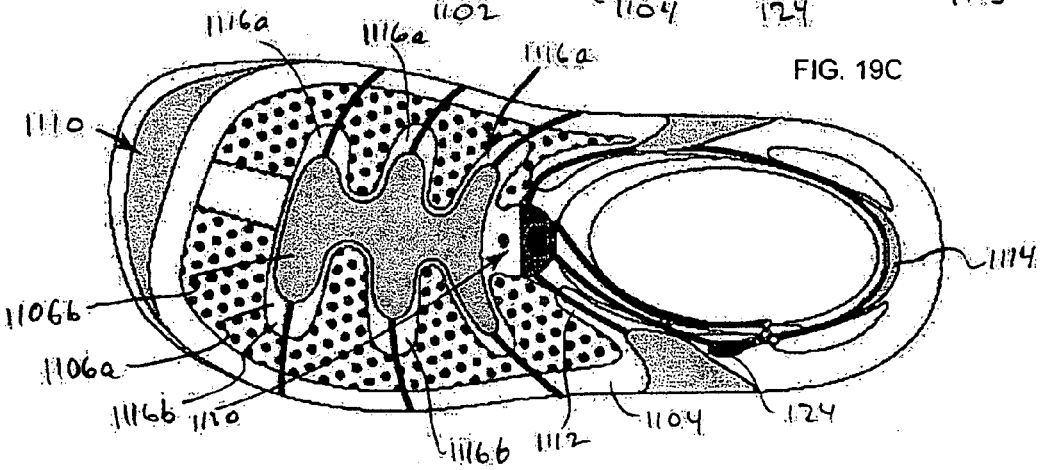

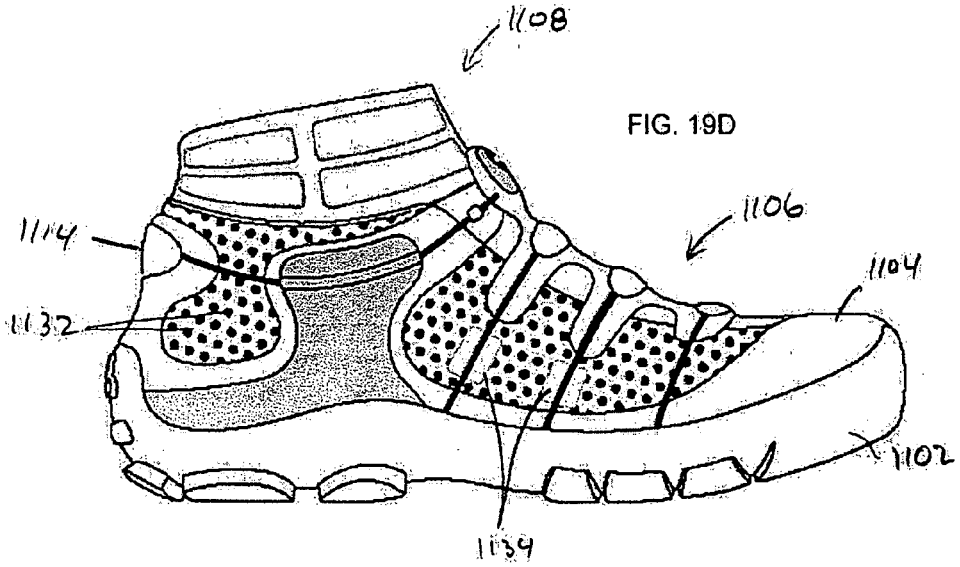
FIG. 19D
FIG. 19E
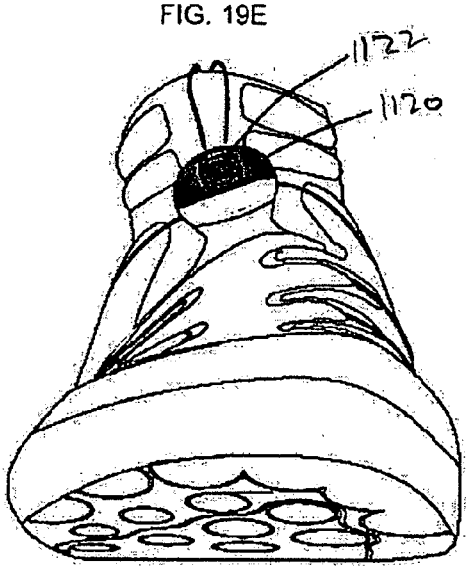
FIG. 19F
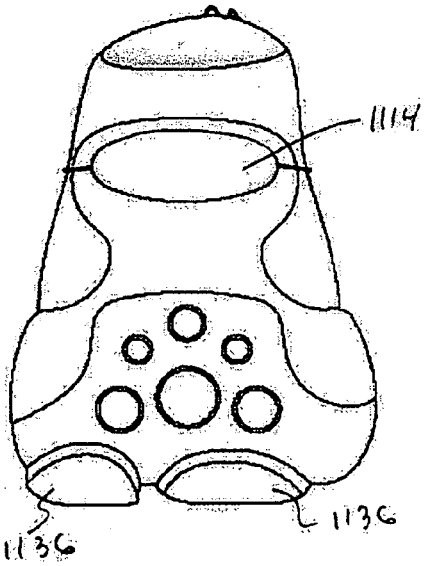
FIG. 19G
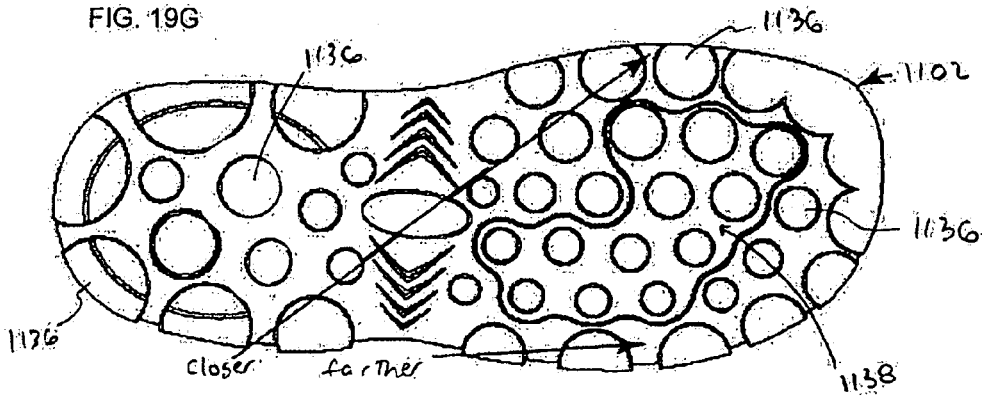

SHOE WITH ANATOMICAL PROTECTION

CROSS-REFERENCE TO RELATED APPLICATIONS

This application is a continuation-in-part of U.S. application Ser. No. 11/328,593, filed Jan. 10, 2006 and entitled "SHOE WITH LACING," which is a continuation-in-part of U.S. application Ser. No. 11/195,214, filed Aug. 2, 2005 and entitled "SHOE WITH LACING," which is a continuation-in-part of U.S. application Ser. No. 11/182,970, filed Jul. 15, 2005 and entitled "SHOE WITH LACING," and is related to U.S. Design patent application Ser. No. 29/234,283, filed Jul. 15, 2005 and entitled "SHOE WITH LACING," the entire disclosures of which are hereby expressly incorporated by reference herein.

BACKGROUND OF THE INVENTION

The present invention relates generally to footwear, and in particular to footwear that combines an upper/midsole structure for maintaining the wearer's foot with a wrap around lacing system in conjunction with a floating anatomical member. The footwear is particularly suited to climbing, hiking, water sports and similar activities, although the invention is not limited to any specific type of footwear or activity.

Conventional footwear has two primary elements, namely the upper and the sole structure. The upper is often made from leather, synthetic materials or a combination thereof. The upper is attached to the sole structure, forming a void or receptacle in the interior of the footwear for receiving and securing the foot to the footwear. The sole structure traditionally includes multiple layers of material commonly referred to as the midsole and the outsole.

Traditional water sport footwear are boat shoes, sandals, and wet boots. Unfortunately, each of these types of footwear has drawbacks that can detract from the pleasure of water-related activities. Commonly, boat shoes have waterproof leather uppers combined with rubber soled bottoms. There are several drawbacks for the water sport participant when using waterproof leather in water sports. For instance, it is common for the wearer to fully submerge his or her foot and footwear in water, or come into contact with enough water to saturate the interior of the shoe. The in-shoe experience of the wearer is lessened in terms of comfort as perspiration and externally introduced water can saturate the skin, which, in turn, may lead to skin irritation, fungal infections or other problems, let alone general discomfort. Although the upper is able to provide protection and the rubber outsole can provide traction on slippery, wet surfaces, the regulation of the in-shoe climate is limited due to the properties of the upper material as well as a lack of ventilation. This can make for a hot and unpleasantly wet foot experience.

In contrast to boat shoes, known water sport sandals offer the benefit of air circulation. However, such sandals typically do not provide the protection, stability or traction of a boat shoe. Wet boots have a rubber and neoprene construction that offers protection from sand, stones, sharp objects and cool water. Wet boots may be suitable for beach walks and water activities such as surfing. However, this conventional construction is not suitable for trekking in wet or hot environments. Neither is it suitable for use on slippery surfaces. Furthermore, known wet boots do not offer durability, traction or stability for rough terrain. Moreover, once water enters into a wet boot, it is difficult to evacuate the water without removing the wet boot from the wearer's foot. Furthermore, traditional footwear for water related activities are typically not configured to protect the instep region of the wearer's foot. As used herein, the term "instep region" refers generally to the instep region of the foot, and is not intended to be limited to any particular anatomical features. For instance, the instep, metatarsals, phalanges, and ankle may all be included in the instep region. These and other anatomical features may be in need of particular protection depending upon the function and use of the footwear.

Sporting activities such as hiking and climbing may place special demands on footwear. For instance, footwear adapted for hiking, climbing or other outdoor active wear use should be flexible and durable. It should provide sufficient insulation and traction, even when the wearer is in an extreme environment. For instance, canyoneering may require the wearer to utilize many different parts of his or her foot to support and/or stabilize the body when climbing. Thus, the footwear should provide traction not only along the sole, but elsewhere as well. Canyoneering may involve many different activities and skills, each of which could individually be enhanced by use of the invention herein, including walking, climbing, scrambling, wading through streams or waterfalls, and even swimming. Thus, footwear utilized while canyoneering must address a wide variety of conditions, functional uses and surfaces. Furthermore, proper protection of the foot, pressure distribution and in shoe security are also very important, for instance about the instep and other regions of the foot and leg.

Therefore, a need exists for new types of footwear suitable for climbing, hiking, walking, scrambling and water-related activities and wet environments to overcome these and other problems.

SUMMARY OF THE INVENTION

The present invention includes articles of footwear that provide the durability, stability, traction, comfort and form fit for a multitude of activities, including climbing, hiking walking, scrambling and water related activities. Water related activities include, but are not limited to, sailing, trekking, fishing, river running, kayaking, golfing, walking, swimming, adventure racing, biathlons, triathlons, etc. The water element could be, for instance, due to the outside environment, or due to temperate environments which necessitate breathability and air circulation around the foot. Such breathability and air circulation is beneficial to the wearer by reducing the moisture level next to the skin created by the interior environment, in cold weather activities where protection from water and temperature is required, in warm environments where perspiration collects next to the skin, or in a combination of these environments and a variety of terrains. The present invention addresses the needs for a multitude of activities and overcomes the deficiencies of conventional footwear with a unique superstructure construction in conjunction with a unique wrap around lacing system. A unique floating anatomical protector is also employed to provide enhanced protection, flexibility and comfort to the wearer. The floating anatomical protector may be used alone or in combination with the superstructure and/or the wrap around lacing system to provide protection, enhance in shoe foot security, and provide greater comfort with enhanced pressure distribution.

In accordance with an embodiment of the present invention, an article of footwear comprises a superstructure at least partly defining an enclosure for receiving a wearer's foot and a floating anatomical protector for protecting a portion of the wearer's foot or leg. The floating anatomical protector is operatively coupled to the superstructure so that the anatomical protector does not directly contact the superstructure during wear.

In one alternative, the article of footwear further comprises an outsole having a first surface for contacting the ground and a second surface remote from the first surface. The superstructure is affixed to the second surface of the outsole.

In another alternative, the floating anatomical protector preferably has a base layer and a cover layer. The base layer has a first surface adapted to face the wearer's foot during wear and a second surface opposite the first surface. The cover layer is connected to the second surface of the base layer. In this case, the cover layer desirably includes a traction material overlying at least part of the second surface of the base layer. In one example, the superstructure includes a toe protector for covering at least a portion of the wearer's toes. The toe protector is spaced apart from the floating anatomical protector by a gap.

In a further alternative, the floating anatomical protector includes a plurality of projections thereon. At least one of the plurality of projections extends medially or laterally away from a central region of the floating anatomical protector. The plurality of projections preferably comprises at least two medial side projections and at least two lateral side projections. In one example, the medial side projections are not symmetrical with corresponding ones of the lateral side projections.

In yet another alternative, the superstructure and the floating anatomical protector each include at least one receptacle therein for receiving a lace.

In a further alternative, the article of footwear also comprises a lace adapted to couple the floating anatomical protector to the superstructure. In one example, the superstructure and the floating anatomical protector each include at least one lacing channel therein for receiving the lace. In this case, the lacing channel of the floating anatomical protector preferably runs between two layers of the floating anatomical protector. The lace may be wound in a generally spiral pattern about the superstructure and the floating anatomical protector.

In another alternative, the article of footwear further comprises a bootie at least partly received within the superstructure. The floating anatomical protector overlies a portion of the bootie during wear. The bootie may be removably connected to the superstructure. The bootie preferably includes a collar having closure means for securing the collar about a portion of the wearer's leg. The article of footwear may further comprise a footbed removably disposed within the bootie.

In accordance with another embodiment of the present invention, an article of footwear comprises a superstructure at least partly defining an enclosure for receiving a wearer's foot and a floating anatomical protector operatively coupled to the superstructure. The floating anatomical protector has at least one medial side projection and at least one lateral side projection extending therefrom.

In one alternative, the superstructure has at least one medial side projection and at least one lateral side projection extending therefrom. In this case, the floating anatomical protector is preferably positionable so that the at least one medial side projection of the floating anatomical protector generally aligns with the at least one medial side projection of the superstructure, and the at least one lateral side projection of the floating anatomical protector generally aligns with the at least one lateral side projection of the superstructure. In another alternative, the superstructure further includes at least one of a medial side ankle guard and a lateral side ankle guard extending therefrom.

In a further alternative, a lace couples the floating anatomical protector to the superstructure. In this case, the superstructure and the floating anatomical protector desirably each include at least one lacing channel therein for receiving the lace. Here, the at least one lacing channel of the floating anatomical protector may be disposed along the at least one medial side projection and the at least one lateral side projection thereof. The lacing channels of the superstructure and the floating anatomical protector may be arranged so that the lace does not cross over itself.

In another alternative, the article of footwear further comprises a bootie connected to the superstructure. The bootie includes a lace support thereon for guiding the lace between the at least one lacing channel of the floating anatomical protector and the at least one lacing channel of the superstructure. In this case, the bootie preferably includes a collar having closure means for securing the collar about a portion of the wearer's leg.

In accordance with yet another embodiment of the present invention, an article of footwear comprises a superstructure, a floating anatomical protector, and a bootie. The superstructure at least partly defines an enclosure for receiving a wearer's foot. The superstructure includes a plurality of lacing channels therein for receiving a lace. The floating anatomical protector is operatively coupled to the superstructure by the lace. The floating anatomical protector including a plurality of lacing channels therein for receiving the lace. The bootie is at least partly received in the superstructure. The floating anatomical protector overlies a portion of the bootie during wear. In one alternative, the bootie is removably engaged to the superstructure.

In accordance with another embodiment of the present invention, an article of footwear comprises a superstructure at least partly defining an enclosure for receiving a wearer's foot, an anatomical protector configured so that the anatomical protector does not directly contact the superstructure during wear and is able to move independently of the superstructure during wear, and means for floatingly coupling the anatomical protector to the superstructure.

BRIEF DESCRIPTION OF THE DRAWINGS

FIGS. 19(*a*)-(*h*) illustrate another article of footwear having a canyoneering configuration in accordance with aspects of the present invention.

DETAILED DESCRIPTION

Figure 1A:
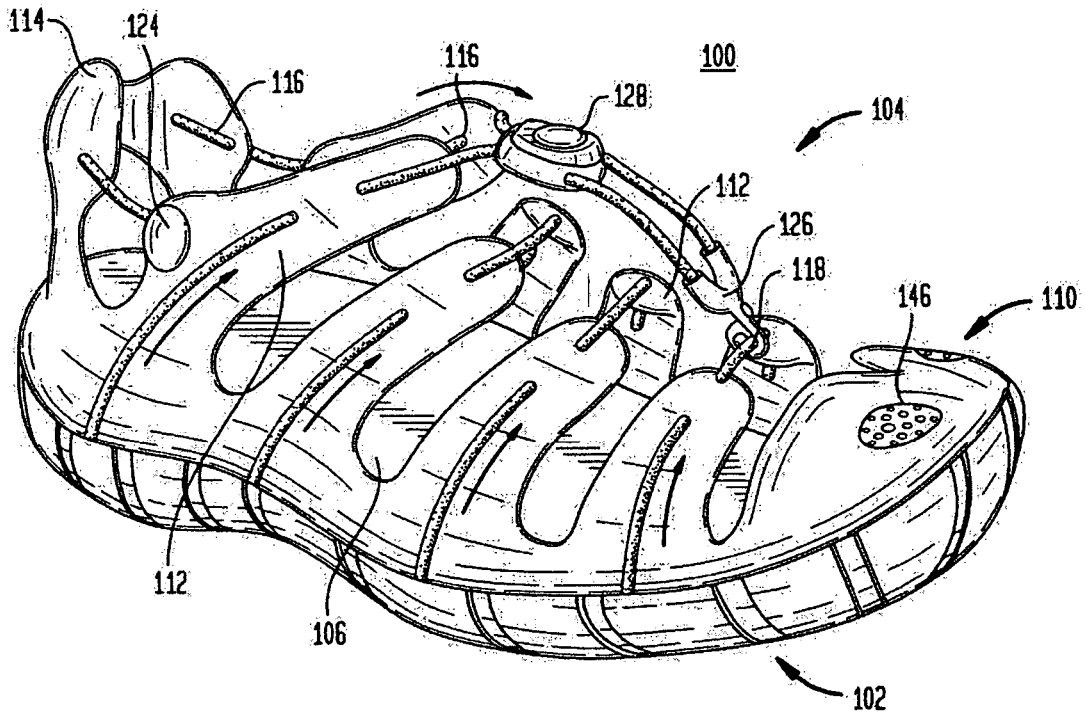
FIGS. 1(*a*)-(*g*) illustrate an article of footwear having a sandal configuration in accordance with aspects of the present invention.
Figure 1B:
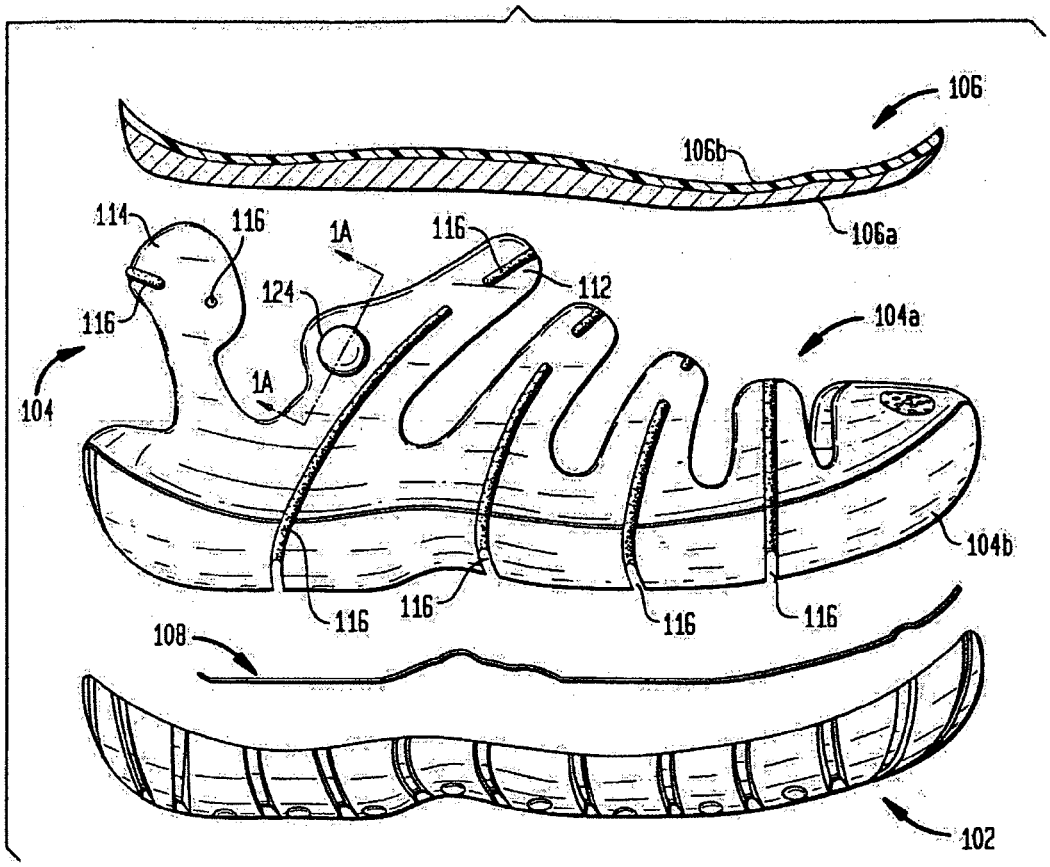
Figure 1C:
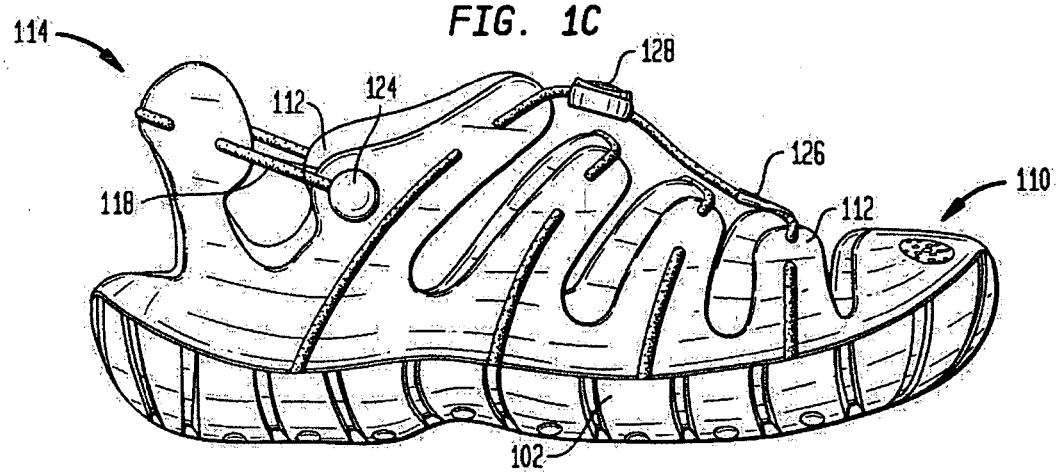
Figure 1D:
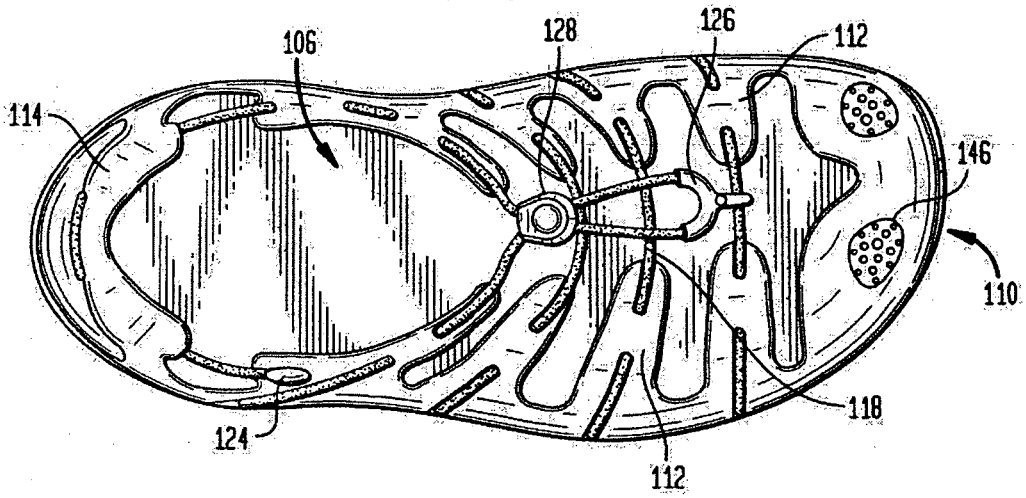
Figure 1E:
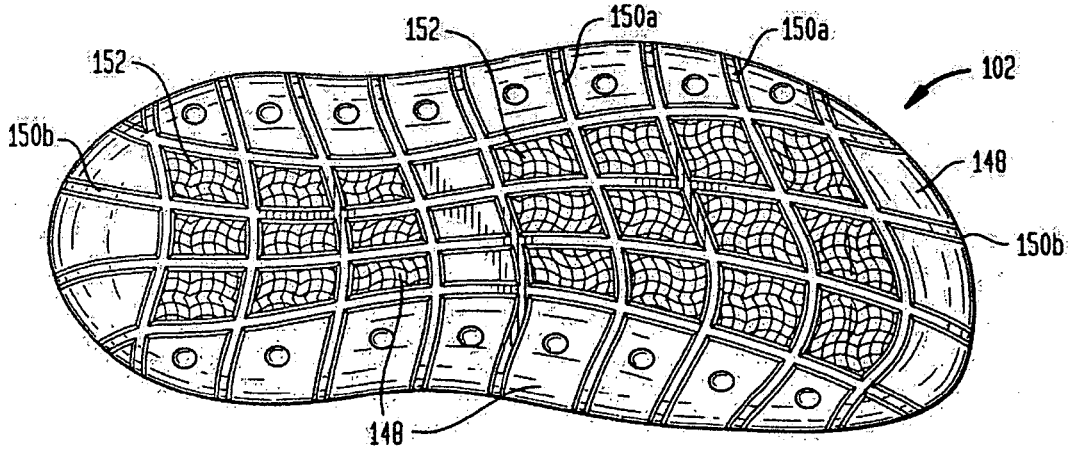
Figure 1F:
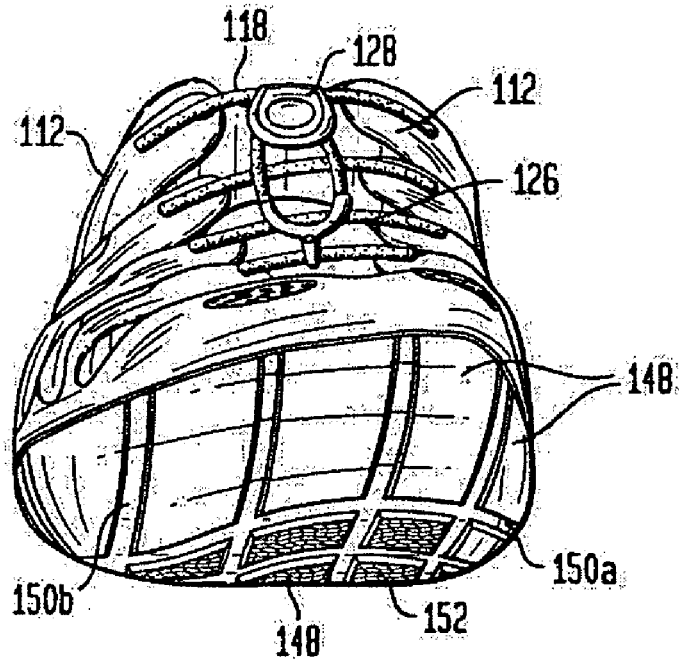
Figure 1G:
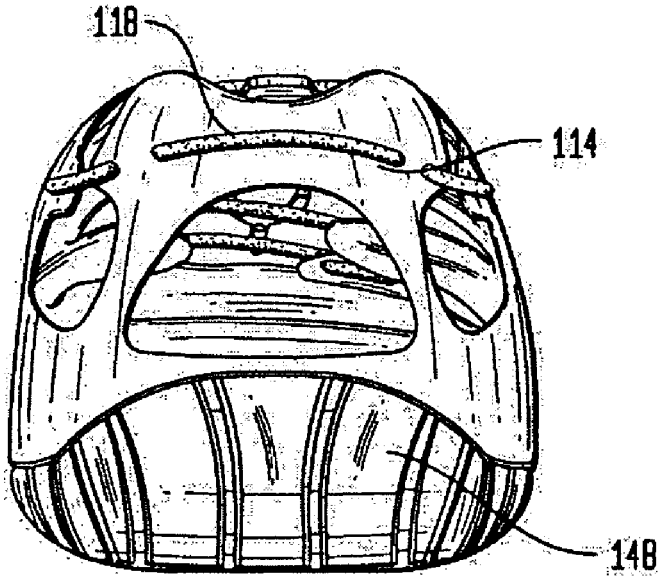
Figure 2A:
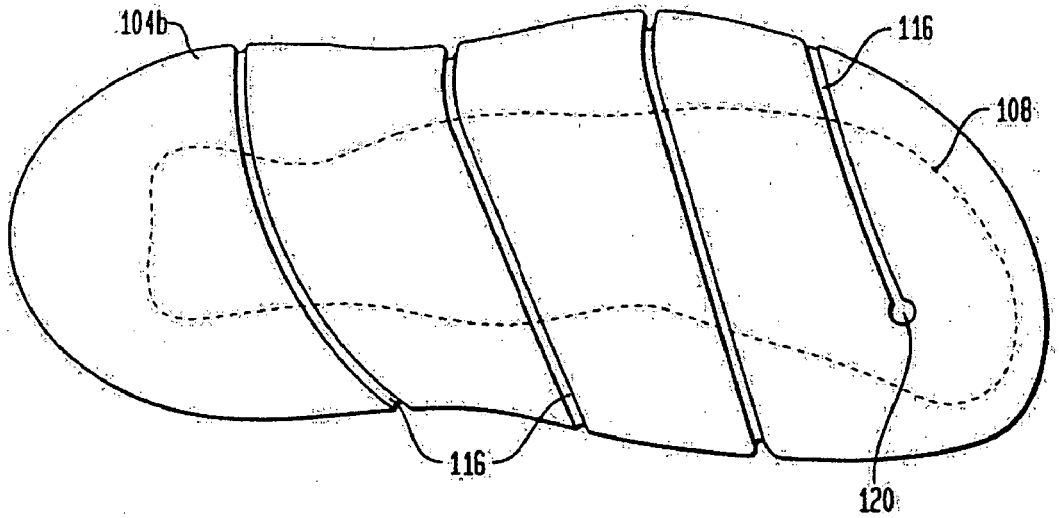
FIGS. 2(*a*)-(*f*) illustrate views of portions of the article of footwear of FIGS. 1(*a*)-(*f*).
Figure 2B:
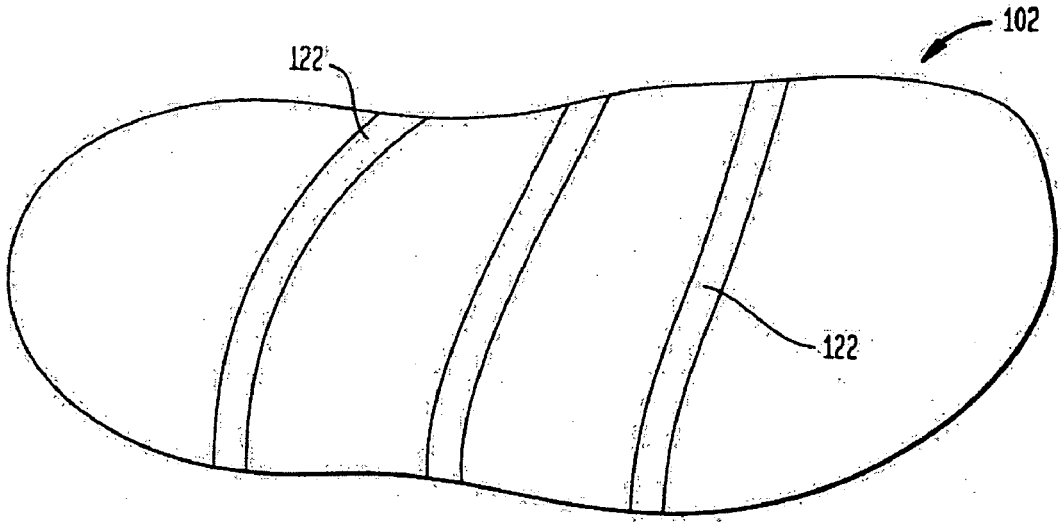
Figure 2F:
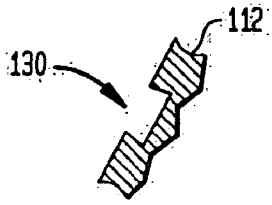
Figure 2C:
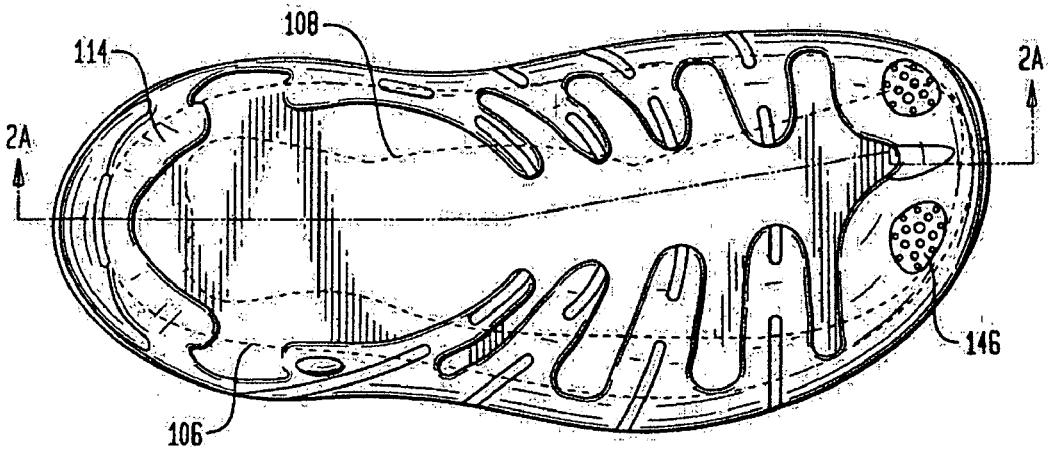
Figure 2D:
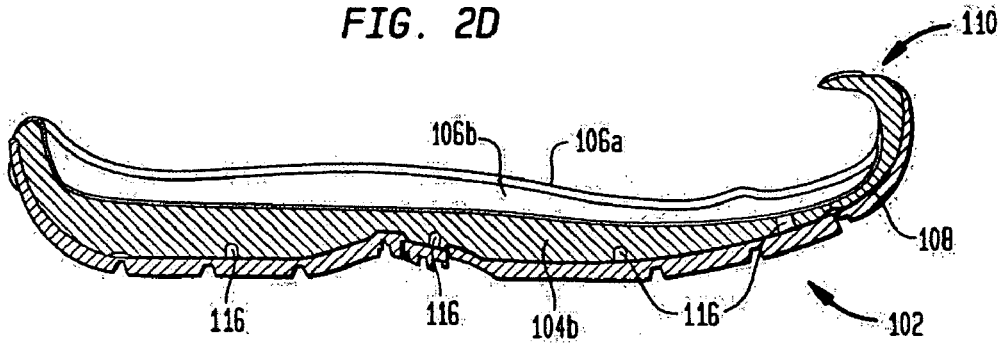
Figure 2E:
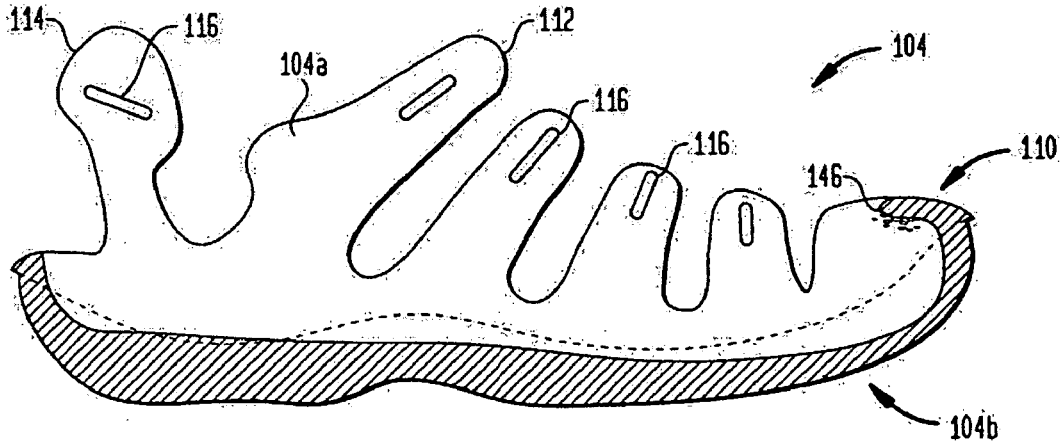

The foregoing aspects, features and advantages of the present invention will be further appreciated when considered with reference to the following description of preferred embodiments and accompanying drawings, wherein like reference numerals represent like elements. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose. By way of example only, the term "footwear" is used herein to include, without limitation, all manner of foot coverings such as boots, shoes, sandals, athletic sneakers, loafers, boat shoes, wet boots, etc. The term "water shoes" includes sandals and sandal-type shoes such as slides, flips and thongs, as well as boat shoes, wet boots and other footwear adapted for water-related activities. In the embodiments of footwear shown in the drawings, only right foot shoes are shown. However, it should be understood that the left foot shoes are mirror images of the right foot shoes.

FIG. 1(*a*) illustrates a perspective view of an article of footwear 100 in accordance with aspects of the present invention, for example, in a sandal configuration. The article of footwear 100 comprises two main components, an outsole 102 and a once piece molded housing 104. The outsole 102 provides a ground contacting surface. The housing 104 provides a receptacle or enclosure for receiving a wearer's foot. As seen in the exploded view of FIG. 1(*b*), the unitary housing 104 includes upper 104*a* and midsole 104*b* portions. The features of the outsole 102 and the housing 104 will be described in more detail below.

FIG. 1(*b*) also shows that a footbed 106 may be disposed over the midsole 104*b* to provide cushioning, support and/or protection underneath the foot. The footbed 106 may be a separate component from the unitary housing 104. In this case, the footbed 106 may be removable from the article of footwear 100, or may be permanently, securely affixed to the midsole 104*b* using an adhesive or other bonding agent. Alternatively, the footbed 106 may be integrally formed as part of the housing 104, for instance as one or more layers of the midsole 104*b*. The footbed 106 may be formed from resilient materials such as ethyl vinyl acetate ("EVA") or polyurethane ("PU") foams or other such materials commonly used in shoe midsoles, insoles or sockliners.

The footbed 106 may be formed of one or more material layers, regions and/or segments, which may each have a different thickness and/or a different rigidity. For example, the footbed 106 may comprise multiple layers of different rigidity. Alternatively, the footbed 106 may have different levels of rigidity in the forefoot, instep and heel regions, respectively. The footbed 106 could also have a first segment about the first metatarsal on the medial side of the forefoot of a first rigidity and a second segment about the fifth metatarsal on the lateral side of the forefoot of a second rigidity. As shown in FIG. 1(*b*), the footbed 106 is preferably removable, and desirably includes two or more layers such as layers 106*a* and 106*b*. In a preferred example, the layer 106*a* comprises EVA foam such as compression molded EVA ("CMEVA"), and the layer 106*b* includes an antimicrobial component.

A stiffening member 108 may optionally be included in the article of footwear 100. The stiffening member 108 may be disposed, for example, between the midsole 104*b* and the outsole 102. Alternatively, the stiffening member 108 may be positioned between the footbed 106 and the midsole 104*b* may be integral with the footbed 106 or integral with the midsole 104*b*. The stiffening member 108 can be made from one or more different materials, including thermoplastic polyurethane ("TPU"), polyolefin, nylon, etc. A main function of the stiffening member 108 is to distribute or dissipate forces (e.g., when the wearer is running) across the midsole 104*b*, the outsole 102 and/or the footbed 106 and to provide a more stable platform for locomotion. Depending upon its placement, the stiffening member 108 may be contoured on one or both of its upper and lower surfaces to fit the contours of the components above and below it. For example, as seen in FIG. 1(*b*), the stiffening member 108 may be contoured in the instep region to fit the contours of the outsole 102 and the midsole 104*a*.

The outsole 102 is desirably formed of a natural or synthetic rubber, although other known outsole materials may be used. The outsole 102 preferably covers all or substantially all of the entire outside surface of the midsole 104*b* remote from the wearer's foot. Specifically, a first or inner surface of the outsole 102 may be bonded or otherwise attached to an exterior surface of the midsole 104*b*. A second or outer surface of the outsole 102 is the ground contacting surface, which may have a variety of tread and/or lug configurations, as will be illustrated below.

The housing 104 will now be described in more detail. Preferably, the one-piece construction is achieved using an injection molding process. For example, the upper 104*a* and the midsole 104*b* may comprise injection-molded EVA ("IM- EVA") that is fabricating using known molding processes. However, other materials and/or processes may be used alone or in combination to form the one piece upper 104*a* and midsole 104*b*. Such materials include, but are not limited to, polyester and polyester based polyurethane ("PU"), rubber, plastics, etc.

The upper 104*a* desirably includes a toe cover 110, one or more projections, branches, or fingers 112, and a heel support 114, which are illustrated in the side and top views of FIGS. 1(*c*) and 1(*d*), respectively. The toe cover 110 is designed to provide protection to the wearer's toes. The fingers 112 and the heel support 114 are part of a one piece or unitary wrap-around lacing system which secures the article of footwear 100 to the wearer's foot, as will be explained in more detail below. While four fingers 112 are shown on both the medial and lateral sides of the article of footwear 100, any number of fingers 112 may be used on the medial and lateral sides, including a single finger 112 on each side or a single finger 112 on either the medial side or the lateral side. The single medial or lateral side finger 112 may partly, substantially or fully wrap over to the other side (e.g., lateral or medial) of the article of footwear 100. Furthermore, the specific placement, dimensions and/or angles of the fingers 112 may differ from what is shown without departing from the spirit or scope of the invention.

The molded fingers 112 of the upper 104*a* increase airflow to the foot and allow for breathability and dissipation of water, as well as exceptional fit. The fingers 112 are preferably flexible enough to work independently, adjusting to the contours of the wearer's foot. This adaptability allows the shoe to fit a large subject population having varying foot geometries. The fingers 112 enable fit adjustment, with an emphasis on foot instep adjustment as well as midfoot and forefoot width adjustment. The geometry of the upper 104*a* allows for greater contour to the foot than in conventional footwear. The fit of articles of footwear of the present invention can accommodate variances in forefoot height and girth expected within the general population while providing a secure and comfortable fit for each wearer. Furthermore, the fingers 112 are able to accommodate variations among the left and right feet of the wearer. As seen in FIG. 1(*b*), the fingers 112, the heel support 114 and the midsole 104*b* may each include lacing channels or paths 116 adapted to receive a lace therein. FIGS. 1(*c*)-(*d*) illustrate side and top views, respectively, of the assembled article of footwear 100 including lace 118.

The lacing system in accordance with the present invention provides the lace 118 as a one piece lace preferably positioned about the foot that is adjustable by the wearer to optimize in-shoe security of his or her foot. The lace 118 is wrapped around the housing 104 of the article of footwear 100 in a spiral pattern, such as a circumferential, helical or coiled pattern. Preferably, the lace 118 is wound in the spiral-type pattern, e.g., the circumferential, helical or coiled pattern so that it envelops, surrounds or otherwise engages the wearer's foot in a manner which secures the article of footwear 100 to the foot for added support and security. More preferably, the lace 118 is wound so that it does not cross over itself as in a conventional crisscross lacing pattern. Most preferably, only a single lace 118 is employed in most cases, although as will be described below, some styles of footwear may utilize more than one lace 118.

The channels 116 allow for security of the lace 118 in the footwear 100 as well as allow movement of the lace 118 during adjustment. As noted above, the lacing system is preferably incorporated as part of the housing 104 through a series of the lacing channels 116 that may be molded into the housing 104. As can be seen, the channels 116 are substantially different from conventional eyelets. The lacing channels 116 along the fingers 112 and/or the heel support 114 may be open so that the lace can be seen, or may be partly or completely enclosed. Any or all of the channels 116 may run along or be disposed within the outside and/or inside surfaces of the upper 104*a*, preferably on the fingers 112. The channels 116 can either be integrally molded into the housing 104 during the molding operation or can be added to the housing 104 as a separate component. Additionally, channels may be hand punched into areas of the housing where molding is limited or problematic. It is desirable for the lace 118 to be received throughout the article of footwear 100 with low friction and with low abrasion on the lace 118. Thus, it is desirable to make the channels 116 as friction free as possible, for example by making the channels smooth and/or coating the interior surfaces with a low friction material such as silicone or a polymer resin such as polytetrafluroethylene ("PTFE"). Additionally, separate low-friction tube structures may be inserted into the molded lace channels to reduce friction and protect the foam and lace 118 from abrasion. The low friction channels 116, low friction lace 118, or both, facilitate sliding of the lace 118 and reduce energy to secure the lace 118 and the article of footwear 100 about the wearer's foot.

The wraparound lace 118 may be anchored at one or more points along the article of footwear 100. The anchor points may be located in a variety of positions along the article of footwear 100, as will be illustrated in the numerous embodiments of the present invention. A critical benefit of the anchor points is that they allow for the lace length and/or lace tightness to be adjusted for individual use and overall tension adjustment at different segments of the foot. FIG. 1(*a*) includes arrows around the fingers 112 and the heel support 114 showing the direction in which the lace 118 may be pulled to tighten the article of footwear 100 around the wearer's foot.

FIG. 2(*a*) illustrates a view of the bottom of the midsole 104*b* showing the lacing channels 116 therein. The stiffening member 108, may be disposed over or under the midsole 104*b*, is shown in outline form with a dotted line. The bottom view also illustrates a recess 120 at an end of one of the lacing channels 116 adjacent to the lateral metatarsal or toe region of the midsole 104*b*. In a preferred embodiment, a first end of the lace 118 is knotted and bonded to the recess 120, thereby anchoring or otherwise securing the first end of the lace 118 to the article of footwear 100 between the midsole 104*b* and the outsole 102.

FIG. 2(*b*) illustrates a view of the top surface of the outsole 102 which mates with the bottom surface of the midsole 104*b*. As indicated above, the top surface of the outsole 102 may be bonded or otherwise affixed to the bottom surface of the midsole 104*b*. If adhesive were applied along the entire top surface of the outsole 102, then the lace 118 would bond to the outsole 102 and would not be able to adjust by moving within the lacing channels 116. However, adjustment of the lace 118 is very important for fit and comfort of the article of footwear 100. In order to overcome this problem, the top surface of the outsole 102 preferably includes markings 122. The markings align with the lacing channels 116 on the bottom of the midsole 104*b*. The markings 122 act as a guide to workers during the manufacturing process. The guide instructs the workers where not to apply adhesive to the outsole 102. Therefore, the lace 118 is free to move within the lacing channels 116. The markings 122 may be molded into the outsole 102, or may comprise some other type of indicator, such as paint or texture, which allows the worker to know where to omit application of the adhesive. It is also possible to provide channels in the outsole to complement, supplement or replace the lacing channels 116 and/or the recess 120 on the midsole 104*b*. The channels may be molded into the top surface of the outsole at positions matching the channels 116 molded into the midsole.

FIG. 2(*c*) illustrates a partial see-through top-down view of the article of footwear 100, which shows the perimeters of the footbed 106 and the stiffening member 108. FIG. 2(*d*) illustrates a sectional view of the outsole 102, midsole 104*b*, and footbed 106 along the 2A-2A line of FIG. 2(*c*) showing that the optional stiffening member 108 may be disposed between the midsole 104*b* and the outsole 102. The lacing channels 116 are also shown in the midsole 104*b*. However, as noted above, such channels could also or alternatively be included in the outsole 102. FIG. 2(*e*) illustrates another sectional view along the 2A-2A line of FIG. 2(*c*), illustrating the inside lateral portion of the housing 104 of the article of footwear 100. While some details are omitted for clarity, such as the lacing channels 116 on the underside of the midsole 104*b*, portions of the lacing channels 116 are shown on the inside of the fingers 112.

Returning to FIG. 1(*a*), it can be seen that the lacing system may also include a lace end keeper or end cap 124, a lace pull 126, and/or a lace locking mechanism 128. In the present embodiment, the second end of the lace 118 is secured or anchored by the lace end keeper 124. The lace end keeper 124 preferably comprises a plug or cap which fits into a receptacle in one of the fingers 112. As shown, the lace end keeper 124 is positioned on a selected finger 112 in the lateral forefoot region near the ankle. FIG. 2(*f*) illustrates a cross-sectional view of cavity or receptacle 130 along the 1A-1A line of FIG. 1(*b*). The lace end keeper 124 is desirably removably insertable into the receptacle 130, permitting access to the second end of the lace 118 held in the receptacle 130. This allows for individual fit adjustment for the wearer's foot. It is also preferentially beneficial at the initial fitting of the footwear to a foot so as to maximize comfort and for support.

In a preferred embodiment, lace tension adjustment can be made by the wearer as follows. The lace end keeper 124 in, for example, the lateral forefoot region, forward of the ankle, can be opened by wearer. The end of the lace 118 can be removed from the receptacle 130 and cut to appropriate length. Then the end of the lace 118 is placed back into the receptacle 130 and the lace end keeper 124 is put back in place by the wearer to lock in the lace 118. The lace end may be burned and/or knotted for security and snug fit within the receptacle 130. Of course, it is possible to utilize lace keepers at both ends of the lace 118 and/or at any intermediate point(s) along the lace 118, as will be described in more detail below. Multiple lace keepers enable the user to adjust for different tension in different segments of the article of footwear 100. For example, the tension in the toe region of the article of footwear 100 may be different from the tension in the instep area or around the ankle. This accommodates foot variability and non-standard conformations resulting in enhanced support and/or comfort to the wearer.

The lace end keeper 124 and the receptacle 130 may have any number of configurations that can allow for an adjustable and secure receipt of the lace end. For example, the lace end keeper 124 may incorporate the use of a needle or pronged end to pin the lace end within the receptacle 130 when placing the cap back on. Alternatively, it is possible to wind the lace 118 about the lace end keeper 124 to adjust its fit. The unique wrap around, adjustable, lacing system with two anchor points, one at the recess 120 and the other at the connection between the lace end keeper 124 and the receptacle 130, provide a secure fit and even pressure distribution across the foot. It is desirable to have low friction on the lace 118 to keep pressure distribution even and to prevent abrasion or fraying of the lace 118.

Figure 3A:
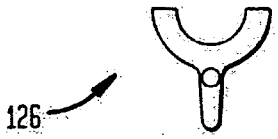
FIGS. 3(*a*)-(*c*) illustrate a lace keeper for use in accordance with aspects of the present invention.
Figure 3B:
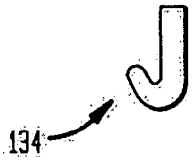
Figure 3C:
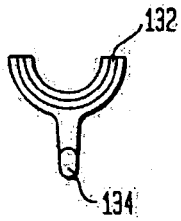
Figure 4C:
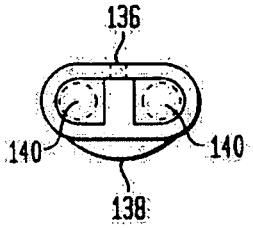
FIGS. 4(*a*)-(*k*) illustrate views of a locking mechanism for use in accordance with the present invention.
Figure 4B:
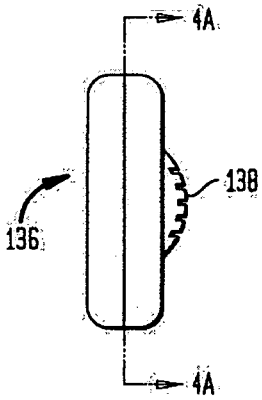
Figure 4A:
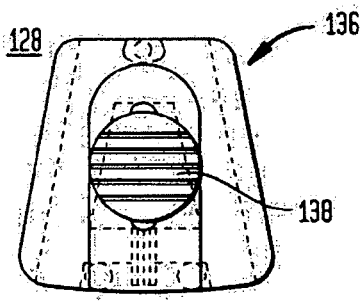
Figure 4E:
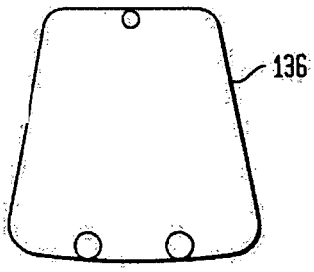
Figure 4F:
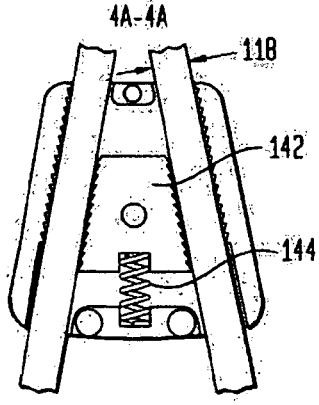
Figure 4D:
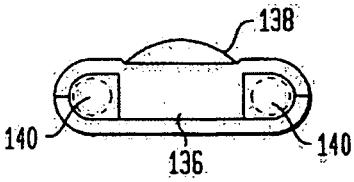
Figure 4G:
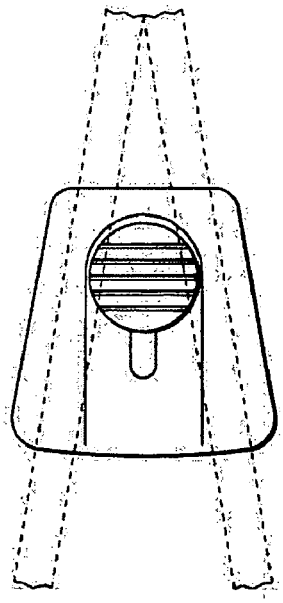
Figure 4J:
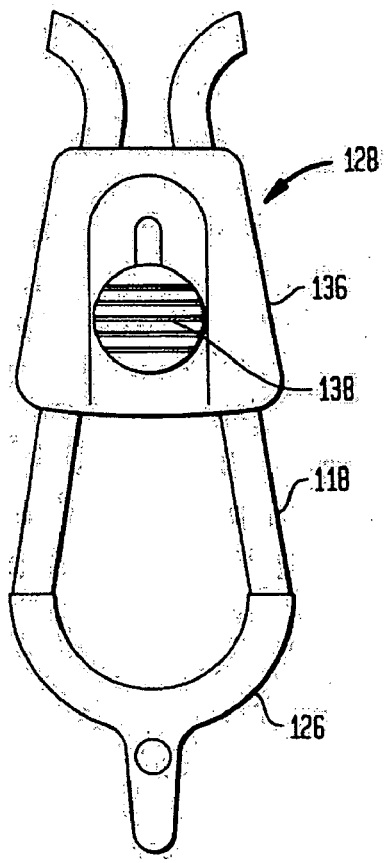
Figure 4H:
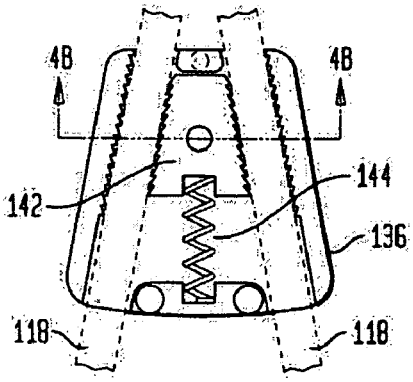
Figure 4K:
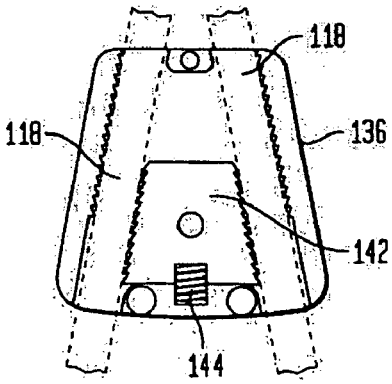
Figure 4I:
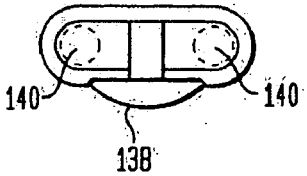
Figure 5A:
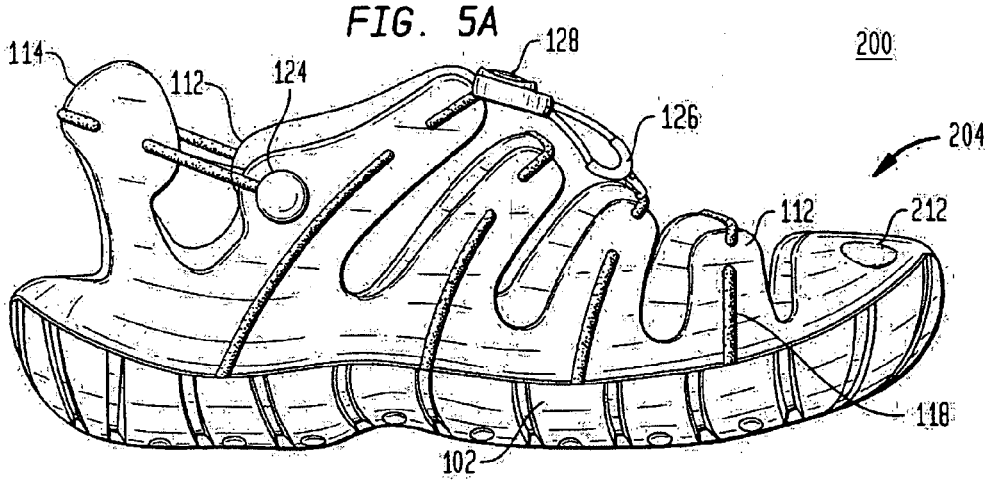
FIGS. 5(*a*)-(*d*) illustrate an article of footwear having an alternative sandal configuration in accordance with aspects of the present invention.
Figure 5B:
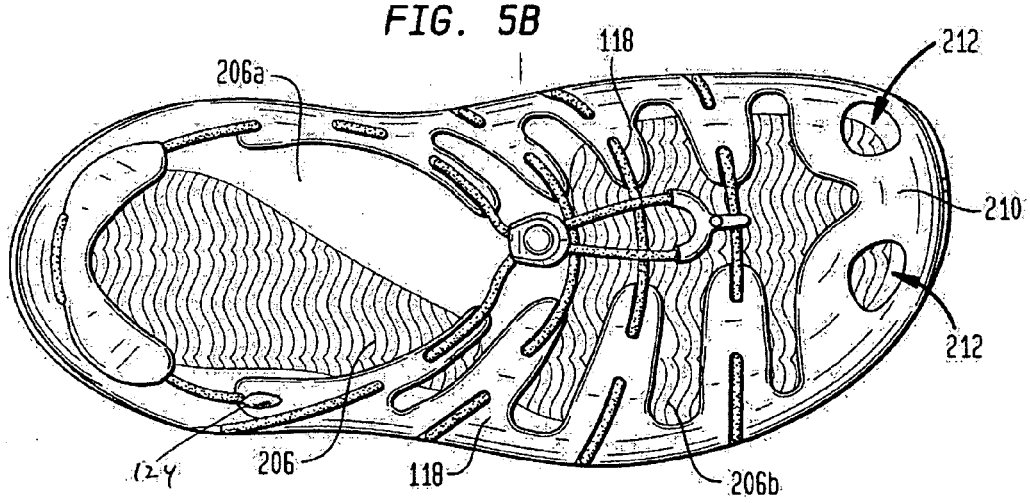
Figure 5C:
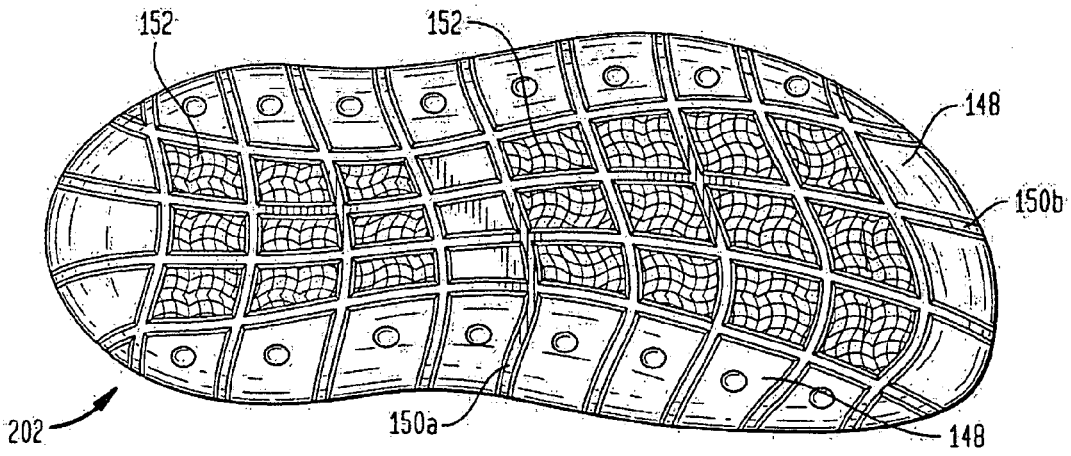
Figure 5D:
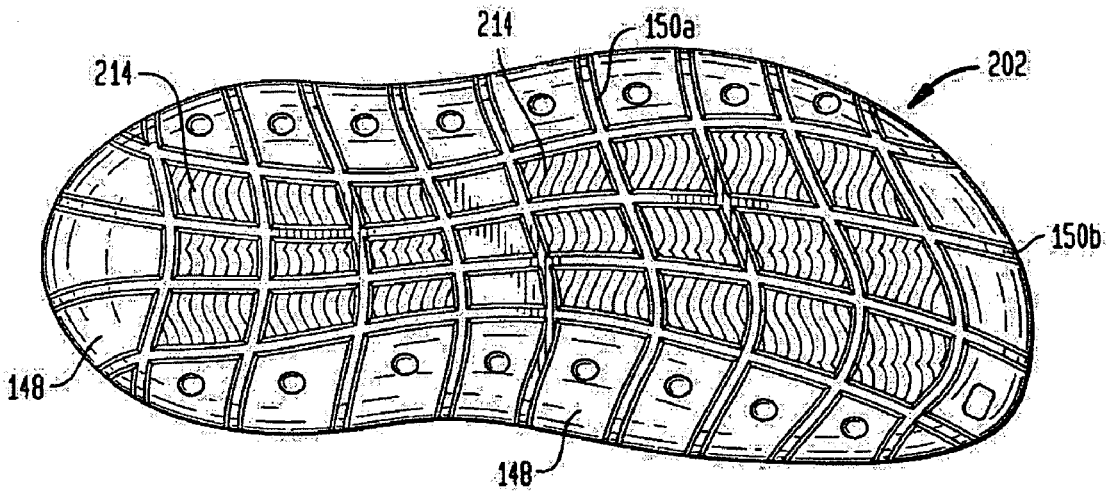
Figure 6A:
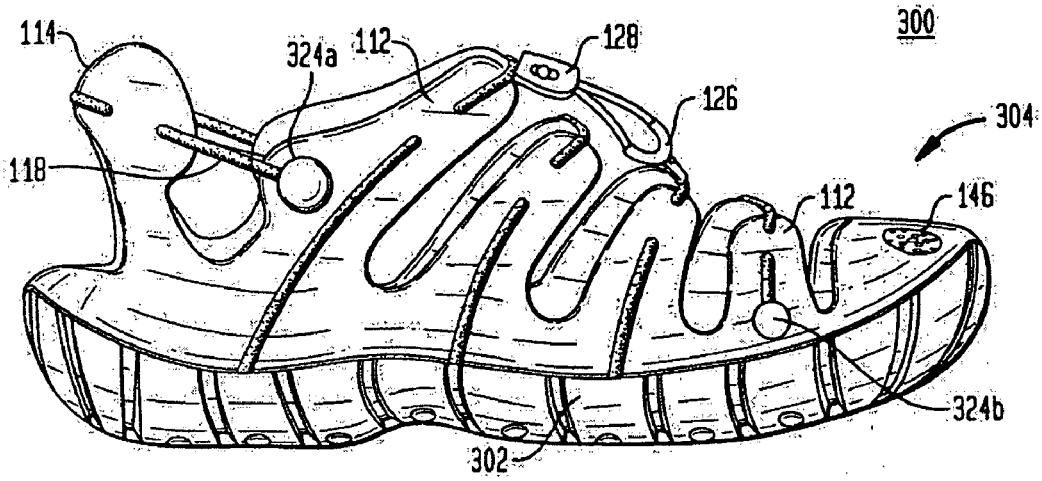
FIGS. 6(*a*)-(*f*) illustrate an article of footwear having another sandal configuration in accordance with aspects of the present invention.
Figure 6B:
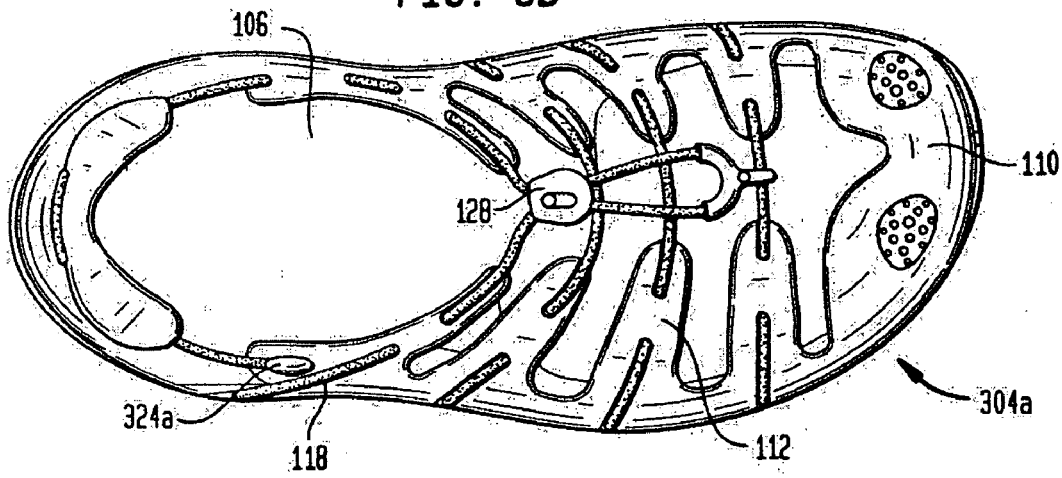
Figure 6C:
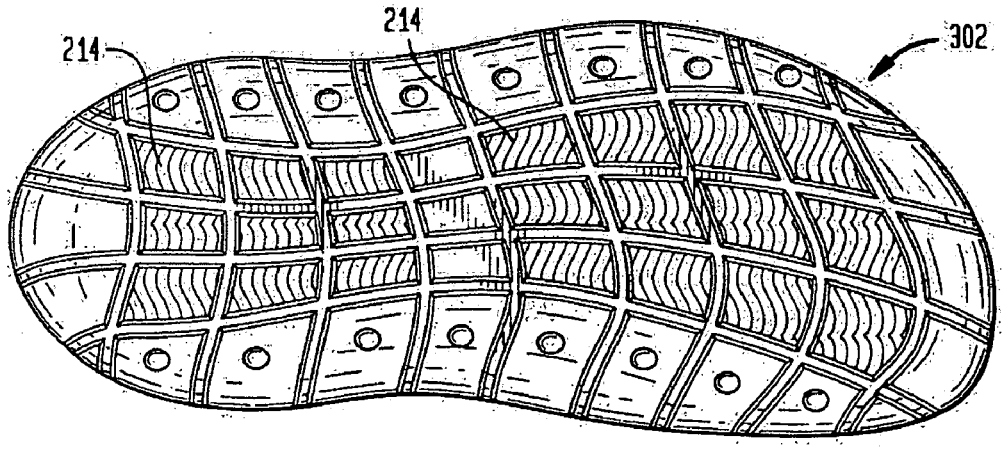
Figure 6D:
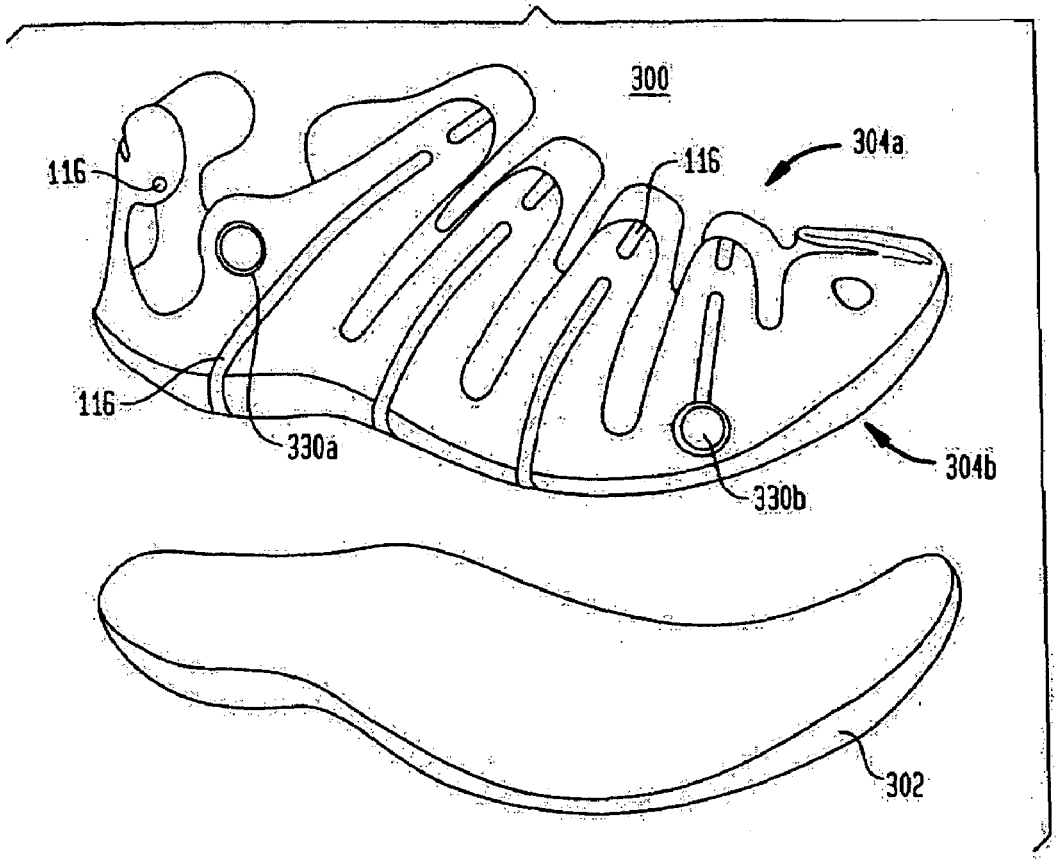
Figure 6E:
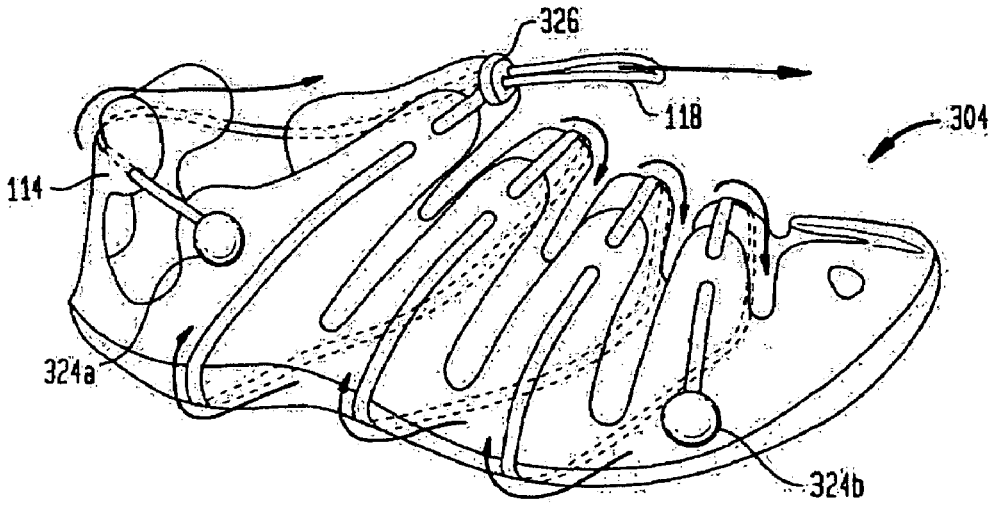
Figure 6F:
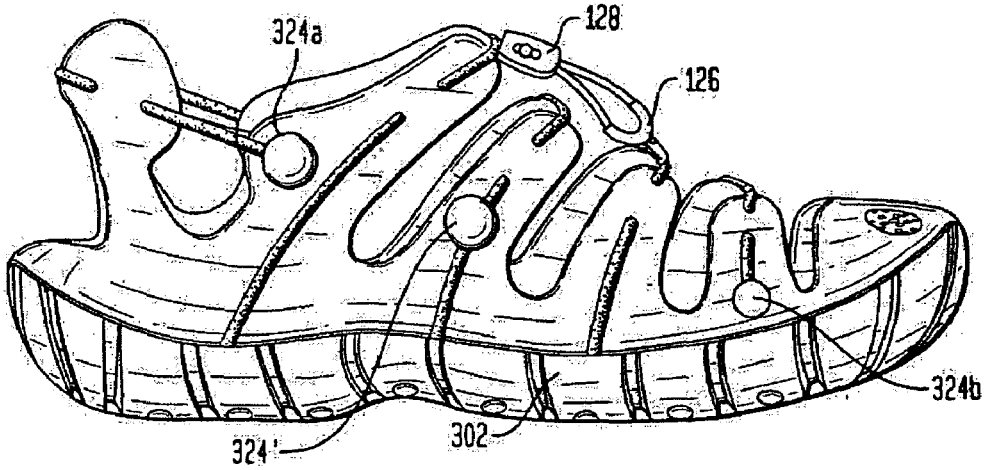

As mentioned above, the lacing system may also include one or both of the lace pull 126 and the lace locking mechanism 128. FIGS. 3(*a*)-(*c*) illustrate the lace pull 126. As shown in the front and rear views of FIGS. 3(*a*) and 3(*c*), respectively, the lace pull 126 generally has a "Y" shape. The rear side of the lace pull 126 may include a pathway 132 adapted to receive a portion of the lace 118 therein. As seen in the side view of FIG. 3(*b*), the lace pull 126 may include a storage hook or other connection member 134 for attaching the lace pull 126 to another portion of the lace 118. The storage hook 134 also keeps the lace 118 from becoming an annoyance or tripping hazard during use of the article of footwear 100.

FIGS. 4(*a*)-(*k*) illustrate the lace locking mechanism 128 in detail. As seen in the front and side views of FIGS. 4(*a*) and 4(*b*), respectively, the lace locking mechanism 128 includes a housing 136 and an adjuster 138 thereon. As seen in the respective top and bottom views of FIGS. 4(*c*) and 4(*d*), a pair of pathways 140 extend through the housing 136. The pathways are sized to allow the lace 118 to pass through. FIG. 4(*e*) illustrates the rear view of the lace locking mechanism 128.

FIG. 4(*f*) is a cutaway view along the 4A-4A line of FIG. 4(*b*) showing the interior of the housing 136. As seen in this view, the lace 118 is threaded through the pathways 140. A locking unit comprising a wedge 142 and a spring 144 are mechanically coupled to the adjuster 138, and permit or prevent adjustment of the lace 118 depending upon the position of the adjuster 138. FIG. 4(*g*) illustrates the lace 118 in the "locked" position with the adjuster 138 positioned near the top or first end of the housing 136. FIG. 4(*h*) shows the placement of the wedge 142 and the spring 144, with the wedge 142 being disposed near the top or first end of the housing 136. The surfaces of the pathways 140 and/or the surfaces of the wedge 142 adjacent the lace 118 may have ridges, protrusions or other structures to restrict the movement of the lace 118. FIG. 4(*i*) is a sectional view along the 4B-4B line of FIG. 4(*h*) showing placement of the wedge 142 in the locked position.

FIG. 4(*j*) illustrates the lace locking mechanism 128 in the "unlocked" position with the adjuster 138 positioned near the bottom or second end of the housing 136. FIG. 4(*i*) shows the placement of the wedge 142 and the spring 144, with the wedge 142 being disposed near the bottom or second end of the housing 136. The ridged or friction creating surfaces of the wedge 142 are not in contact with the lace 118. Thus, the lace 118 is free to move within the pathways 140. In a preferred example, the lace locking mechanism 128 is positioned at or near the top of the forefoot. However, the lace locking mechanism 128 can be positioned anywhere else along the upper 104*a*. Thus, it can be seen that the lace locking mechanism 128 allows for the securing and loosening of the lacing system and, in turn, the upper 104*a* to the foot of the wearer. Of course, any number of lace locking mechanisms 128 can be used with the article of footwear 100.

The lace pull 126 and the lace locking mechanism 128 may be used separately or together to provide enhanced security and a snug fit. When used in combination, the lace pull 126 may be added onto the lace 118 and positioned on the lace 118 after it exits one of the pathways 140 of the lace locking mechanism 128 but before reentering the other pathway 140 on the opposite side of the lace locking mechanism 128, as depicted in FIG. 1(*a*). This placement of the lace pull 126 would allow the lace 118 to be kept close and secure to top of the housing 104. In turn, this prevents the lace 118 from catching on objects. Furthermore, it is a common issue with footwear to have excess lace after adjusting the tension of the lace 118. Any number of lace pulls 126 or other form of lace hooks can be used to help store and secure the excess lace and prevent the lace 118 from catching on objects.

Returning to FIG. 1(*a*), another aspect of the present invention is a ventilation area at the top of the toe cap 110. As discussed above, the toe cap 110 provides protection for the front of the foot/toe area (e.g., metatarsals and phalanges) by protecting this area from direct contact with external objects. By incorporating areas on the top of the toe region that have holes or areas for ventilation, air and moisture can freely travel in and out, but debris is kept out of shoe.

In a preferred embodiment, ventilation and protection are achieved through openings or holes incorporated into the toe cover 110. Desirably, the ventilation holes have screens or "debris shields" fitted into/over the openings to maintain ventilation but keep debris out of the toe region of the shoe. It can be seen in FIG. 1(*a*) that openings of the toe cover 110 may include one or more debris shields 146. The ventilation holes in the debris shields 146 may be of various shapes and/or sizes. The debris shields 146 may be integrally formed as part of the toe cover 110 or may be added after the injection molding process. In one example, the debris shields comprise fine metal screens.

In addition to the secure lacing system and the ventilation in the toe cover 110, another aspect of the present invention provides optimized traction on the bottom of the article of footwear 100 for wet or smooth surfaces. This is preferably achieved through the use of both molded-in siping as well as the addition of siping cut in the opposite direction in the quad cut configuration. FIG. 1(*e*) illustrates a bottom view showing the portion of the outsole 102 which contacts the ground. As seen in this view, the outsole 102 may include one or more sections, quadrants, or regions 148. The regions 148 may be separated by lines or spacers 150*a* running partly or completely from the medial side to the lateral side of the article of footwear 100, as well as by longitudinal lines or spacers 150*b* running partly or completely from the toe region to the heel region of the article of footwear 100. Each region 148 may include symbols, logos, size information, style data, source identifiers, designs such as circles or other geometric patterns, etc. Each region 148 may also include structural features such as siping 152 to improve traction on wet surfaces. The siping 152 may be, for example, in a "quad cut" configuration, as shown in FIG. 1(*e*), where the siping runs both from side to side and front to back, for instance in an undulating or wave-like pattern that forms traction reinforcing microquadrants in the outsole 102. The siping 152 may be confined within one or more of the regions 148, or may also be incorporated into the lines or spacers 150*a,b*. FIGS. 1(*f*) and 1(*g*) illustrate front and rear views, respectively, of the article of footwear 100, showing the lacing 118, the regions 148, the spacers 150*a,b*, and the siping 152.

The siped outsole 102 provides traction on wet surfaces through diversion of water from the bottom surface of the outsole 102. The duel siped quad cut area provides optimized surface area contact for the wearer, enhancing the traction of the rubber outsole 102. The quad cut configuration is ideally suited for wet and/or smooth surface contact. Optionally, the quad cut configuration can be incorporated into specific areas of the outsole 102, such as the forefoot and the heel, while using more traditional lugs and/or other siping configurations on the medial/lateral perimeters to optimize for multi-surface use.

FIGS. 5(*a*)-(*c*) illustrate side, top and bottom views, respectively, of an article of footwear 200 similar to the article of footwear 100 discussed above. As with the article of footwear 100, the article of footwear 200 has a sandal configuration with the wraparound lacing system, as seen in FIGS. 5(*a*) and 5(*b*). The quad cut siping within the regions 148 is shown in FIG. 5(*c*). The differences between the article of footwear 200 and the article of footwear 100 will now be described. In the article of footwear 200, the housing 204 comprises an integrally molded upper and midsole (not shown) as well as an integrally molded footbed 206, which is part of the unitary housing 204.

As shown in the top view of FIG. 5(*b*), the integrally molded footbed 206 comprises two regions 206*a* and 206*b*, although any number of regions 206*n* may be employed. In the illustrated example, the regions 206*a* and 206*b* have different texture. For instance, the region 206*a* may be substantially smooth, and the region 206*b* may be ridged, siped or otherwise textured. The regions of different texture may be created via a pattern or texture in the mold. Additionally, the texture pieces may be created separately and then co-molded into the larger mold. Using this technique, the regions can be made of a material different from the larger component. This allows for a material of greater resiliency to be placed in high impact and/or high wear areas such as under the heel and forefoot where high impact forces are realized during locomotion. Preferably, the regions 206*a* and 206*b* comprise CMEVA. More preferably, these two regions comprise bonded CMEVA that is on the order of 3 mm thick, for example between 2 mm and 4 mm thick. Another difference from the article of footwear 100 is that the toe cover 210 does not include a debris screen or shield. Instead, the toe cover 210 includes openings 212 for ventilation. An alternative to the quad cut siping of FIG. 5(*c*) is shown in FIG. 5(*d*). Here, transverse siping 214 running between the medial and lateral sides of the outsole 200 is created, for example, by cutting the outsole 202 after initially molding the outsole 202. The lateral siping can also be formed during the molding process.

FIGS. 6(*a*)-(*c*) illustrate side, top and bottom views, respectively, of an article of footwear 300 generally similar to the article of footwear 100 discussed above. As with the article of footwear 100, the article of footwear 300 preferably has a sandal configuration with the wraparound lacing system, as seen in FIGS. 6(*a*) and 6(*b*). The quad cut siping in the outsole 102 is shown in FIG. 6(*c*), and is preferably molded in the outsole 102. The main difference between the article of footwear 300 and the article of footwear 100 pertains to the lace end retention system, which will now be described.

As shown in FIG. 6(*a*), the lacing system of the article of footwear 300 preferably includes a pair of lace end keepers or end caps 324*a* and 324*b*, the lace pull 126, and the lace locking mechanism 128. In the present embodiment, the first and second ends of the lace 118 are secured or anchored by the lace end keepers 324*a* and 324*b*, respectively. As with the lace end keeper 124, the lace end keepers 324*a* and 324*b* preferably each comprise a plug or cap which fit into receptacles in the fingers 112. As shown, the lace end keeper 324*a* is positioned on a first selected finger 112 in the lateral metatarsal region near the toe cover 110, and the lace end keeper 324*b* is positioned on a second selected finger 112 in the lateral forefoot region near the ankle. One or both of the lace end keepers 324*a,b* may be placed on either the medial or the lateral side of the article of footwear 300. The lace end keepers 324*a* and 324*b* are desirably removably insertable into the receptacles on the fingers 112, permitting access to the ends of the lace 118 held therein. Alternatively, the lace end keepers 324*a,b* may be bonded into the receptacles, for instance by using an appropriate bonding agent such as water or solvent based cement.

FIG. 6(*d*) is an exploded view of the article of footwear 300, illustrating the integrally molded upper 304*a* and midsole 304*b* and the separate outsole 302. In this view, the lace 118 is omitted to show the channels 116 and the lace end keepers 324*a* and 324*b* are omitted to show respective cavities or receptacles 330*a* and 330*b*.

In a preferred embodiment, lace tension adjustment can be made by the wearer as follows. A first one of the lace end keepers 324*a* or 324*b* can be opened by wearer. The end of the lace 118 can be removed from the receptacle and cut to appropriate length. Then the end of the lace 118 is placed back into the receptacle and the lace end keeper 324*a* or 324*b* is put back in place by the wearer to lock in the lace 118. The lace end may be burned and/or knotted for security and snug fit within the receptacle. The same procedure can be repeated at the other one of the lace end keepers 324*b* or 324*a*. The adjustment may be a one-time adjustment which allows for customization of fit to an individual's foot. Daily or routine adjustment of the lace tension is preferably accomplished by pulling on the lace pull 126 and/or the lace locking mechanism 128. It is also possible to replace the lace 118, for example to change out a broken lace or to change the style, size, etc.

As with the lace end keeper 124 and the receptacle 130, the lace end keepers 324*a,b* and the associated receptacles in the upper of the article of footwear 300 may have any number of configurations that can allow for an adjustable and secure receipt of the lace end. For example, the lace end keepers 324*a* and/or 324*b* may incorporate the use of a needle or pronged end to pin the lace end within the receptacle when placing the cap back on. Alternatively, it is possible to wind the lace 118 about the lace end keeper 324*a* and/or 324*b* to adjust its fit. The unique wrap around, adjustable, lacing system with two anchor points, one at the lace end keeper 324*a* and the other at the lace end keeper 324*b* provide a secure fit and even pressure distribution across the foot. It is desirable to have low friction on the lace 118 to keep pressure distribution even and to prevent abrasion or fraying of the lace 118.

FIG. 6(*e*) illustrates a view of the integrally molded housing 304 with the lace 118, the lace end keepers 324*a* and 324*b*, and a modified lace pull 326. The arrows show how the lace 118 wraps around the housing 304 in the spiral configuration, e.g., a circumferential, helical or coiled pattern, and that it may be pulled and tightened using the lace pull 326. If the lace pull 326 is included, it may be slid forward or backward relative to the loop of the lace 118, thereby loosening or tightening the lace 118.

While only two lace end keepers 324*a* and 324*b* are shown, any number of lace keepers may be positioned along the housing 104 between the endpoints of the lace 118. For instance, as seen in FIG. 6(*f*), at least one mid-lace keeper 324' may be positioned along one of the fingers 112. The mid-lace keeper 324' provides for separate adjustment of the lace 118 aside from adjustment at the endpoints of the lace 118. The mid-lace keeper 324' allows the user to perform separate adjustments and thus varying amounts of lace tension across different areas or zones of the foot. For instance, many people apply low lace tension across the toe box and higher lace tension across the instep region to provide a secure fit across the instep region with a looser fit across the toes. A single lace 118 or multiple laces 118 may be employed across one or more of the zones. If multiple laces 118 are used, each lace 118 may include any number of lace keepers such as the lace end keepers 324*a,b* and/or the mid-lace keeper(s) 324'. Multi-zone adjustment permits the wearer to achieve a desired fit. The mid-lace keeper 324' may be used in place of or in combination with the lace pull 126 and the lace locking mechanism 128. The mid-lace keeper 324' can be adjusted in the same or a similar manner to the adjustment of the lace end keepers 324*a* and 324*b*. A pin, needle, cleat, etc. can be used to hold the lace 118 in place along with the mid-lace keeper 324', and then further adjustment may be made at one or both of the lace end keepers 324*a* and 324*b*. Alternatively, it is possible to wind or twist the lace 118 about the mid-lace keeper 324' to adjust its fit. The placement of the lace keeper(s) is not limited to any specific point on the housing 104; instead lace keepers such as the lace end keepers 324*a,b* and/or the mid-lace keeper(s) 324' may be positioned at any point or region of the upper 304*a* in which they can be coupled to or otherwise in communication with the lace 118.

Figure 7:
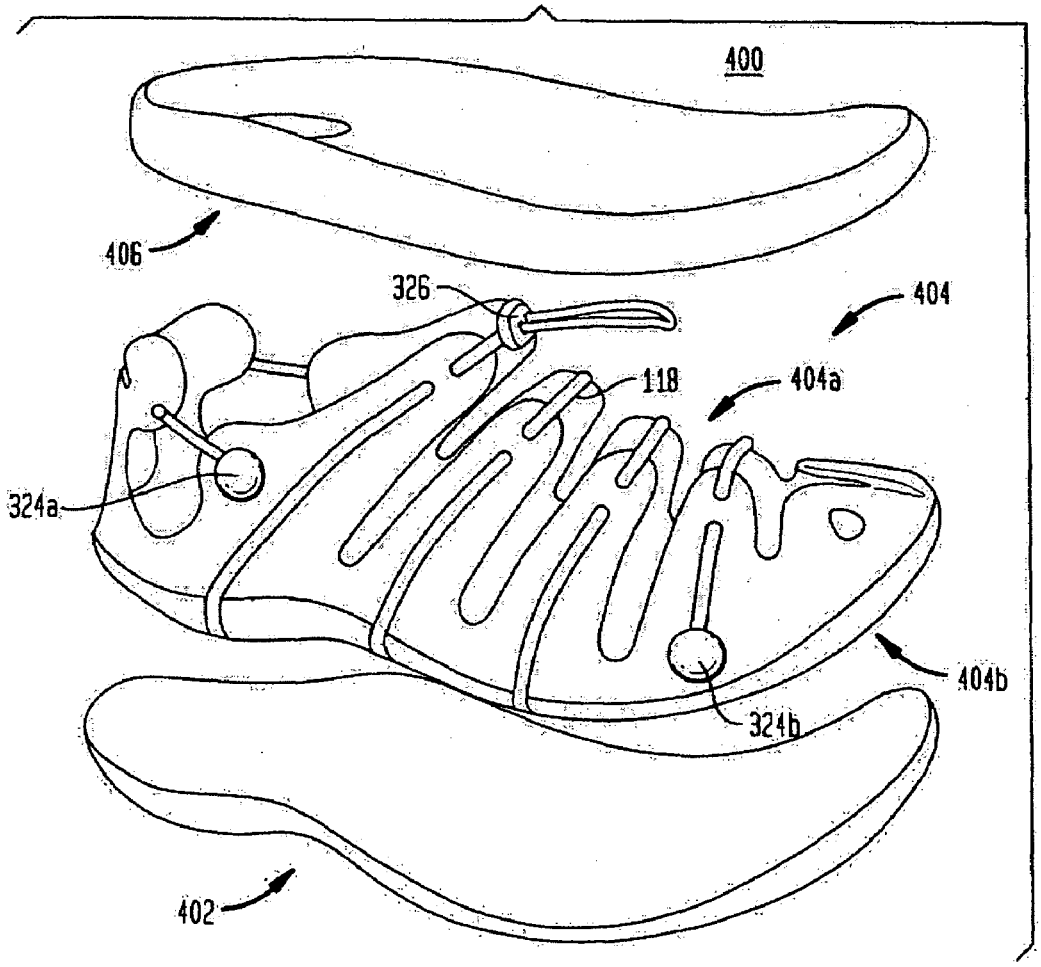
FIG. 7 illustrates an article of footwear having a further sandal configuration in accordance with aspects of the present invention.

FIG. 7 illustrates an exploded view of an article of footwear 400 generally similar to the article of footwear 300 discussed above. The article of footwear 400 preferably has a sandal configuration with the wraparound lacing system. In the embodiment of FIG. 7, the article of footwear 400 comprises an outsole 402, an integrally molded housing 404 including upper 404*a* and midsole 404*b*, and a footbed 406. The footbed 406 is preferably formed of foam rubber, but can be made with any suitable material or materials, such as EVA, PU, latex rubber, cork, leather, etc.

More preferably, the footbed 406 is a removable self customizing footbed. In this embodiment, the footbed 406 may be constructed of CMEVA with a top layer of moldable foam. The moldable foam may be a polyolefin foam such as the nitrogen expanded polyolefin foam marketed under the trademark Plastazote® from Zotefoams PLC, which allows the footbed to contour to the wearer's foot over time. Moldable foams enhance both comfort and security during wear. The use of a removable antimicrobial footbed cover can also be incorporated into the footbed 406. Antimicrobial properties incorporated into materials can reduce the growth of mold, bacteria, mildew and fungus often associated with warm, moist environments. This can be accomplished by the use of materials treated with an antimicrobial compound as is known in the art, or by the use of inherently antimicrobial material such as bamboo fiber. The removable footbed 406 allows for faster drying time and cleaning if necessary. Alternatively, the removable footbed 406 can easily be removed and washed separately from the article of footwear 400, if necessary.

Figure 8:
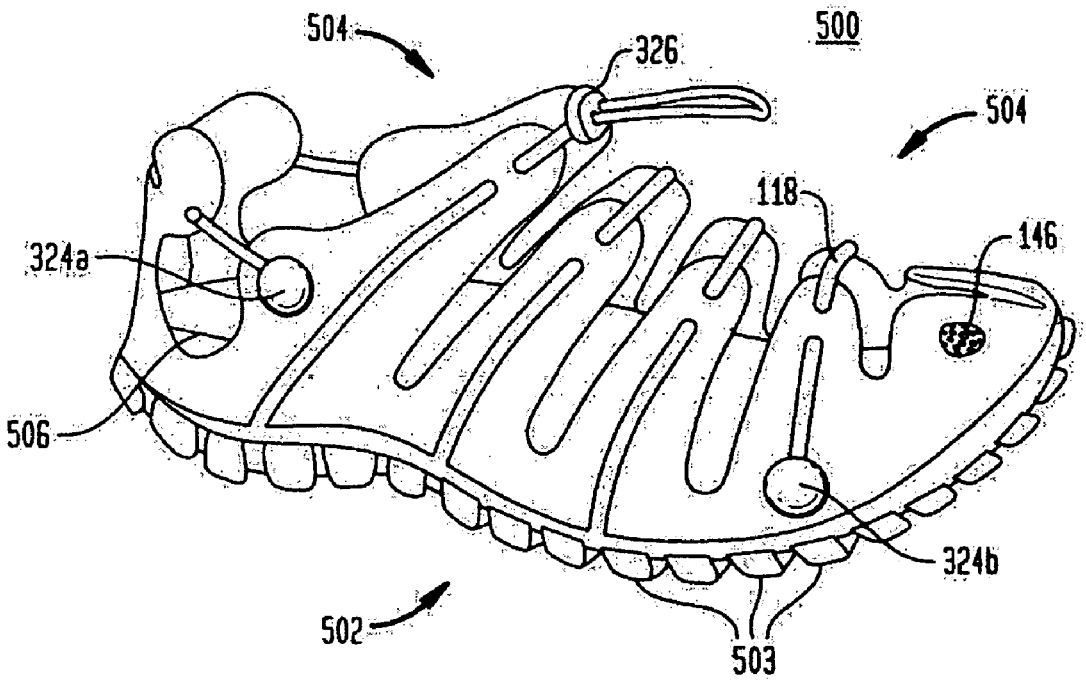
FIG. 8 illustrates an article of footwear in accordance with aspects of the present invention.
Figure 9A:
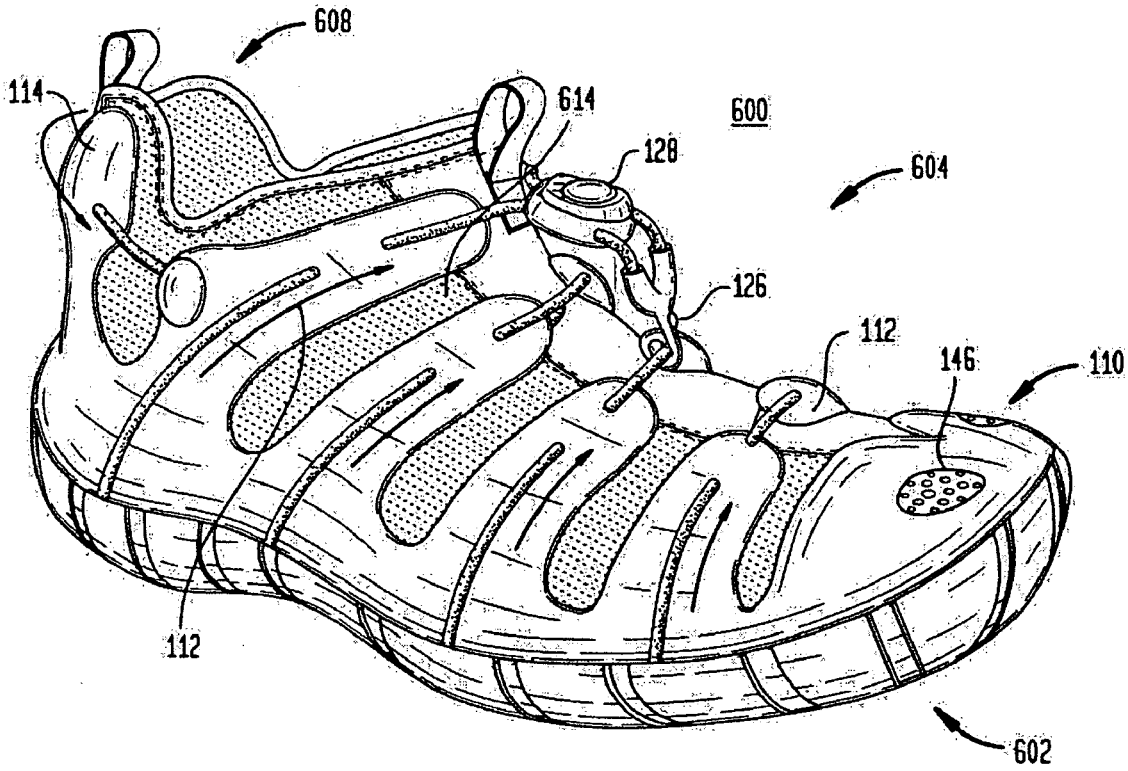
FIGS. 9(*a*)-(*h*) illustrate an article of footwear having a removable liner in accordance with aspects of the present invention.
Figure 9B:
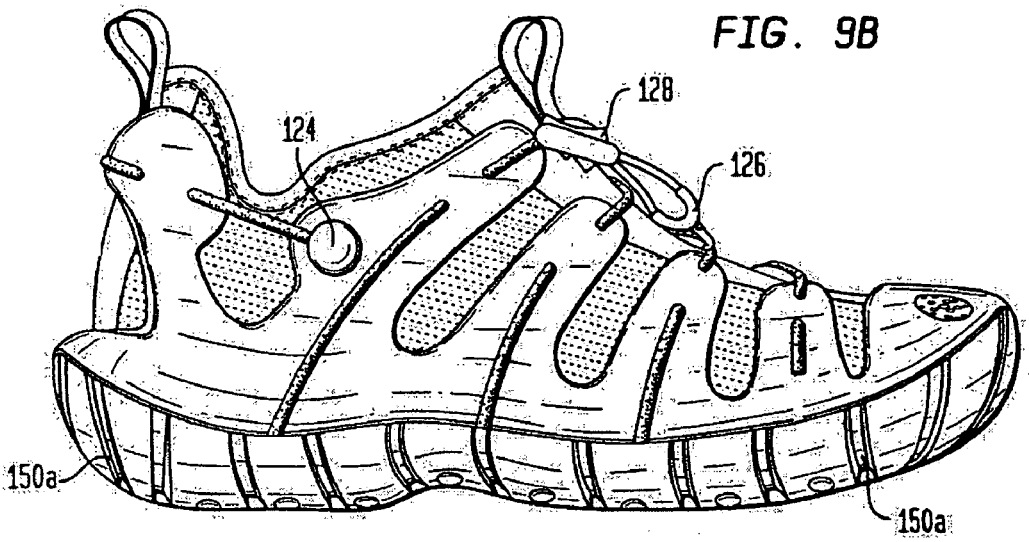
Figure 9C:
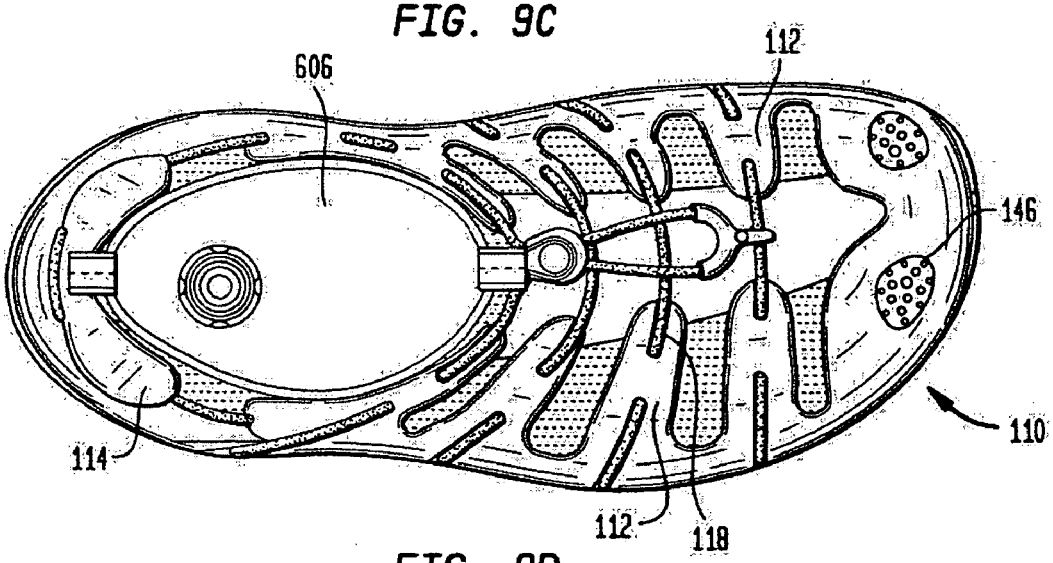
Figure 9D:
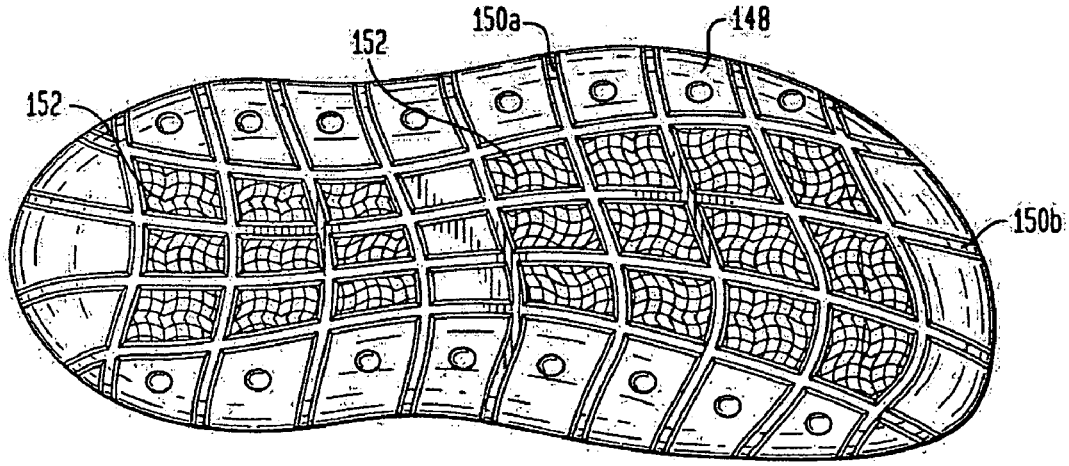
Figure 9E:
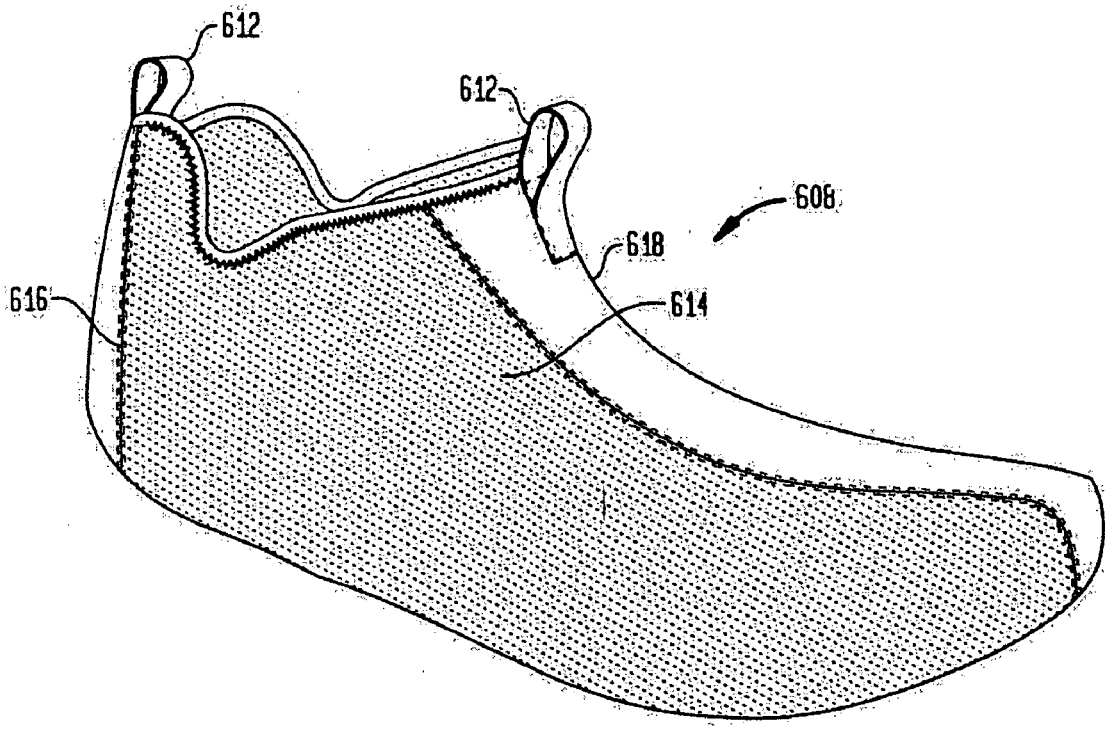
Figure 9F:
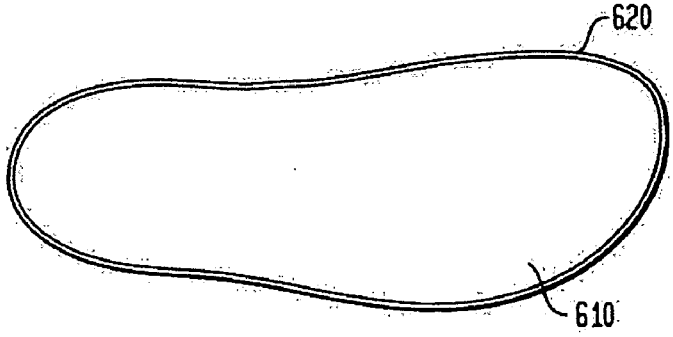
Figure 9G:
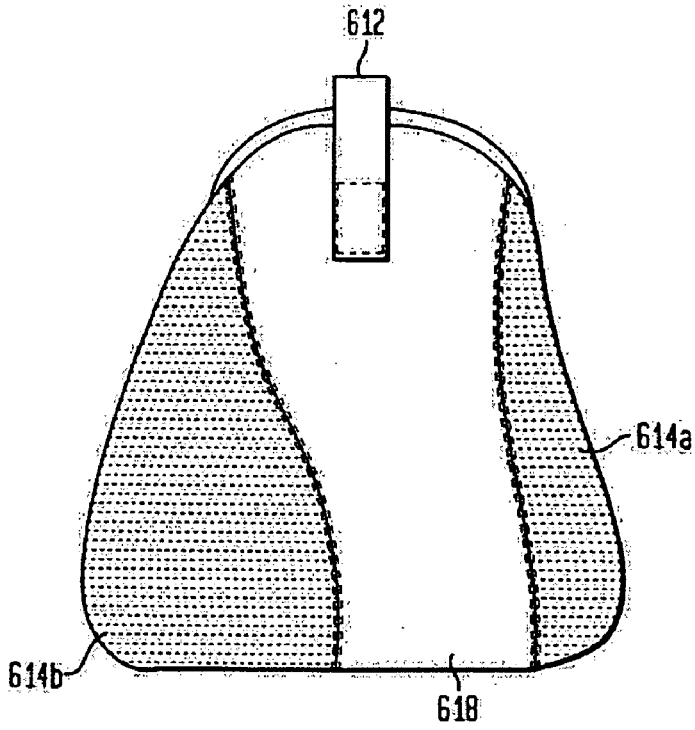
Figure 9H:
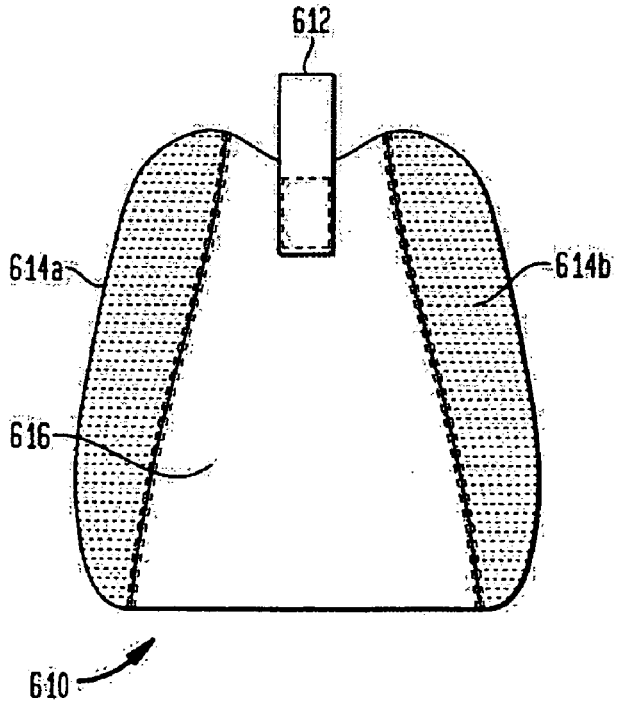
Figure 10A:
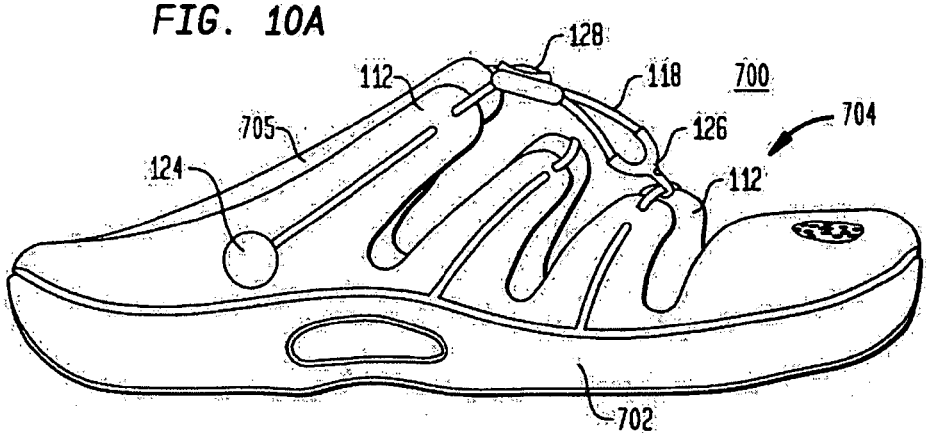
FIGS. 10(*a*)-(*d*) illustrate an article of footwear having a slide configuration in accordance with aspects of the present invention.
Figure 10B:
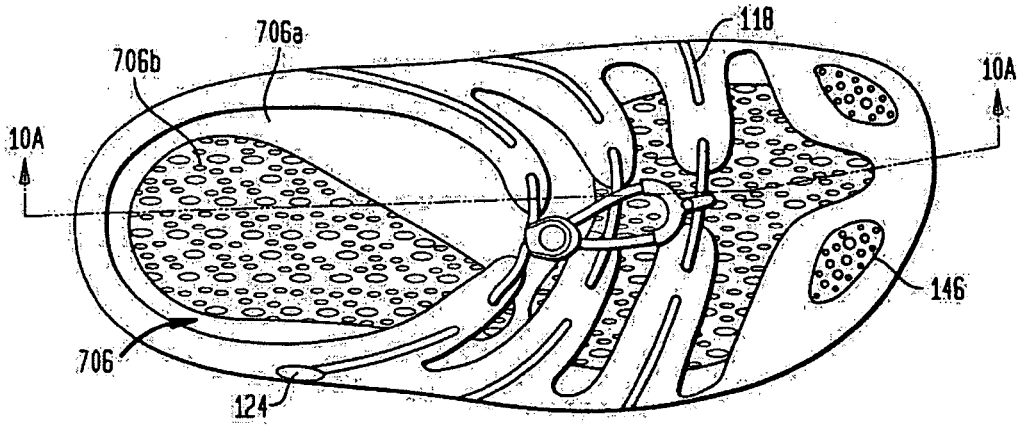
Figure 10C:
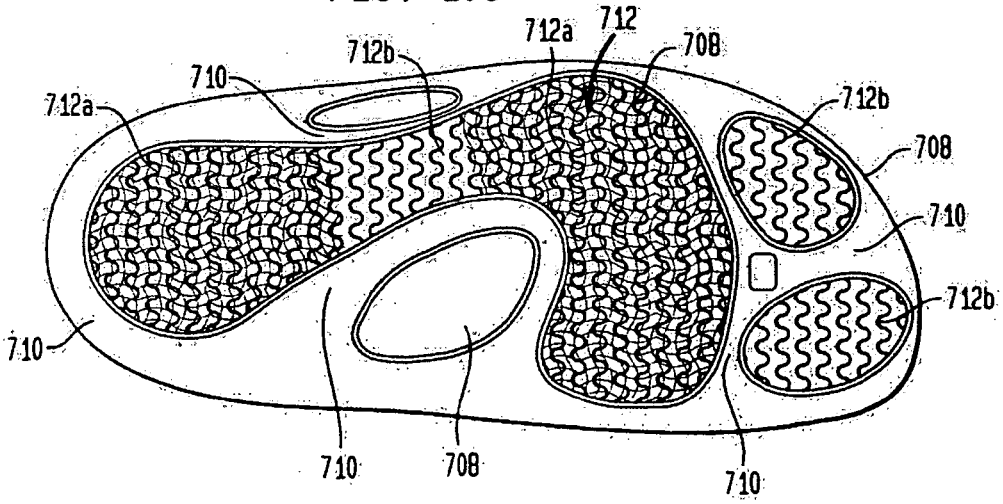
Figure 10D:
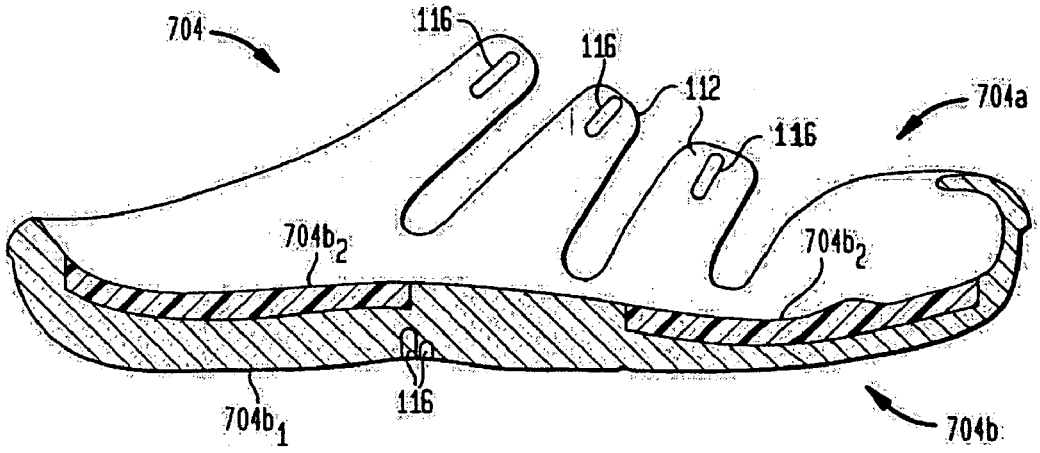
Figure 11A:
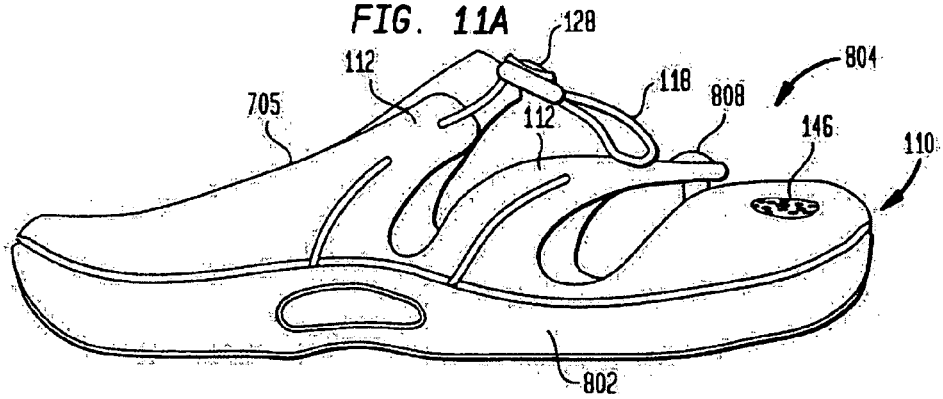
FIGS. 11(*a*)-(*g*) illustrate an article of footwear having a flip-flop or thong sandal configuration in accordance with aspects of the present invention.
Figure 11B:
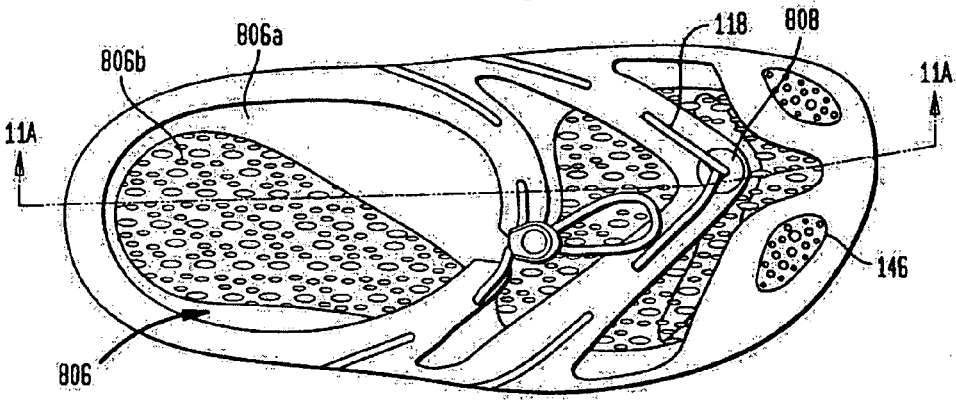
Figure 11C:
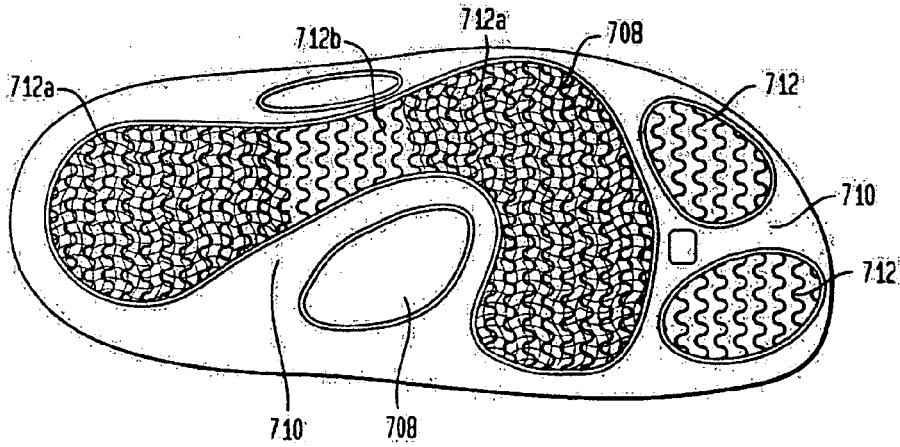
Figure 11D:
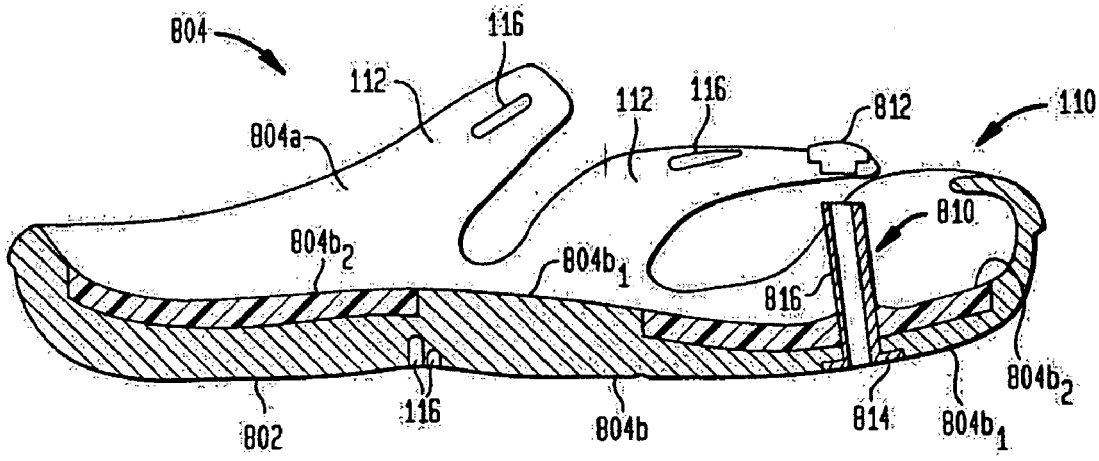
Figure 11E:
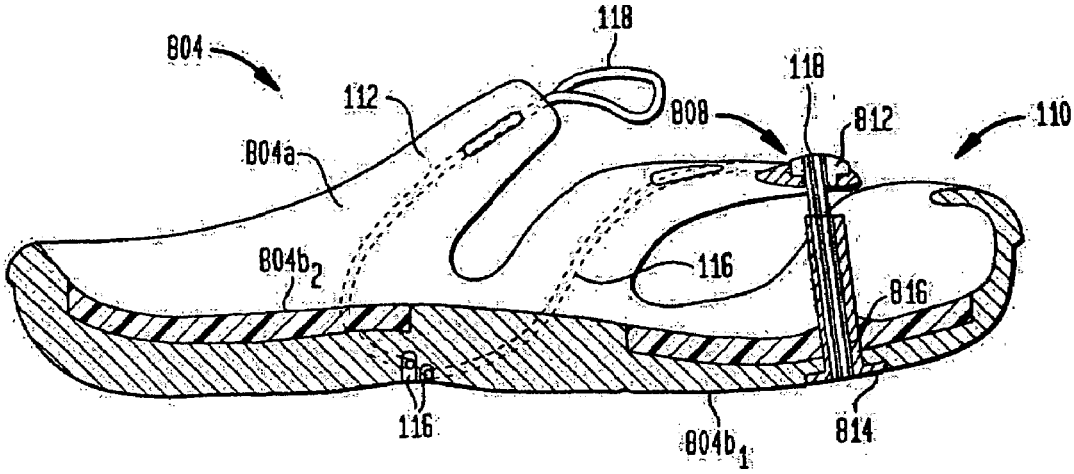
Figure 11F:
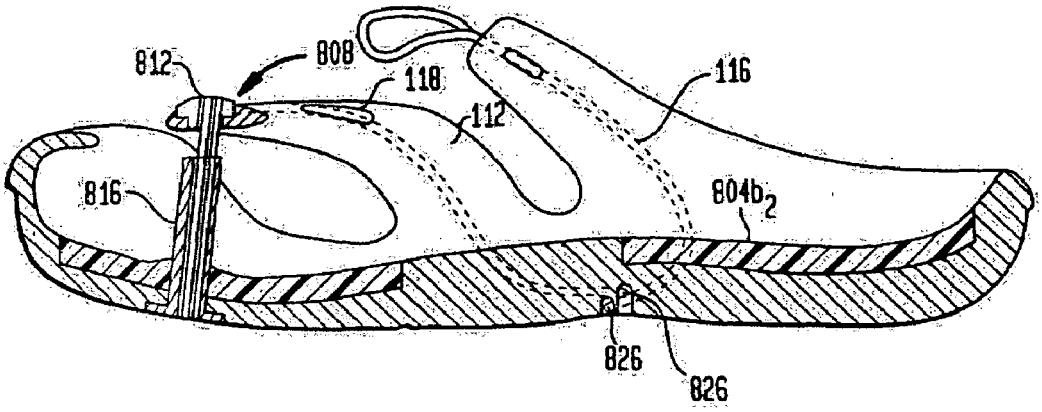
Figure 11G:
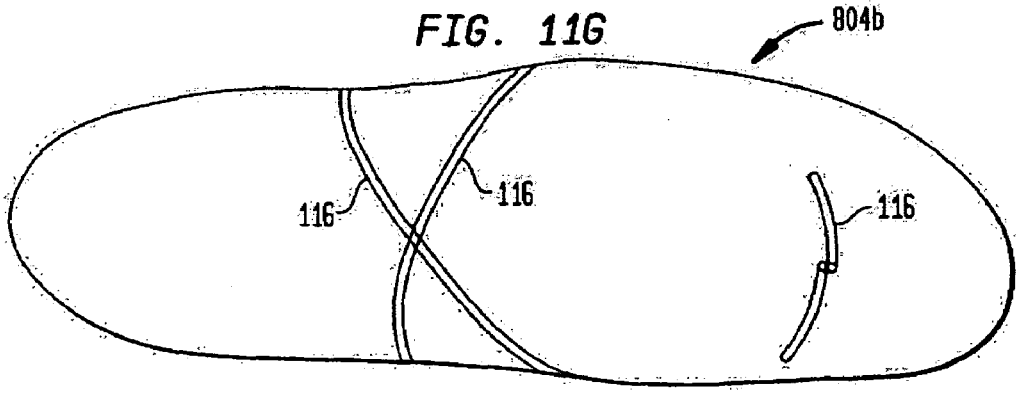
Figure 12A:
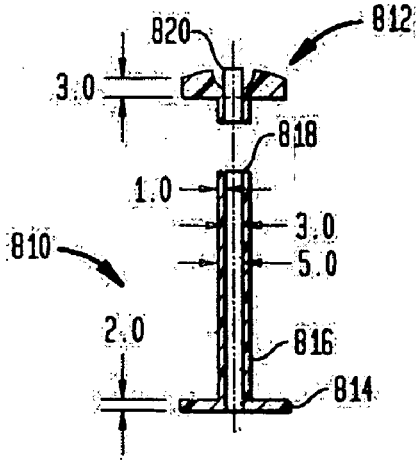
FIGS. 12(*a*)-(*d*) illustrate a toe post for use with the thong sandal of FIGS. 11(*a*)-(*d*).
Figure 12B:
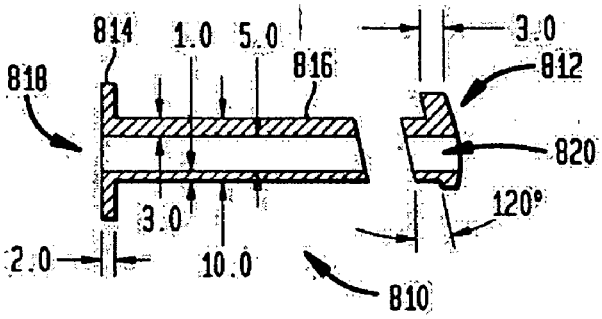
Figure 12C:
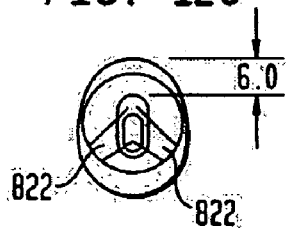
Figure 12D:
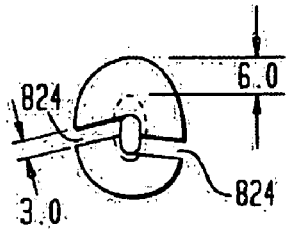

FIG. 8 illustrates a perspective view of an article of footwear 500 generally similar to the article of footwear 400 discussed above. As with the article of footwear 400, the article of footwear 500 has a sandal configuration with the wraparound lacing system. In the embodiment of FIG. 8, the article of footwear 500 comprises an integrally molded unit having outsole 502, housing 504 including an upper and a midsole (not shown), and a footbed 506. The outsole 502 preferably includes a plurality of lugs 503 in place of or in combination with siping. In this unitary structure, the lace 118 may run through channels in or along the outsole 502, or, alternatively, between rows of the lugs 503. The housing 504 preferably comprises IMEVA. The outsole 502 and/or the footbed 506 may also comprise IMEVA so that the article of footwear 500 is formed as a homogenous structure. Alternatively, the outsole 502 and/or the footbed 506 may be formed of different materials such as those described in other embodiments of the present invention. Nonetheless, in this embodiment, the outsole 502, housing 504 and footbed 506 are formed as a unitary structure. The lacing configurations of this embodiment may be the same as for the other embodiments discussed herein.

FIGS. 9(*a*)-(*h*) illustrate an article of footwear 600 in accordance with another preferred embodiment of the present invention. As seen in the perspective, side, top and bottom views of FIGS. 9(*a*)-(*d*), respectively, the article of footwear 600 has a shoe configuration, such as a wet boot, incorporating the wraparound lacing system described above. As shown, the article of footwear 600 comprises an outsole 602, integrally molded housing 604 including an upper and a midsole (not shown), and a footbed 606. The article of footwear 600 also includes a bootie or sockliner 608.

The bootie 608 is preferably a stretch bootie adapted to fit into the molded upper of the housing 604. The bottom surface 610 (see FIG. 9(*f*)) of the bootie 608 may be bonded to the top surface of the midsole. In this case, the footbed 606 is desirably a removable footbed 606 that can be received into the interior of the bootie 608. Alternatively, the bootie 608 may be removable from the housing 604.

As seen in the perspective view of FIG. 9(*e*) and the front and back views 9(*g*) and 9(*h*), respectively, the bootie 608 may include one or more finger pulls 612, which may be made of webbing. In a preferred embodiment, there are two finger pulls 612, one at the front and one at the back of the collar of the bootie 608. The finger pulls 612 allow the wearer to quickly and easily remove the bootie 608 from the housing 604. If the bootie 608 is bonded to the midsole or otherwise secured to the housing 604, the finger pulls 612 enable the user to pull the article of footwear 600 on easily.

Sidewalls 614 preferably comprise a breathable mesh, such as a coated, hydrophobic, breathable mesh. The breathable mesh is desirably lightweight and waterproof, allowing for added protection of the skin while complementing the features of the EVA upper to provide comfort, contour and a secure fit to the wearer. As shown in the front view of FIG. 9(*g*), medial sidewall 614*a* and lateral sidewall 614*b* need not be the same. Heel section 616 and instep section 618 preferably comprise non-stretch microfiber fabric. The edges 620 of the sidewalls 614 may be strobel stitched to a non-woven lasting board of the bottom 610.

In an alternative example, the bootie 608 may incorporate stretch wovens or knits in conjunction with a form fitting, insulting, waterproof material such as neoprene, which may be utilized with or without an additional layer or layers of a polyester stretch knit material, such as a Spandex-type material or insulating material such as fleece. The insulating material is especially desirable in cold climates. The stretch wovens or knits, waterproof materials and/or the insulating materials provide flexibility, comfort, waterproofing or water resistance, as well as insulation. All of these benefits are available in conjunction with the benefits of the durable, pliable, and protective housing 604.

FIGS. 10(*a*)-(*d*) illustrate an article of footwear 700 in accordance with another preferred embodiment of the present invention. As seen in the side and top views of FIGS. 10(*a*)-(*b*), respectively, the article of footwear 700 preferably has a slide configuration incorporating the wraparound lacing system described above. This style of footwear with a low back area allows for quick entry and exit of the wearer's foot from the article of footwear 700. As shown, the article of footwear 700 comprises an outsole 702, integrally molded housing 704 including an upper and a midsole (not shown), and a footbed 706.

As described above with regard to a preferred embodiment of the article of footwear 100, the lace 118 winds around and through the fingers 112 and between the midsole and the outsole 702. Unlike the configurations above, the slide 700 does not include a heel support. Instead, the slide 700 is open at the rear. Nonetheless, a first end of the lace 118 is desirably knotted and bonded in a recess of the midsole (not shown), thereby anchoring or otherwise securing a first end of the lace 118 to the article of footwear 700 between the midsole and the outsole 702. The second end of the lace 118 is secured or anchored by the lace end keeper 124, which, as seen in FIG. 10(*a*), may be positioned at or near the bottom of the rearmost finger 112 on either the medial or lateral side of the slide 700. Alternatively, the lace end keeper 124 may be positioned anywhere else along the housing 704. A sizing indicator 705 may be screen printed on the inside of one of the fingers 112.

As shown in the top view of FIG. 10(*b*), the footbed 706, which may be integrally molded to the housing 704, may comprise at least two regions 706*a* and 706*b*, although any number of regions 706*n* may be employed. In the illustrated example, the regions 706*a* and 706*b* have different texture. For instance, the region 706*a* may be substantially or generally smooth, while the region 706*b* may be ridged, siped, embossed or otherwise textured.

The present invention provides optimized traction on the bottom of the slide 700 for wet or smooth surfaces. This is achieved through the use of both molded-in siping as well as the addition of siping cut in the opposite direction in the quad cut configuration. The bottom view of FIG. 10(*c*) shows that the outsole 702 may include one or more sections, quadrants, or regions 708. The regions 708 may be separated by spacers 710, which may also include a border around the exterior portion of the outsole 702. Each region 708 may include symbols, logos, size information, style data, source identifiers, designs such as circles or other geometric patterns, etc. Each region 708 may also include structural features such as siping 712 to improve traction on wet surfaces. The siping 712 may be, for example, in a quad cut configuration 712*a* and/or a "waffle cut" configuration 712*b*. The siping 712 may be confined within one or more of the regions 708, or may also be incorporated into the spacers 710. The quad cut siping 712*a* and the waffle cut siping 712*b* and/or other siping configurations may be within the same region 708.

The siped outsole 702 provides traction on wet surfaces through diversion of water from the bottom surface of the outsole 702. The duel siped quad cut areas 712*a* provide optimized surface area contact for the wearer, enhancing the traction of the rubber outsole 702. The quad cut configuration 712*a* is ideally suited for wet and/or smooth surface contact. Optionally, the quad cut configuration can be incorporated into specific areas of the outsole 702, such as the forefoot and the heel, while using more traditional lugs and/or other siping configurations such as the waffle cut 712*b* on the medial/lateral perimeters to optimize for multi-surface use.

FIG. 10(*d*) illustrates a sectional view along the 10A-10A line of FIG. 10(*b*), illustrating the inside lateral portion of the housing 704 of the article of footwear 100. While some details are omitted for clarity, such as the debris shield 146, the interior lacing channels 116 are shown on the inside of the fingers 112 and the lacing channels 116 on the underside of midsole 704*b* are also shown. The midsole 704*b* may include a first region $\mathbf{704}b_1$ of EVA foam having a first density or hardness, and a second region $\mathbf{704}b_2$ of EVA foam having a second density or hardness. One or more second regions $\mathbf{704}b_2$ may be strategically positioned on the surface of the midsole 704*b*, for example beneath the metatarsal and heel regions of the foot to absorb forces applied by these portions of the foot.

FIGS. 11(*a*)-(*c*) illustrate an article of footwear 800 in accordance with another preferred embodiment of the present invention. As seen in the side and top views of FIGS. 11(*a*)-(*b*), respectively, the article of footwear 800 preferably has a flip-flop or thong sandal configuration incorporating the wraparound lacing system described above. As shown, the thong sandal 800 comprises an outsole 802, integrally molded housing 804 including an upper and a midsole (not shown), and a footbed 806. The thong sandal 800 is somewhat similar to the slide 700, although a few differences will become evident.

As described above with regard to a preferred embodiment of the article of footwear 100, the lace 118 winds around and through the fingers 112 and between the midsole and the outsole 802. It can be seen that there are only two fingers 112 on either side of the thong sandal 800, in contrast to the three fingers 112 on either side of the slide 700. However, it should be understood that any number of fingers 112 can be used on either the slide 700 or the thong sandal 800. Some or all of the medial and lateral fingers 112 may be separate or connected together.

As shown in the top view of FIG. 11(*b*), the footbed 806, which may be integrally molded to the housing 804, may comprise at least two regions 806*a* and 806*b*, although any number of regions 806*n* may be employed. The regions 806*a* and 806*b* may be the same configuration as the regions 706*a* and 706*b*. For instance, the regions 806*a* and 806*b* may have different texture. The region 806*a* may be substantially or generally smooth, while the region 806*b* may be ridged, siped, embossed or otherwise textured.

As with the slide 700, the thong sandal 800 does not include a heel support. Instead, thong sandal 800 is open at the rear. In this configuration, an alternative to lace end keepers may be used. For instance, a first end of the lace 118 is desirably knotted and bonded in a first recess of the midsole (not shown), thereby anchoring or otherwise securing the first end of the lace 118 to the thong sandal 800 between the midsole and the outsole 802. Similarly, the second end of the lace 118 is desirably knotted and bonded in a second recess of the midsole (not shown), thereby anchoring or otherwise securing the second end of the lace 118 to the thong sandal 800 between the midsole and the outsole 802.

While lace end keepers are not required, the lace locking mechanism 128 can be used alone or in combination with a lace pull (not shown). In addition to the lace locking mechanism 128, the thong sandal 800 preferably includes a toe post or toe stem 808. The toe stem 808 is preferably a retractable or "floating" toe stem 808. The toe stem 808 can assist in securing the foot within footwear and as an anchor for the wrap lacing system. The floating toe stem 808 preferably allows the upper to travel up or down to secure the forefoot when adjusting the lacing system. Of course, it should be understood that the toe stem 808 can be used in other types of footwear besides the thong sandal 800.

FIGS. 12(*a*)-(*d*) illustrate the toe stem 808 in more detail. The dimensions in these figures are preferred sizes in millimeters, although it should be understood that different size toe stems 808 could be employed. As seen in the front view of FIG. 12(*a*) and the side view of FIG. 12(*b*), the toe stem 808 includes two main parts, namely a base 810 and a top 812. The toe stem 808 is called a floating toe stem because the top 812 is not directly affixed to the base 810. The base 810 includes a pedestal 814 and a tubular body 816. There is an open channel 818 running through the pedestal 814 and the tubular body 816. The top 812 also includes a channel 820 therein. The lace 118 runs through the channels 818 and 820 and connects the top 812 to the base 810, allowing the top 812 to float or move relative to the base 810. Of course, a standard, one-piece toe stem with a hollow core may also be used without presenting significant changes to the lacing system.

FIG. 12(*c*) is a top-down view of the toe stem 808. As shown in this figure, the top 812 of the toe stem 808 may be circular, and preferably includes an angled or "V" shaped recess or depression 822 on the upper surface facing away from the base 810. The recess or depression 822 is designed to receive the lace 118 thereon. As shown in FIG. 12(*d*), the bottom 810 of the toe stem 808 may have an oval shape, and may also include a pair of notches 824 therein. The notches 824 receive portions of the lace 118.

FIG. 11(*d*) illustrates a cutaway view of the thong sandal 800 along the 11A-11A line of FIG. 11(*b*). This cutaway view of the interior lateral side of the thong sandal 800 shows the placement of the toe stem 808 absent the lace 118. As seen in the figure, the pedestal 814 and a lower portion of the tubular body 816 are disposed in midsole 804*b*. The midsole 804*b* may include a first region 804$b_1$ of EVA foam having a first density or hardness, and a second region 804$b_2$ of EVA foam having a second density or hardness. The toe stem 808 may run through one or both of the first and second regions 804$b_1$ and 804$b_2$. The top 812 of the toe stem 808 is disposed in upper 804*a* of the housing 804, preferably along the finger 112 positioned closest to the toe cover 110.

FIGS. 11(*e*)-(*f*) illustrates cutaway view of the thong sandal 800 along the 11A-11A line of FIG. 11(*b*) showing the interior lateral side and interior medial side, respectively, with the wraparound lace 118. As seen in these figures, the lace 118 runs through the channels 116 and through the toe stem 808. FIG. 11(*g*) illustrates the underside of the midsole 804*b* with the channels 116 therein. The view of FIG. 11(*g*) also shows that the lace 118 may cross over itself within the crossed channels 116.

Figure 13A:
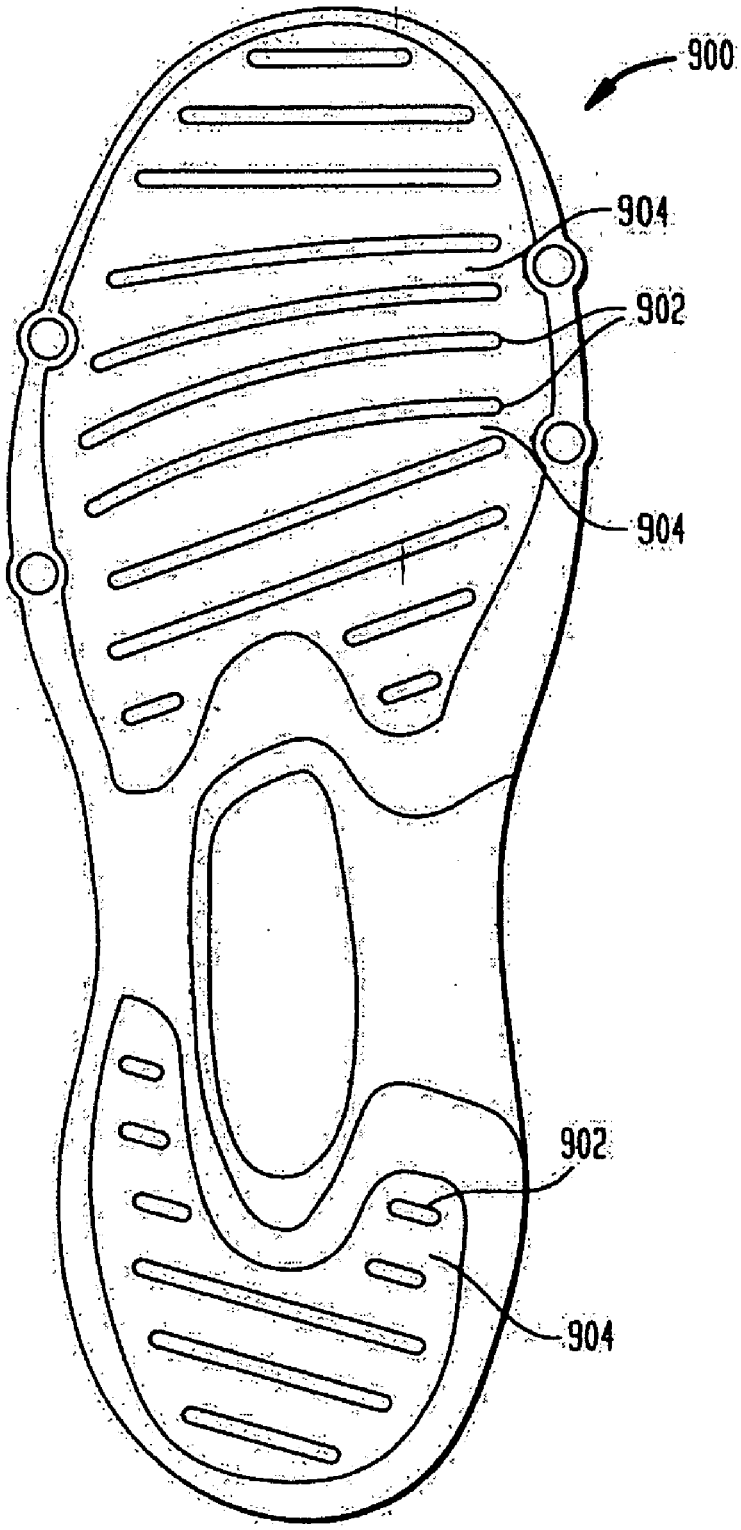
FIGS. 13(*a*)-(*c*) illustrate alternative outsole configurations in accordance with aspects of the present invention.
Figure 13C:
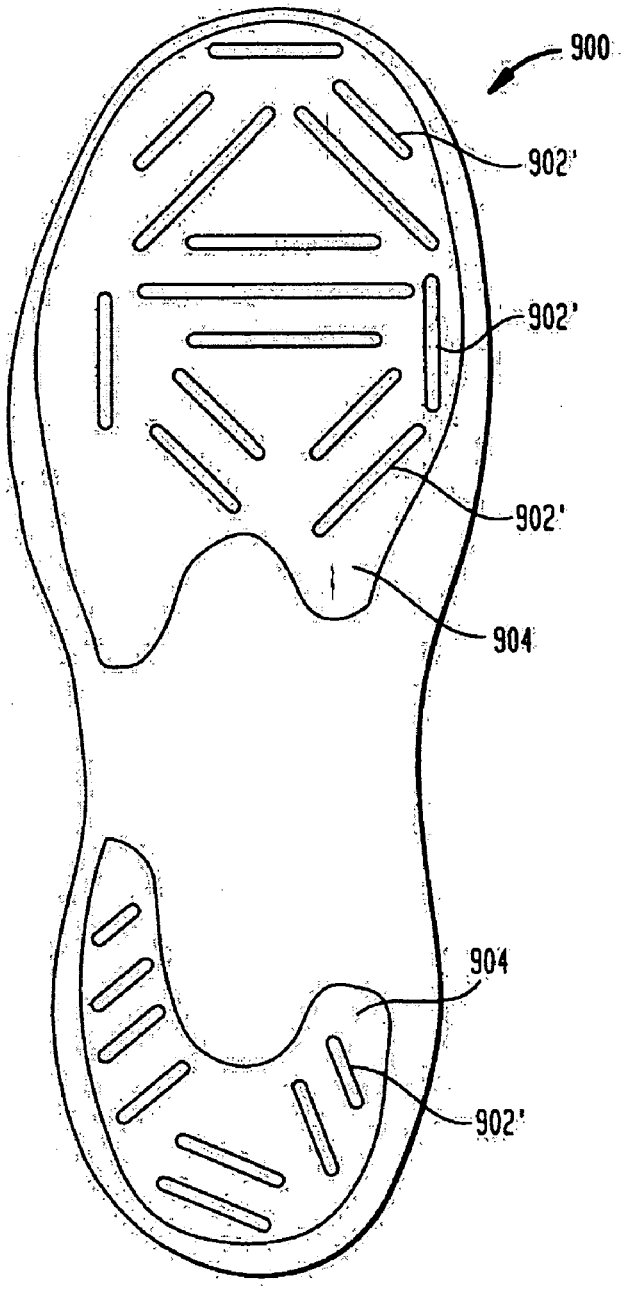
Figure 13B:
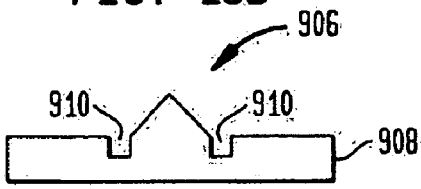
Figure 14A:
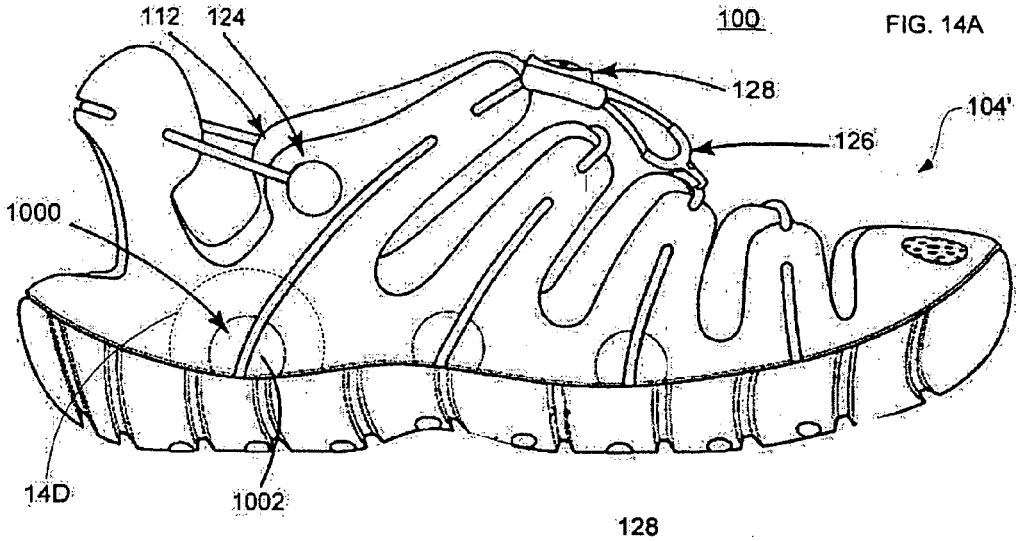
FIGS. 14(*a*)-(*g*) illustrate optional configurations of articles of footwear including recessed cavities.
Figure 14B:
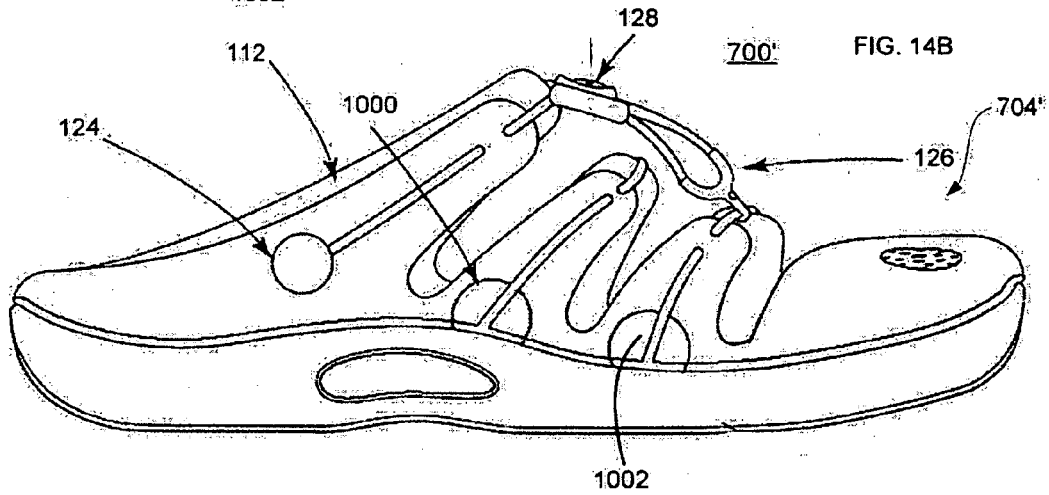
Figure 14C:
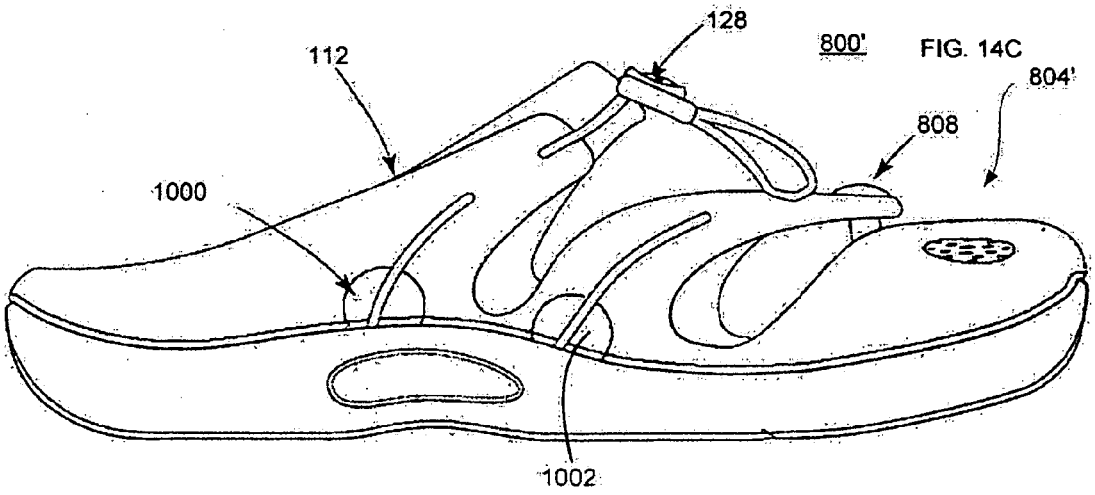
Figure 14D:
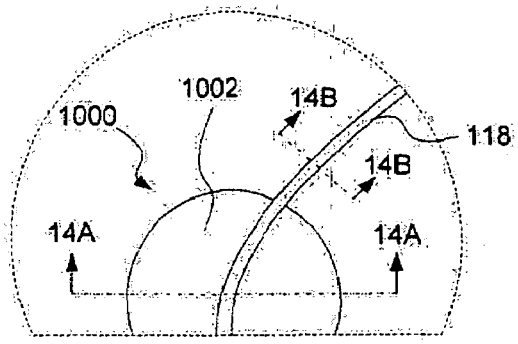
Figure 14E:
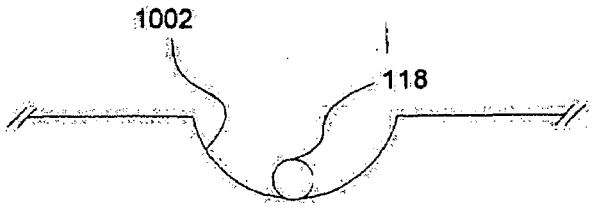
Figure 14F:
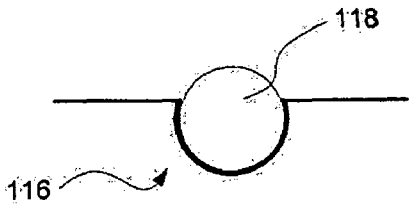
Figure 14G:
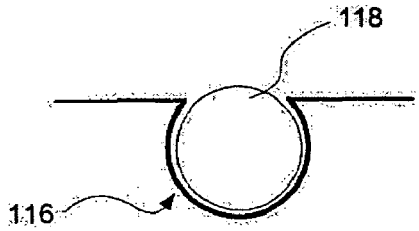
Figure 15I:
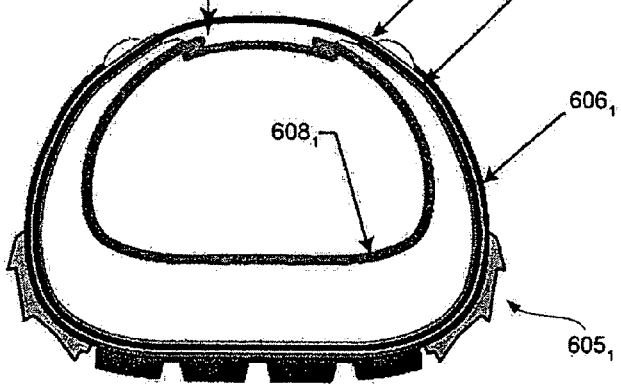
FIGS. 15(*a*)-(*j*) illustrate an alternative configuration of an article of footwear in accordance with aspects of the present invention.
Figure 15G:
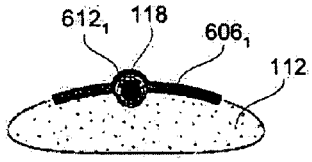
Figure 15H:
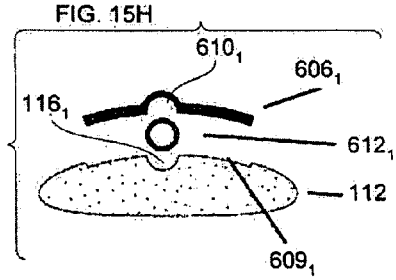
Figure 15C:
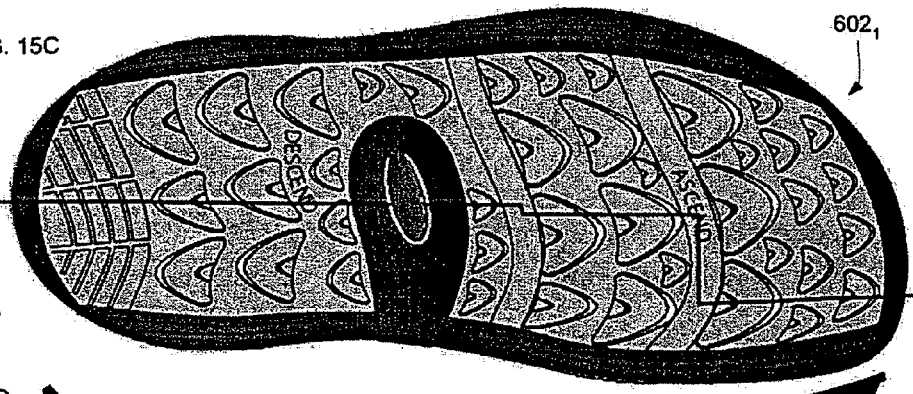
Figure 15D:
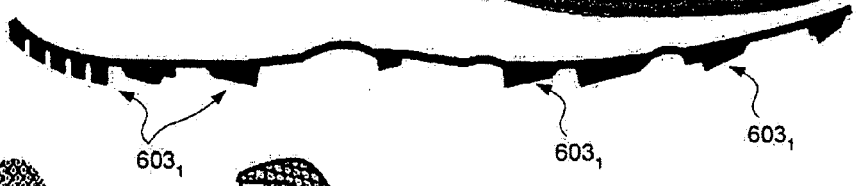
Figure 15J:
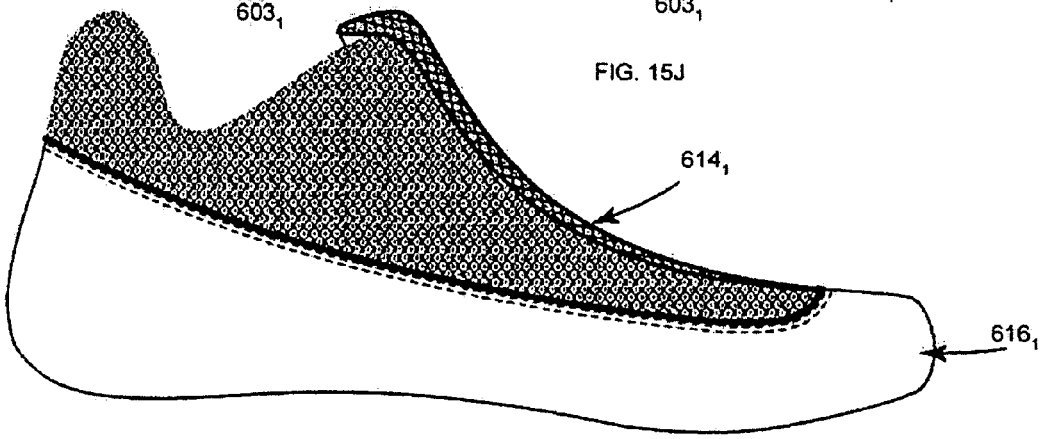

As discussed above, certain outsole configurations such as the siped outsole 702 provide traction on wet surfaces through diversion of water from the bottom surface of the outsole 702. However, other outsole configurations can also be used for enhanced wet surface traction. FIGS. 13(*a*)-(*c*) illustrate alternative outsole configurations in accordance with aspects of the present invention, which can be used with any of the articles of footwear described above, as well as with other types of footwear.

Referring now to FIG. 13(*a*), outsole 900 is illustrated having a set of blade-like traction elements. Specifically, positioned on the outsole 900 are a number of elongated, raised ridge members 902. The elongated raised ridge members 902 are designed to be beneficial by providing traction on wet surfaces and act like wiper blades or squeegee blades to remove water from the surface of the outsole 900. Preferably, the members 902 comprise PU, EVA and/or thermoplastic rubber ("TPR"), although other known outsole materials or combinations thereof can also be employed. The members 902 may be integrally formed as part of the outsole 900, or, alternatively, may be fabricated separately from the rest of the outsole 900 and then attached or otherwise securing during the manufacturing process. Optionally, the members 902 may be sold separately so that the wearer can attach members 902 at selected positions along the outsole 900 as he or she sees fit.

During a standard walking or running gait cycle, there is a small amount of translational movement between the shoe and the ground surface. This translational movement is evident during the "heel strike" and "toe off" phases of motion as the ground reaction forces are changed from no forces when the shoe is off the ground to braking forces when the shoe comes into contact with the ground to propulsion forces as the center of mass is moved forward towards the front of the shoe during the toe off phase. During these small translational movements, there is an opportunity to remove water from a surface by using these movements to squeegee the surface. As water is removed from the surface, outsole material 904 that is positioned adjacent to the members 902 can now come into contact with a dry surface thus greatly increasing traction. It is well known that the coefficient of friction on a dry surface is at least double and often more than double the coefficient of friction on a wet surface.

In more extreme movements where there is a great deal of translational movement, the effectiveness of the members 902 increases. For instance, in extreme movements where a person starts to slip, there is increased translational movement between the shoe and ground. In these situations, the members 902 are dragged across the ground surface and remove water from a larger area of the surface. This provides a larger dry surface that the adjacent outsole material 904 can grip in order to arrest the slipping. The outsole material 904 may be smooth or otherwise planar, or may include lugs such as the lugs 503, siping such as the siping 712, and/or spacers such as the spacers 710. In order to promote water removal, the members 902 are preferably flexible and/or bendable in response to movement such as translational movement between the shoe and the ground.

The design of the leading edge geometry of the members 902 is critical in providing effective removal of the water from the surface. In order to effectively remove water from a surface, the geometry should come to a point or similar narrowed geometry forming an apex in areas where the member 902 comes into contact with the surface.

As seen in FIG. 13(*b*), the member 902 preferably includes a pointed tip 906 attached to a base section 908. Recesses, spacing or voids 910 may be positioned along either side of the tip 906. Given that the normal force remains constant and is equal to the force exerted by the person, the pointed tip 906 on the member 902 focuses and increases pressure between the article of footwear and the ground surface. This increased pressure between the two surfaces keeps fluids from seeping under the member 902. Other geometries (ones with increased surface area) will decrease the pressure between the two surfaces and increase the chance of fluids escape between the surfaces.

The members 902 may be positioned in any configuration and may be applied to any area of the outsole 900; however, the members 902 will be more effective in the heel and forefoot regions of the outsole 900. FIG. 13(*a*) shows the members 902 in a generally parallel arrangement running from the medial to the lateral side of the outsole 900. Alternatively, the members 902 can be oriented at different angles to account for the varied forces and movements that occur during a gait cycle. For instance, there are large anterior-posterior forces during heel strike and toe off. Medial-lateral forces are also present during a normal walking gait and these side to side forces increase during any turning motion by the person. Moreover, on uneven surfaces like the deck of a sail boat, the forces will be directed towards the low side of the boat as someone maneuvers over the deck. For all these, reasons, the members may be oriented at various angles. FIG. 13(*c*) illustrates an alternative in which members 902' are oriented at various positions along the outsole 900. Specifically, some of the members 902' run generally transverse to the outsole 900, while others run in a generally longitudinal direction. Still other ones of the members 902' are positioned along paths that are neither transverse nor longitudinal.

As discussed above, the present invention includes several ways to store and adjust the lace 118. For instance, the lace 118 may be secured at either end by the lace end keeper/endcap 124, which allows for individual fit adjustment for the wearer's foot. The mid-lace keeper 324' provides for separate adjustment of the lace 118 aside from adjustment at the endpoints of the lace 118. The mid-lace keeper 324' allows the user to perform separate adjustments and thus varying amounts of lace tension across different areas or zones of the foot. The lace pull 126 and the lace locking mechanism 128 also enable securing and adjustment of the lace 118.

The lace is desirably positioned along one or more lacing channels in a given article of footwear. Depending upon the specific configuration of the article of footwear and the lace used, the outer surface of the lace may be positioned along a lacing channel to be flush with the outer surface of the upper. Alternatively, the outer surface of the lace may be recessed within the lacing channel relative to the outer surface of the upper, or even project above the outer surface of the upper. In some situations, particularly when the lace lies recessed relative to the outer surface of the upper, it may be difficult for a user to grip the lace within the channel when he or she adjusts the lace. While it is possible to use a tool to grip the lace, this option may not always be available. Thus, it is desirable to have some other way to easily grip the lace.

FIGS. 14(*a*)-(*c*) illustrate alternative embodiments of the present invention including receptacles, openings, recesses, depressions or divots, collectively "recessed cavities", adjacent to the lacing channels 116 at selected locations. FIG. 14(*a*) illustrates a variant of the article of footwear 100, namely article of footwear 100' including upper 104'. FIG. 14(*b*) illustrates a variant of the article of footwear 700, namely article of footwear 700' including upper 704'. FIG. 14(*c*) illustrates a variant of the article of footwear 800, namely article of footwear 800' including upper 804'. The articles of footwear 100', 700' and 800' include the elements of the articles of footwear 100, 700, and 800, respectively, as well as recessed cavities 1000. The recessed cavities 1000 expose the lace to permit a user to quickly and easily grip it. Then the lace may be adjusted as described above.

While multiple recessed cavities 1000 are shown in the figures, it should be understood that any article of footwear may employ one or more recessed cavities 1000. Preferably there is at least one recessed cavity 1000 on each of the medial and lateral sides of the article of footwear. The recessed cavities 1000 are preferably substantially or generally circular, arcuate or semicircular in shape. However, the recessed cavities 1000 may be of any other shape. Surface 1002 of the recessed cavity may be smooth or textured.

FIG. 14(*d*) presents an enlarged view recessed cavity 1000 and FIG. 14(*e*) illustrates a cross section of the recessed cavity 1000. As seen in FIG. 14(*e*), the recessed cavity is preferably concave. FIGS. 14F and 14G are exemplary views of how the lace 116 may be disposed in one of the channels 116. It should be understood that all of these views are not necessarily to scale, and that the lace 118 is depicted as circular for illustrative purposes only. As seen in FIG. 14F, the channel 116 may generally surround at least 50% of the cross sectional surface of the lace 118. FIG. 14G presents an alternative where the channel 116 may generally surround more than 67% of the cross sectional surface of the lace 118, for example 80% or more. In such cases, it should be understood that while it is advantageous to position the lace 118 within the channel 116, this may make it difficult for a wearer of an article of footwear to grip the lace 118.

Recessed cavity 1000 solves the gripping problem by exposing a significant portion of the lace 118. Preferably, the recessed cavity 1000 exposes at least 50% of the cross-sectional surface of the lace 118. More preferably, the recessed cavity exposes 67% or more of the cross sectional area of the lace 118 for easy gripping. Desirably, 75% to 95% or more of the cross sectional area of the lace 118 is exposed by the recessed cavity 1000.

The recessed cavities 1000 are preferably positioned along the lacing channels of the upper. The recessed cavities 1000 may be placed adjacent to the outsole or elsewhere along a given lacing channel as desired, for example along a medial side channel, a lateral side channel, or a heel support channel. In some preferred embodiments, there may be a recessed cavity 1000 along each lacing channel of the upper. While not shown, it is also possible to have multiple recessed cavities 1000 disposed along the same lacing channel. The recessed cavities 1000 may be positioned substantially symmetrically about the lacing channel as shown. However, it is also possible to place a recessed cavity 1000 asymmetrically along a lacing channel, or entirely on one side or the other of the lacing channel. Thus, it can be seen that the user does not have to use a tool or otherwise strain his or her fingers to sufficiently grip the lace within the lacing channel. Instead, the recessed cavity 1000 exposes a portion of the lace to provide immediate and convenient access to the lace.

As discussed above, the channels allow for security of the lace within the articles of footwear disclosed herein, and also allow for movement of the lace during adjustment. The lacing channels can either be integrally molded into the housing and/or can be added to the housing as a separate component. In order to minimize wear and tear on the lace, low-friction tube structures may be incorporated into the articles of footwear.

FIGS. 15(*a*)-(*j*) illustrate a variant of the article of footwear 600, namely article of footwear $\mathbf{600_1}$. As with the article of footwear 600, the article of footwear $\mathbf{600_1}$ preferably has a shoe-type configuration, such as a wet boot, which incorporates a wraparound lacing system. Lateral and medial side views 15(*a*) and 15(*b*) illustrate that the article of footwear $\mathbf{600_1}$ desirably includes an outsole $\mathbf{602_1}$, a housing $\mathbf{604_1}$, a shell structure $\mathbf{606_1}$ and a bootie or sockliner $\mathbf{608_1}$.

FIG. 15(*c*) is a bottom view of the outsole 6021, and FIG. 15(*d*) is a cutaway view of the outsole $\mathbf{602_1}$ along the 15A-15A line of FIG. 15(*c*). Similar to the outsole 502 in the article of footwear 500, the outsole $\mathbf{602_1}$ preferably includes a plurality of lugs $\mathbf{603_1}$ in place of or in combination with siping or other tread configurations. Here, as seen in the cutaway view, the lugs $\mathbf{603_1}$ may be angled to provide enhanced traction, for instance when ascending or descending a hill. Lugs or other tread configurations $\mathbf{605_1}$ may also extend up the front, rear and/or sides of the housing $\mathbf{604_1}$, as seen in the side views of FIGS. 15(*a*)-(*b*) and the front and back views of FIGS. 15(*e*)-(*f*).

Returning to FIGS. 15(*a*)-(*b*), the projections, branches, or fingers 112, are preferably partly, substantially or completely covered by the shell structure $\mathbf{606_1}$. The fingers 112 are preferably formed of IMEVA. More preferably, the housing $\mathbf{604_1}$ may be formed of any of the materials described above with regard to other housings herein. As shown, the shell structure $\mathbf{606_1}$ substantially covers the projections 112 and the heel support 114. The shell structure $\mathbf{606_1}$ may be, for instance, a rigid or semi-rigid material. Preferably, the shell structure $\mathbf{606_1}$ comprises a hard or rigid plastic of one or more material layers.

FIGS. 15(*g*) and 15(*h*) show cutaway views of one of the projections 112 and overlying shell structure $\mathbf{606_1}$ along the 15B-15B line of FIG. 15(*a*). As best seen in the FIG. 15(*h*), a lacing channel 1161 is formed along an outer surface of the projection 112. The lacing channel $\mathbf{116_1}$ may be, for instance, semicircular, although other shapes are possible. A depression or recess $\mathbf{609_1}$ in the shape of the overlying shell structure $\mathbf{606_1}$ may also be formed in the outer surface of the projection 112. The shell structure $\mathbf{606_1}$ desirably also includes a lacing channel $\mathbf{610_1}$ therein. As with the lacing channel 116', the lacing channel $\mathbf{610_1}$ may be semicircular or another shape.

As seen in FIG. 15(*g*), when the shell structure $\mathbf{606_1}$ mates with the projection 112, the lacing channel $\mathbf{610_1}$ and the lacing channel $\mathbf{116_1}$ preferably form a complete or unitary channel for the lace 118. The complete or unitary channel may be, for instance, generally circular, although many other shapes such as square, hexagonal, etc. may also be employed. A structure $\mathbf{612_1}$ having a generally tubular configuration may be disposed within the complete or unitary channel formed by the lacing channel 6101 and the lacing channel $\mathbf{116_1}$.

As seen in the side views 15(*a*)-(*b*), multiple tube structures $\mathbf{612_1}$ may be incorporated within the article of footwear 6001 along the projections 112 and the heel support 114. The tube structures $\mathbf{612_1}$' may extend partly, substantially or completely along the projections 112. Portions or sections of the tube structures $\mathbf{612_1}$ may be covered only by the housing $\mathbf{604_1}$ or by the shell structure $\mathbf{606_1}$. Other portions or sections of the tube structures $\mathbf{612_1}$, such as one or both ends, may not be covered by either the housing $\mathbf{604_1}$ or the shell structure $\mathbf{606_1}$.

FIG. 15(*i*) illustrates a cutaway view of the article of footwear 6001 along the 15C-15C line of FIG. 15(*b*). As seen here, the tube structure $\mathbf{612_1}$ preferably wraps around the housing $\mathbf{604_1}$ from a medial side projection 112 to a corresponding lateral side projection 112. Preferably, a base section of the tube structure $\mathbf{612_1}$ is disposed between the outsole $\mathbf{602_1}$ and the housing $\mathbf{604_1}$. However, it is also possible to embed the tube structure $\mathbf{612_1}$ within the outsole $\mathbf{602_1}$ or the housing $\mathbf{604_1}$, or both.

Tube structures $\mathbf{612_1}$ reduce friction on the lace 118 and protect the housing $\mathbf{604_1}$ and the lace 118 from abrasion. The tube structures $\mathbf{612_1}$ also facilitate sliding of the lace 118 and help prevent portions of the lace 118 from catching on clothing, equipment or other objects or surfaces. Thus, while not required, it is desirable to include one or more tube structures $\mathbf{612_1}$ in the article of footwear $\mathbf{600_1}$, or in any of the other articles of footwear herein.

Returning to FIG. 15(*a*), it can be seen that the article of footwear $\mathbf{600_1}$ may utilize the lace locking mechanism 128. The lace pull 126 or other forms of lace hooks may also be employed. In a preferred embodiment, one or more cleat-type lace hooks $\mathbf{613_1}$ (a "cleat member") may be incorporated into the article of footwear $\mathbf{600_1}$ to help store or otherwise secure excess lace and prevent the lace from catching on objects or surfaces. While shown disposed between one of the projections 112 and the heel support 114, the cleat-type lace hook $\mathbf{613_1}$ may be disposed on the projection 112, on the heel support 114, or elsewhere along the housing $\mathbf{604_1}$. Alternatively, the lace hook $\mathbf{613_1}$ may also be part of or otherwise connected to the bootie $\mathbf{608_1}$.

As discussed above, the article of footwear $\mathbf{600_1}$ desirably includes the bootie $\mathbf{608_1}$. The bootie $\mathbf{608_1}$ is preferably a stretch bootie adapted to fit within the housing $\mathbf{604_1}$. The bootie $\mathbf{608_1}$ may be bonded or otherwise permanently secured to the housing $\mathbf{604_1}$. In this case, a footbed may be permanently or removably received into the interior of the bootie $\mathbf{608_1}$. Alternatively, the bootie $\mathbf{608_1}$ may be removable from the housing $\mathbf{604_1}$.

The bootie $\mathbf{608_1}$ may be of the same or similar construction as the bootie 608 discussed above with respect to the article of footwear 600. FIG. 15(*j*) illustrates the bootie $\mathbf{608_1}$ in detail. A first section $\mathbf{614_1}$ preferably comprises a breathable mesh, such as a coated, hydrophobic, breathable mesh. The breathable mesh is desirably lightweight and waterproof, allowing for added protection of the skin while complementing the features of the EVA upper to provide comfort, contour and a secure fit to the wearer. A second section $\mathbf{616_1}$ preferably comprises a non-stretch microfiber fabric. The first and second sections $614_1$ and $616_1$ are preferably stitched or otherwise secured together. In one alternative, the first section $614_1$ is an upper section and the second section $616_1$ is a lower section. In a second alternative, the first section 6141 is formed so as to substantially surround a wearer's foot, and the second section $616_1$ covers the lower portion of the first section $614_1$. The first section $614_1$ may have a gusseted configuration along the instep region of the article of footwear $600_1$. Alternatively, a unitary, seamless bootie may be employed.

In an alternative example, the bootie $608_1$ may incorporate stretch wovens or knits in conjunction with a form fitting, insulting, waterproof material such as neoprene, which may be utilized with or without an additional layer or layers of a polyester stretch knit material, such as a Spandex-type material or insulating material such as fleece. The insulating material is especially desirable in cold climates. The stretch wovens or knits, waterproof materials and/or the insulating materials provide flexibility, comfort, waterproofing or water resistance, as well as insulation. All of these benefits are available in conjunction with the benefits of the durable, pliable, and protective housing $604_1$.

Figure 16A:
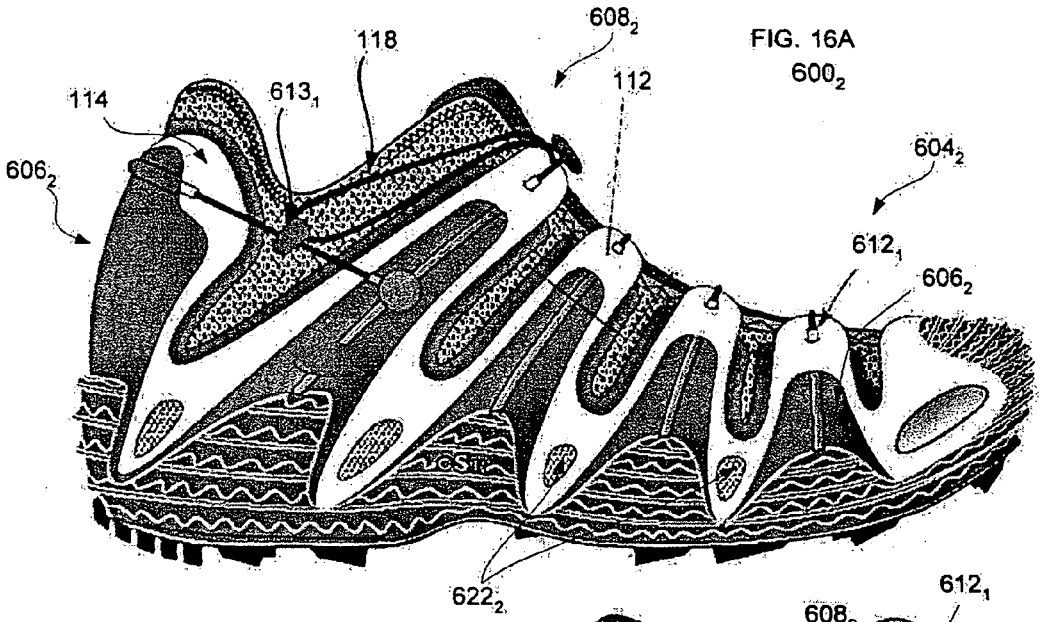
FIGS. 16(*a*)-(*c*) illustrate a variation on the configuration of FIGS. 15(*a*)-(*j*) in accordance with aspects of the present invention.
Figure 16B:
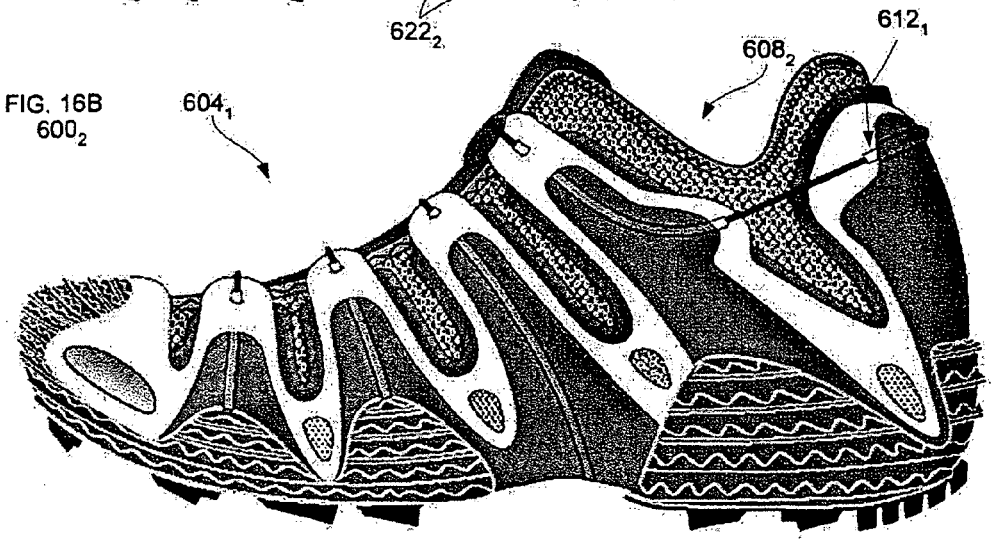
Figure 16C:
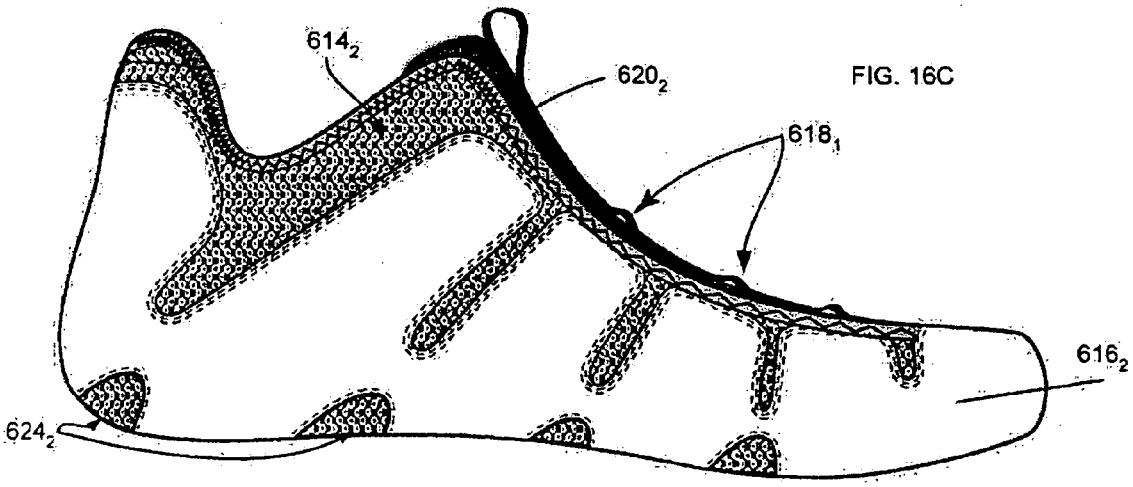

FIGS. 16(*a*)-(*c*) illustrate a variation on the article of footwear $600_1$, namely, article of footwear $600_2$. The main difference of article of footwear $600_2$ from the article of footwear $600_1$ is the configuration of bootie $608_2$. Here, as best seen in FIG. 16(*c*), first section $614_2$ preferably is designed to completely or substantially cover the wearer's foot, and second section $616_2$ covers selected portions of the first section $614_2$. In this case, the second section $616_2$ is also configured to underlie the projections 112 and shell structure $606_2$. This configuration provides enhanced flexibility to the article of footwear $600_2$ as portions of the first section $614_2$ between the fingers of the second section $616_2$ may be may be more pliable.

One or more guides $618_1$ may be used to help manage the lace along tongue portion $620_2$ of the bootie $608_2$. Also, openings $622_2$ are desirably provided in the upper $604_2$, and may align or overlap with portions $624_2$ of the bootie $608_2$. The portions $624_2$ are desirably formed of breathable mesh as described above, and may be portions of the first section $614_2$.

Figure 17A:
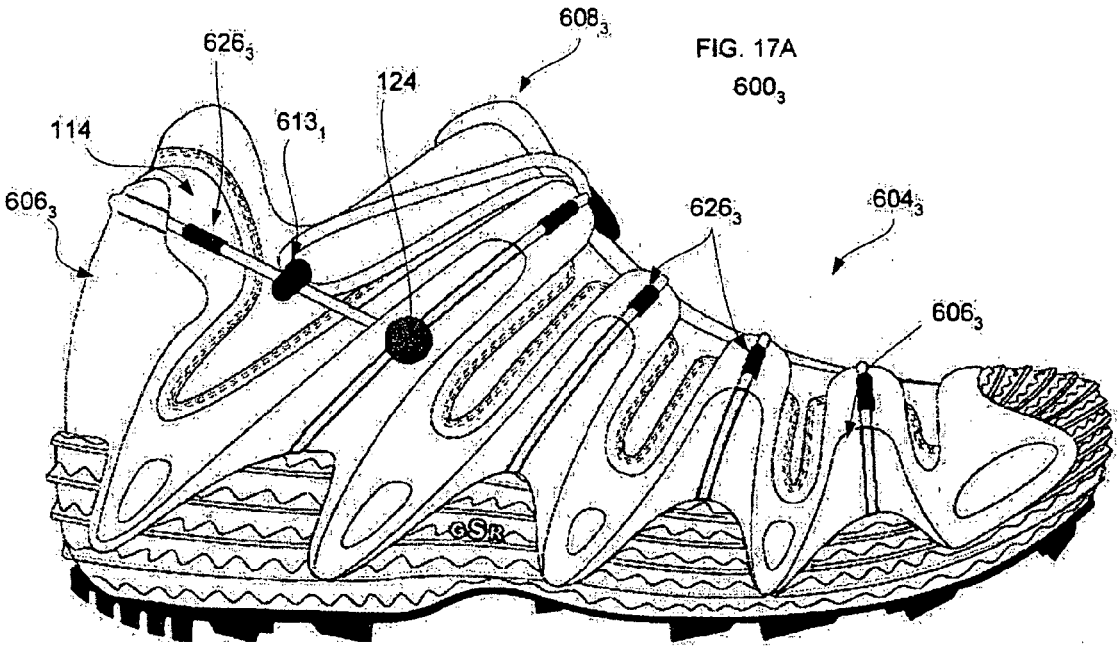
FIGS. 17A-B illustrate another variation on the configurations of FIGS. 15 and 16 in accordance with aspects of the present invention.
Figure 17B:
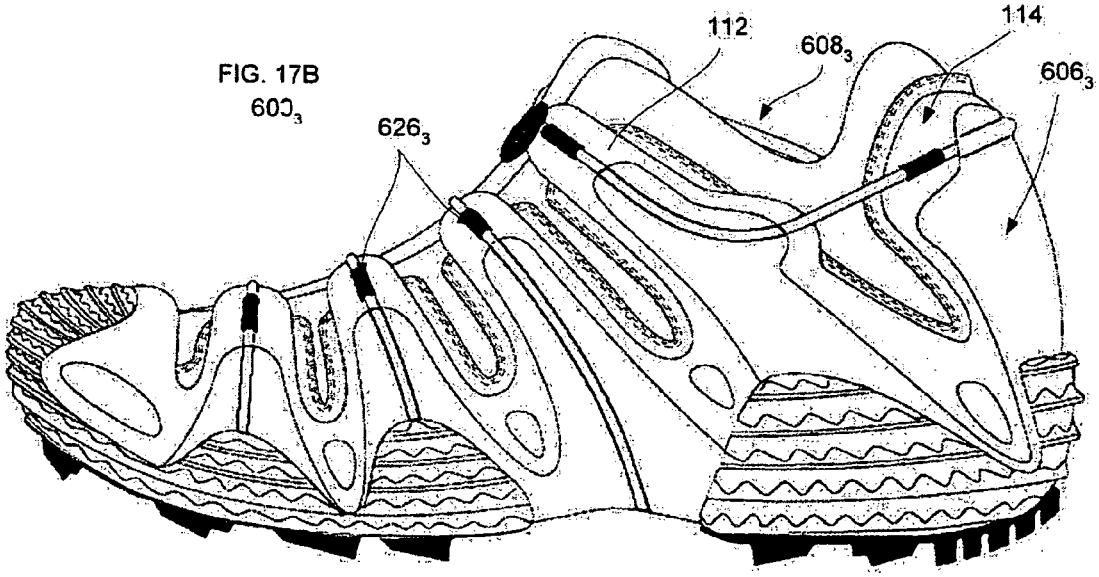

FIGS. 17(*a*)-(*b*) illustrate another variation on the articles of footwear $600_1$ and $600_2$. Here, in article of footwear $600_3$, the end of the lace 118 connects to the lace end keeper 124 beneath shell structure $606_3$. For example, the end of the lace may run through or beneath the projection 112 to connect to the shell structure $606_3$. In contrast, as seen in FIGS. 15(*a*) and 16(*a*), the end of the lace 118 preferably runs over the shell structure $606_1$ or $606_2$ before connecting to the lace end keeper 124. Also, one or more lace guides or stays $626_3$ may be placed on the fingers 112 and/or the heel support 114. While not shown, tube structures such as tube structures $612_1$ may be employed.

Figure 18A:
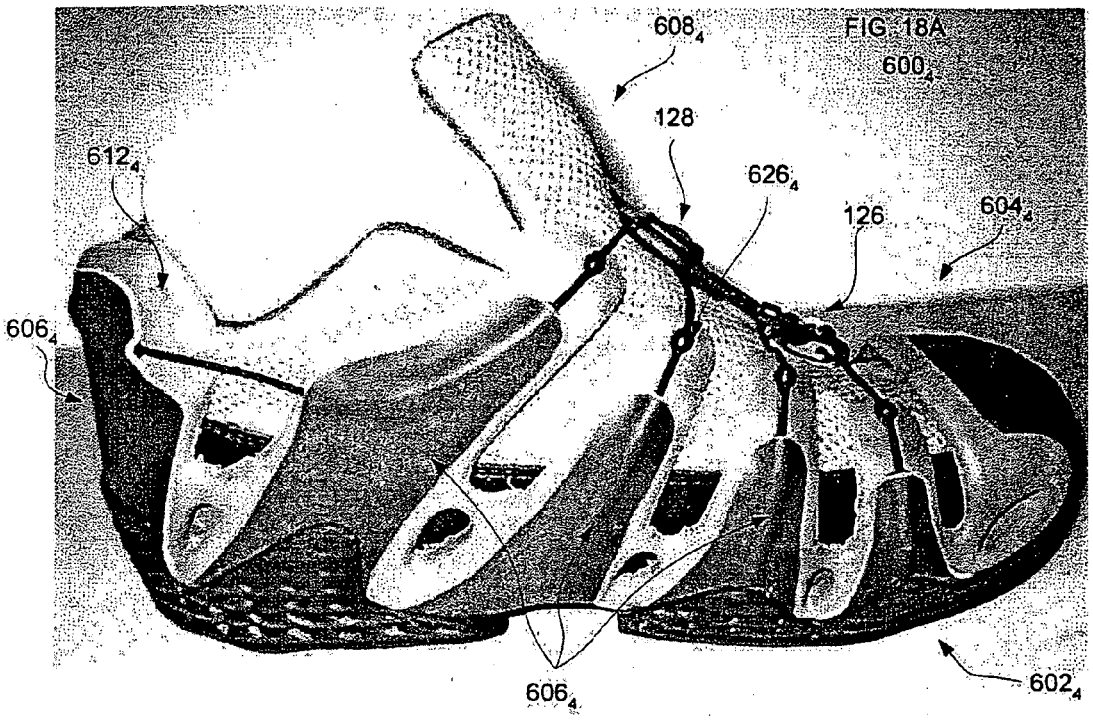
FIGS. 18(*a*)-(*b*) illustrate yet another variation on the configurations of FIGS. 15-17.
Figure 18B:
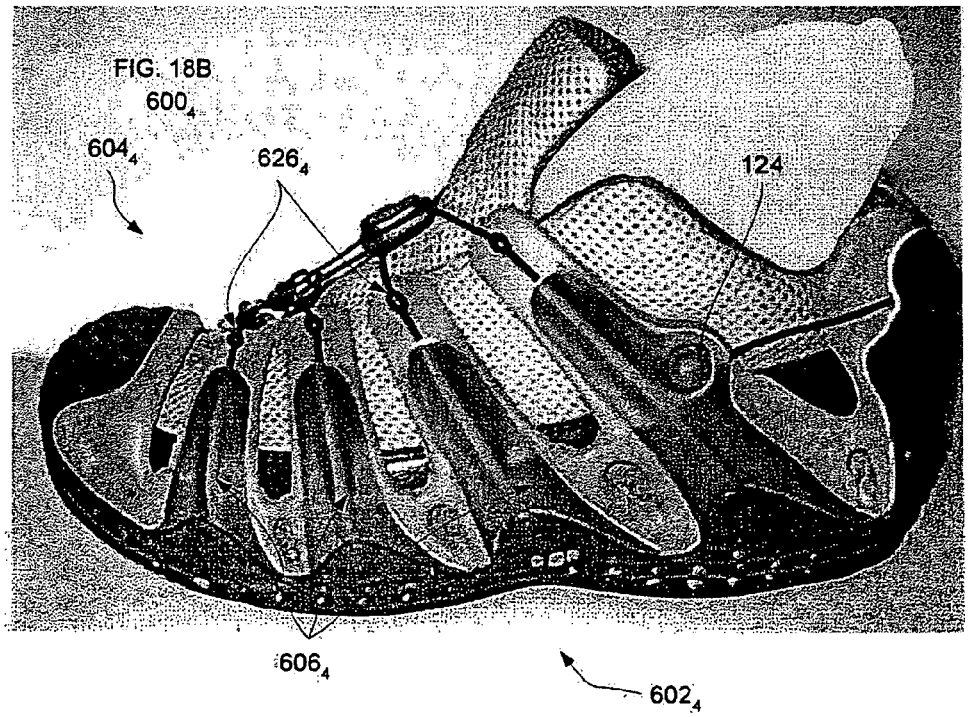

FIGS. 18(*a*)-(*b*) illustrate medial and lateral views of article of footwear $600_4$. In this alternative, the lace pull 126 is used instead of the cleat-type lace hook $613_1$. Here, lace guides or stays $626_4$ may be employed to help guide and/or retain the lace 118. One or more lace guides $626_4$ are preferably affixed to exposed portions of the projections 112, for instance at the ends of the projections proximate to the instep region of the article of footwear $600_4$.

As seen in FIGS. 18(*a*)-(*b*), portions of outsole $602_4$ may wrap around the medial and/or lateral sides of the housing $604_4$ and partially cover shell structure $606_4$. Other portions of the outsole $602_4$ may wrap over the toe and/or heel regions of the housing $604_4$. The wraparound sections of the outsole $602_4$ may provide enhanced traction, stability, durability and/or protection to the wearer. Alternatively, outsole-like materials may be placed about the toe and/or heel regions for aesthetic purposes. The wraparound sections of the outsole $602_4$ may be separately or integrally formed with the main ground contacting portion of the outsole $602_4$. In particular, an integrally molded outsole including a toe cover that wraps back to cover the toes is described in U.S. Pat. No. 4,535,554 to De Obaldia, the entire disclosure of which is hereby expressly incorporated by reference herein.

FIGS. 19(*a*)-(*h*) illustrate yet another embodiment of the present invention. As seen in the perspective view of FIG. 19(*a*), an article of footwear 1100 is adapted to meet the rigorous demands of hiking and climbing, among other active pursuits. While the article of footwear 1100 is suitable for extreme environmental conditions such as when canyoneering, the features of the footwear 1100 may be used in various styles and configurations of footwear for many other types of environmental conditions or simply for aesthetic appeal.

Several general features of the article of footwear 1100 are illustrated in FIG. 19(*a*), including an outsole 1102, a superstructure 1104, a "floating" anatomical protector 1106 and a bootie 1108. As shown here, the anatomical protector 1106 is desirably configured to protect the instep region of the foot, although other regions of the foot and leg may be protected. The outsole 1102 provides a ground contacting surface. While different lug and traction configurations are shown in FIGS. 19(*g*) and 22 and will be discussed in detail below, any of the outsoles presented herein may be used in conjunction with the article of footwear 1100. In this embodiment, the outsole 1102 is preferably fabricated as a component separate from the superstructure 1104. However, an alternative configuration may include the outsole 1102 as part of the superstructure 1104.

The superstructure 1104 desirably combines midsole and upper elements in a unitary housing, which may be similar to the housing 104 of the article of footwear 100. For instance, the superstructure 1104 may comprise IMEVA, PU, or any of the other materials used in any of the other housing variations described elsewhere herein. The superstructure 1104 preferably includes a toe protector 1110, which is designed to provide protection to the wearer's toes. The toe protector 1110 is similar to the toe cover 110 of the footwear 100 discussed above, and preferably covers at least some of the metatarsals during wear. Ankle guards 1112 may be provided on the medial and/or lateral sides adjacent to the wearer's ankle. The ankle guards 1112 are similar to the rearmost "fingers" 112 of the article of footwear 100. A heel support 1114, which may be the same as heel support 114, may also be provided. The toe protector 1110, ankle guards 1112 and heel support 1114 are similar in form and function to counterpart elements in the footwear 100 and other embodiments illustrated herein, and may be formed in any of the configurations and from any of the materials disclosed herein. A cover 1115 may be positioned over part or all of the superstructure 1104. For instance, the cover 1115 may comprise the same material as shell structure $606_1$. Alternatively, the cover 1115 may be a rubberized material for enhanced traction and/or durability. As shown in FIG. 19(*b*), the cover 1115 may be disposed on a portion of the superstructure 1104 including the ankle guard 1112. The toe protector 1110 may also be partly covered by the same rubberized material for enhanced traction and/or durability.

Unlike the housing 104, while ankle guards 1112 may be employed, the superstructure 1104 preferably does not include a plurality of medial or lateral fingers that are positioned adjacent to the wearer's forefoot. Instead, the anatomical protector 1106 preferably includes one or more fingers, also referred to as projections, 1116 extending medially and/ or laterally therefrom. For instance, as best seen in the top view of FIG. 19(*c*), there may be three medial fingers 1116*a* and three lateral fingers 1116*b* that extend away from a central region of anatomical protector 1106. As best seen in the top view of FIG. 19(*c*) and the front view of FIG. 19(*e*), the medial fingers 1116*a* and lateral fingers 1116*b* need not be symmetrical. One or more projections having a vertical or other orientation may be used along with or separate from the medial and lateral projections 1116*a,b*. For instance, a vertical projection may extend upward from the central region to at least partially cover an ankle section of the instep region. Another vertical projection may extend downward from the central region to cover, e.g., a portion of the metatarsals. During wear, the downward vertical projection is spaced apart from the toe protector 1110 by a gap.

The anatomical protector 1106 "floats" relative to the superstructure 1104. For instance, the anatomical protector 1106 is not integrally formed with or otherwise rigidly attached or directly secured to the superstructure 1104. The anatomical protector 1106 is thus able to move independently of the superstructure 1104. A lace 1118 preferably runs through portions of the anatomical protector 1106, thereby positioning the anatomical protector 1106 over the instep region of the wearer's leg. Thus, the wearer is free to position the anatomical protector 1106 in a desired location and orientation, which may be chosen depending upon factors such as comfort, security, protection, etc. As explained above, the instep region may include at least the instep, metatarsals, phalanges, and ankle. Other portions of the foot or leg may also be protected by the anatomical protector 1106, such as the shin, heel, Achilles tendon, calf muscle, etc. Various configurations of the anatomical protector 1106 are illustrated herein, and any of the configurations may be used to protect any portion or portions of the instep region or other anatomical features of the foot and leg.

The anatomical protector 1106 can move in response to forces from the foot, the lace 1118 or both independent of movement, such as flexing, of the superstructure 1104. The anatomical protector 1106 is most preferably positioned so that it is not directly adjacent to or overlapping on the superstructure 1104. Instead, the lace 1118 or other connector(s) provides an indirect link between the anatomical protector 1106 and the superstructure 1104. Thus, while the anatomical protector 1106 most preferably does not directly contact the superstructure 1104 during wear, both the anatomical protector 1106 and the superstructure 1104 may provide support, stability and protection to the foot during wear. In one example, the lace 1118 may be tightened by pulling in the direction of the arrows shown in FIG. 19(*a*).

The anatomical protector 1106 not only protects the instep region of the foot. Another benefit is to improve pressure distribution over a greater surface area of the foot, which increases comfort and provides a more secure fit for the article of footwear. When donning the article of footwear 1100, the wearer may insert his or her foot into the bootie 1108, if used. Then he or she may position the anatomical protector 1106 as desired. Next, the lace 1118 or other fastening system can be tightened or otherwise engaged for a secure fit that is customized to the wearer.

The anatomical protector 1106 may comprise one or more layers or regions of material. In a preferred example, the anatomical protector 1106 comprises a main layer 1106*a* as well as a cover layer 1106*b*. The main layer 1106*a* desirably comprises a foam-like material such as PU or EVA, more preferably CMEVA. The cover layer 1106*b* may also be a foam-like material, although it preferably is a natural or synthetic rubber. More preferably, the cover layer 1106*b* includes an exterior layer of traction rubber such as the kind used as the ground contacting layer of the outsole 1102. The cover layer 1106*b* may be integrally formed with the main layer 1106*a*, or may be glued, stitched or otherwise affixed to the main layer 1106*a* during manufacture.

The anatomical protector 1106 may also comprise one or more different sections that are directly or indirectly connected together. For instance, the anatomical protector 1106 may include a first section for protection of a lower portion of the wearer's instep region such as the metatarsal and phalanges region of the foot, as well as a second section for protection of another portion of the instep region such as the ankle. Other portions of the foot or the leg may be protected by the same or separate sections of the anatomical protector 1106. The different sections may be directly connected together. For instance, the first and second sections may be fabricated as a unitary, flexible structure. Alternatively, the first and second sections may comprise separate anatomical protectors that operate together to protect the wearer's foot and/or leg. In this case, the different sections may overlap or otherwise touch during wear, or they may not contact each other during wear. The sections may be operatively coupled to the superstructure 1104 and/or each other by the lace 1118 or other fastening device.

The lace 1118 preferably runs through one or more lacing channels (not shown) in the anatomical protector 1106. For instance, in the version of footwear 1100, which has three medial and three lateral fingers 1116, there are preferably three lacing channels—one for each pair of medial/lateral fingers. The lacing channels of the anatomical protector may be of any of the configurations of lacing channels described elsewhere herein. For instance, each lacing channel may be formed at least partly by a recess in the main layer 1106*a*, a recess in the cover layer 1106*b*, or as a combination of both. One or more lacing channels are also preferably supplied with the superstructure 1104 and/or the outsole 1102 in any of the configurations described elsewhere herein. The lace 1118 may also be used in combination with other lacing or fasteners elsewhere along the article of footwear 1100.

Figure 20:
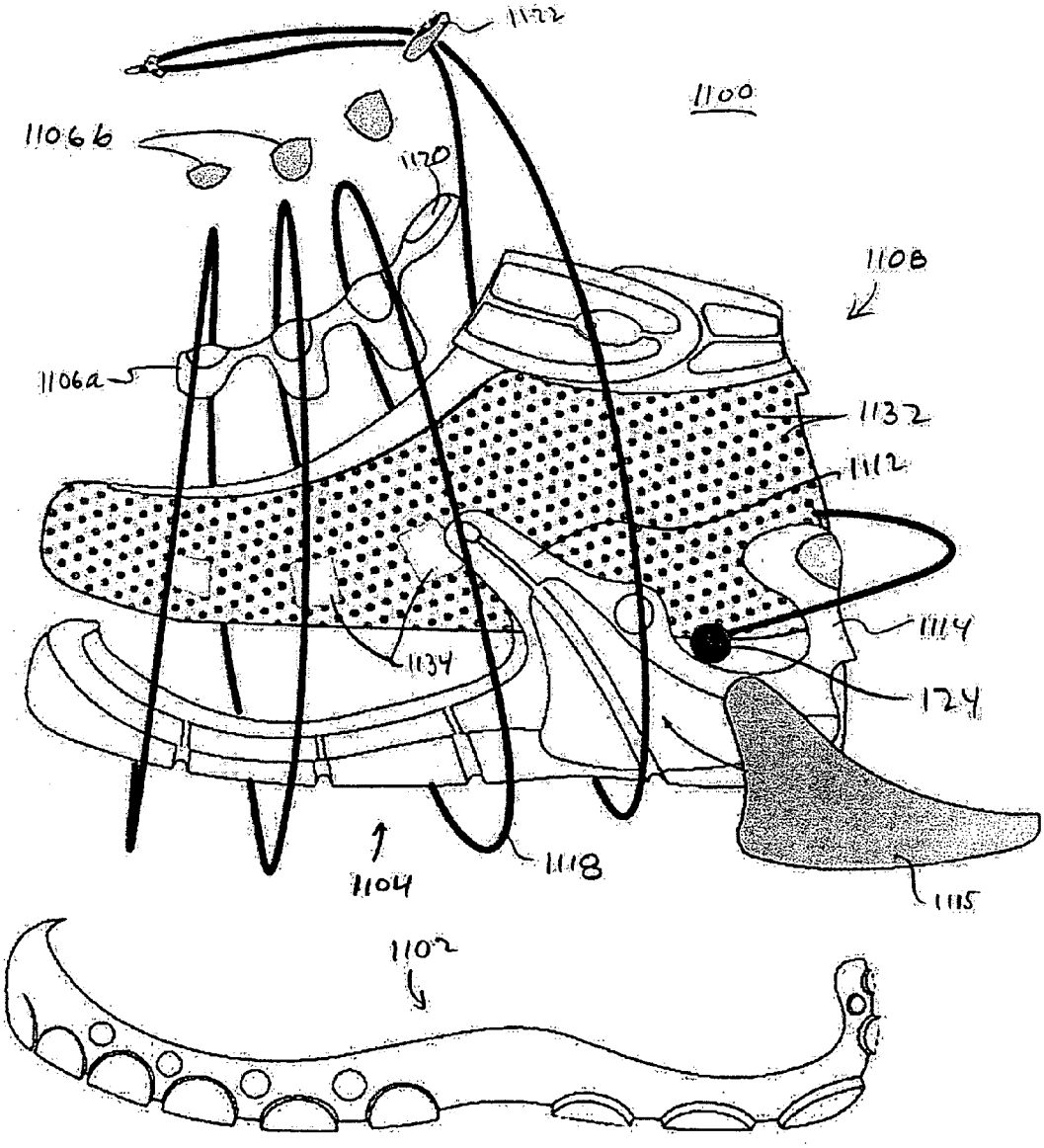
FIG. 20 illustrates an exploded view of the article of footwear of FIGS. 19(*a*)-(*g*).

FIG. 20 is an exploded view of the article of footwear 1100 showing selected components and features, including lacing channels in the base of the support structure 1104 and along the ankle guard 1112. The lacing channels along the fingers 1116 and/or the heel support 1114 may be open so that the lace 1118 can be seen, or may be partly or completely enclosed. The channels can either be integrally molded into the anatomical protector 1106 and the heel support 1114 during manufacture or can be added as a separate component. Additionally, lacing channels may be hand punched into areas of the anatomical protector 1106 or heel support 1114 where molding is limited or problematic.

As discussed above with regard to the article of footwear 100, it is desirable for the lace 1118 to be received throughout the article of footwear 1100 with low friction and with low abrasion on the lace 1118. Thus, it is desirable to make the channels as friction free as possible, for example by making the channels smooth and/or coating the interior surfaces with a low friction material such as silicone or a polymer resin such as PTFE. Additionally, separate low-friction tube structures, such as the structure 612, discussed above with regard to FIGS. 15(*g*)-(*h*), may be inserted into the lacing channels to reduce friction and protect against abrasion.

The anatomical protector 1106 may be used in conjunction with one or more lace securing features such as the lace end keeper or end cap 124, the lace pull 126, and/or the lace locking mechanism 128, or any of the other lace securing features utilized with any of the articles of footwear of the instant application. For instance, a portion 1120 of the anatomical protector may include or connect to a lace locking mechanism 1122, which may function in the same or a similar manner to the lace locking mechanism 128. The portion 1120 is preferably a vertical projection extending from a central region of the anatomical protector 1106. As shown in the lateral and top views of FIGS. 19(*b*) and (*c*), the end cap 124 and the lace pull 126 may used as well. One or more lace guides or stays 1124, such as lace guides $\mathbf{626}_3$ or $\mathbf{626}_4$ discussed above with respect to FIGS. 17(*a*)-(*b*) and 18(*a*)-(*b*), may be placed on the article of footwear 1100. In an example, a lace guide 1124 may be placed within a lacing channel of the medial and/or lateral ankle guards 1112 to help position the lace 1118 within the lacing channel and prevent the lace 1118 from accidentally pulling away from the lacing channel.

The anatomical protector 1106 may be used with or without any of the other features of the various articles of footwear discussed herein. For instance, it is preferred that the anatomical protector 1106 include medial and/or lateral projections 1116. In this case, it is also preferred that the superstructure 1104 not include medial or lateral fingers that are positioned adjacent to the wearer's forefoot, such as the three frontmost medial and lateral fingers shown in FIG. 1(*a*). However, this is not required. It is possible to utilize an anatomical protector with the article of footwear 100. In this case, it may be preferable for the anatomical protector not to include medial or lateral fingers projecting therefrom.

Furthermore, while the anatomical protector 1106 may be used in conjunction with any of the various wraparound lacing schemes discussed herein, it is not required. The anatomical protector 1106 may also be used with conventional lacing or without lacing at all. In the latter case, the anatomical protector 1106 may be connected to and may float relative to the superstructure 1104 using alternative connection mechanisms. For instance, some or all of the fingers 1116 may be connected to part of the superstructure 1104 by an elastomeric bungee cord/lace. Alternatively, one or more of the fingers 1116 may be connected to the superstructure by hook and loop straps, with snaps, buckles or other connectors.

The anatomical protector 1106 may also be used with or without the bootie 1108. When used without the bootie 1108, the anatomical protector 1106 may desirably include a backing material adapted to contact the wearer's foot. For instance, the backing material may include one or more layers of material. Such backing material may be, for instance, padding such as foam padding, a jersey such as a polyester jersey, a layer or coating having antimicrobial properties, or any combinations thereof. In some cases the layer or coating having antimicrobial properties may be integrated with or applied to the padding, the jersey, or both. Optionally, the backing material, if used, or the main layer 1106*a* itself may have a tacky or roughened surface to prevent slipping or sliding of the anatomical protector 1106 relative to the bootie 1108 or the wearer's leg.

It may be desirable to utilize the anatomical protector 1106 with the bootie 1108 depending upon the climate, environmental conditions and/or the activities undertaken. The bootie 1108 may be permanently attached to the article of footwear 1100 or may be removable. In the former case, the bootie 1108 may be stitched, glued or otherwise affixed to the superstructure 1104. The bootie 1108 may be of any of the configurations and materials discussed herein with regard to bootie construction, such as with the booties 608, $\mathbf{608}_1$, $\mathbf{608}_2$, $\mathbf{608}_3$ or $\mathbf{608}_4$.

The bootie 1108 may be adapted for canyoneering, walking, hiking, water or snow activities, etc. The materials of the bootie 1108 may be chosen based on end use. For instance, such materials may comprise a neoprene layer with a nylon knit outer later. The neoprene may be perforated to let water escape from the bootie 1108. Alternatively, the neoprene may be non-perforated. A polyester jersey may be added as an inner layer for next to skin comfort. The neoprene may be laminated with various materials for different functions and feels. For instance, wool or a synthetic lofted material such as polyester can be used in conjunction with the neoprene as an insulator. Other materials may be substituted for neoprene depending on expected operating conditions.

The bootie 1108 preferably includes a collar 1126, which may have a closure 1128 comprising, for example, a hook and loop fastener system, claps, snaps or another type of connection. The closure 1128 preferably closed securely about a portion of the wearer's leg so that unwanted material such as dirt, pebbles, sand, etc. is kept out of the bootie 1108. The collar 1126 may also include a pouch or other receptacle, as shown in FIG. 19H, for securing or containing a portion of the lacing 1118. A gusset 1130, as seen in FIG. 19(*a*), may be included on the bootie 1108 to enable the wearer to comfortable insert his or her foot into the bootie 1108. The gusset 1130 preferably comprises a stretchable/elastomeric material, which is desirably positioned on either the lateral or medial side of the bootie 1108.

The top and side views of FIGS. 19(*b*)-(*d*) illustrate that the bootie 1108 may include a series of nubs 1132 positioned therealong. The nubs 1132 are preferably formed of rubber or plastic, and may be used to provide protection and/or traction, as well as an aesthetic design. The exterior of the bootie 1108 may also include one or more lace supports 1134 thereon. The nubs 1132 and/or the lace supports 1134 may be, for example, plastic or rubber molded or otherwise formed to have a channel therein. Other suitable materials include PU, silicone, PVC and materials having similar properties. The nubs 1132 and the lace supports 1134 may be bonded, sewn, or otherwise affixed to the bootie 1108. When PU is employed, it may be compression molded onto the bootie 1108. Alternatively, PU may be RF, HF or sonically welded onto the bootie 1108.

The channel of the lace support 1134, like the lacing channels described elsewhere herein, is designed to guide the lace 1118. The lace support channel may be formed on, in or both on and in the lace support 1134. Thus, the lace supports 1134 are desirably positioned in alignment with lacing channels of the superstructure 1104 and/or of the anatomical protector 1106. Preferably, there is a 1:1 correspondence between the number of projections 1116 and the number of lace supports 1134. However, there may be fewer or more lace supports 1134 than projections 1116. For instance, in one example, multiple lace supports 1134 may be used with some or all of the projections 1116. In another example, one or more of the projections 1116 may not have any lace supports 1134 associated therewith. It can be seen that the lace support 1134 helps improve security and stability of the lacing system around the foot. The lace support 1134 can protect the lace 1118 from abrasion and also provides enhanced distribution of the surface tension of the lace 1118.

While not shown, a footbed, such as the footbed 106, may be used with or without the bootie 1108. When used, the footbed may be inserted into the bootie 1108. The footbed may be of any of the configurations and materials discussed herein with regard to footbed construction.

Figure 21A:
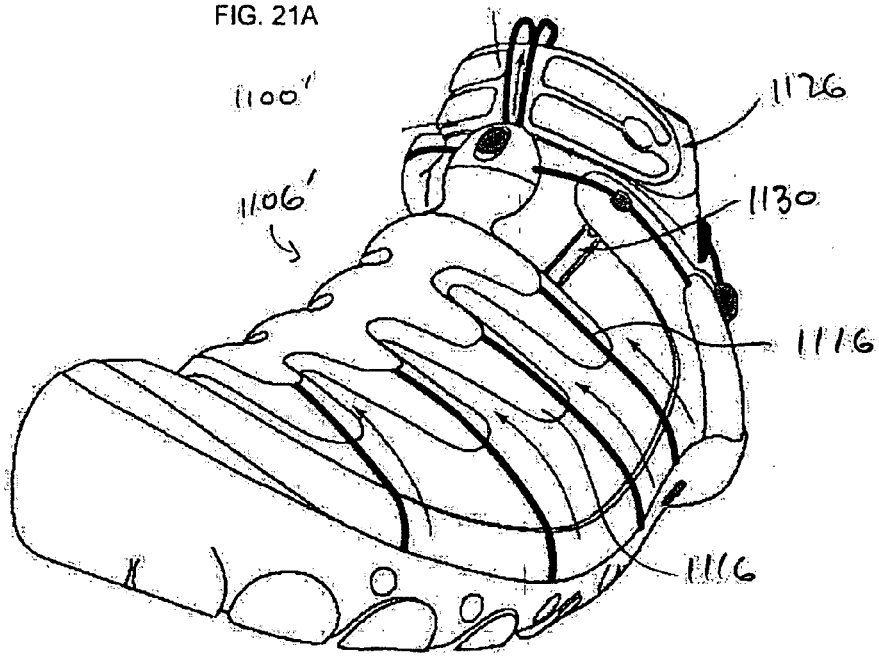
FIGS. 21(*a*)-(*c*) illustrate variations on the article of footwear of FIGS. 19(*a*)-(*g*) in accordance with aspects of the present invention.
Figure 21B:
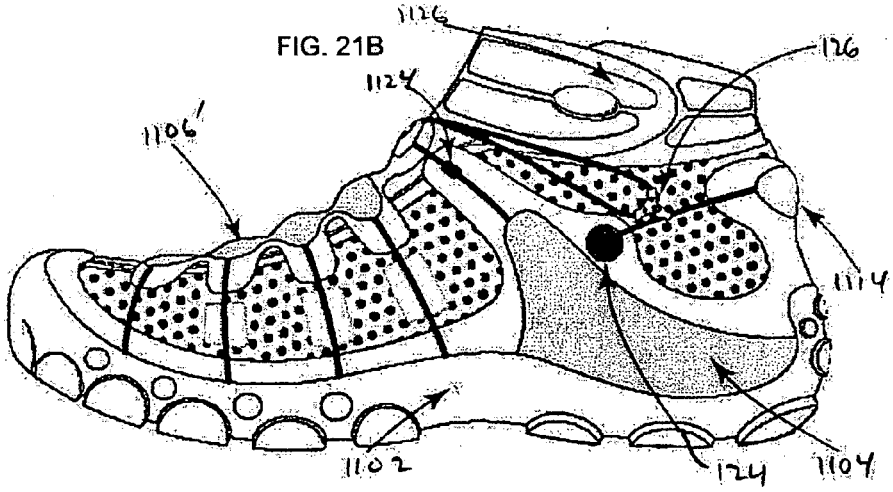
Figure 21C:
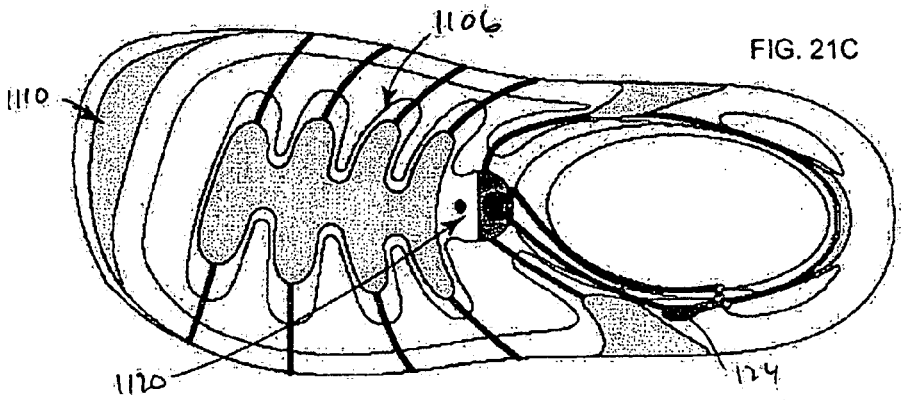

The embodiment of the footwear 1100 shows anatomical protector 1106 as having three fingers 1116. Of course, it should be understood that any number of fingers 1116 may be employed, or no fingers 1116 may be employed. For instance, FIGS. 21(*a*)-(*c*) illustrate article of footwear 1100' as having four fingers 1116 on both the medial and lateral sides of anatomical protector 1106'. Aside from the number of fingers 1116, the article of footwear 1100' is substantially identical to the article of footwear 1100. The number of fingers 1116, as well as the size and/or shape of each finger may vary depending upon the style of footwear, the size of the footwear (children's shoes have limited area for the fingers 1116), the degree of protection desired, as well as other design considerations. For instance, the fingers 1116 may have any geometric shape, such as rectangular, triangular, oval-shaped, etc. The central region of the anatomical protector 1106 may also have any geometric shape.

FIG. 19(*g*) illustrates one style of the outsole 1102 which may be used with the article of footwear 1100. This style includes multiple lugs 1136, which preferably have a generally rounded shape. As seen in the figure, the lugs 1136 in interior region 1138 are round. The lugs 1136 along the perimeters of the forefoot and heel regions may maintain a round shape as they curve outwardly or upwardly along the sides or back of the outsole 1102, as seen in the side and rear views of FIGS. 19D and 19F. Alternatively, some of the lugs 1136 along the forefoot perimeter adjacent the toe region may partly blend into the main body of the outsole, as seen in FIG. 19E. In one variation, the lugs 1136 on the medial side of the forefoot region are spaced closer together than the lugs 1136 on the lateral side of the forefoot region, as best seen in FIG. 19(*g*). However, the spacing, shape and orientation of the lugs 1136 may vary depending on, e.g., end use or style. Also, some or all of the lugs 1136 may include siping for enhanced traction on wet or slippery surfaces. Any type of siping described herein may be used on or in conjunction with the lugs 1136.

Figure 22:
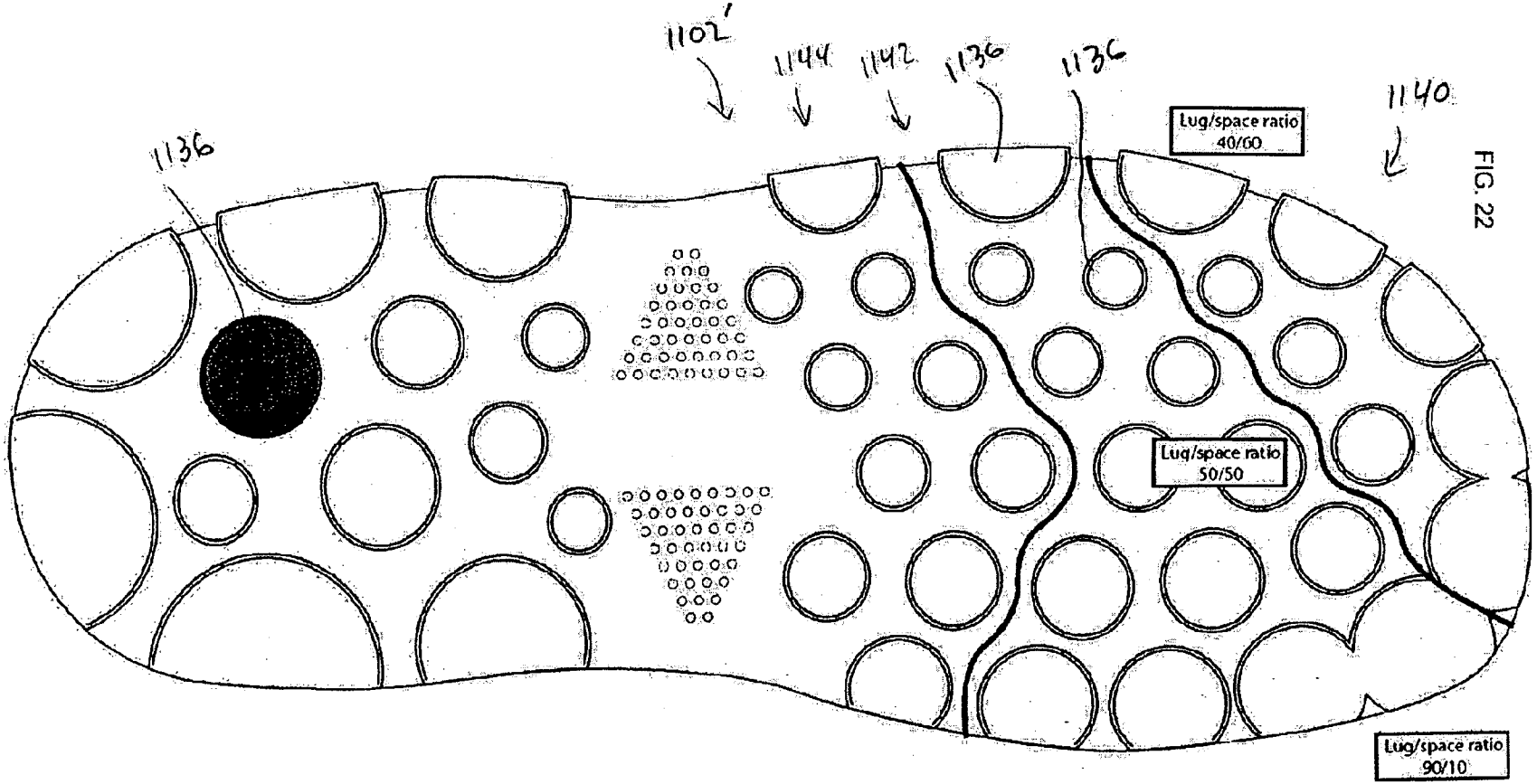
FIG. 22 illustrates an alternative outsole configuration in accordance with aspects of the present invention.
Figure 23A:
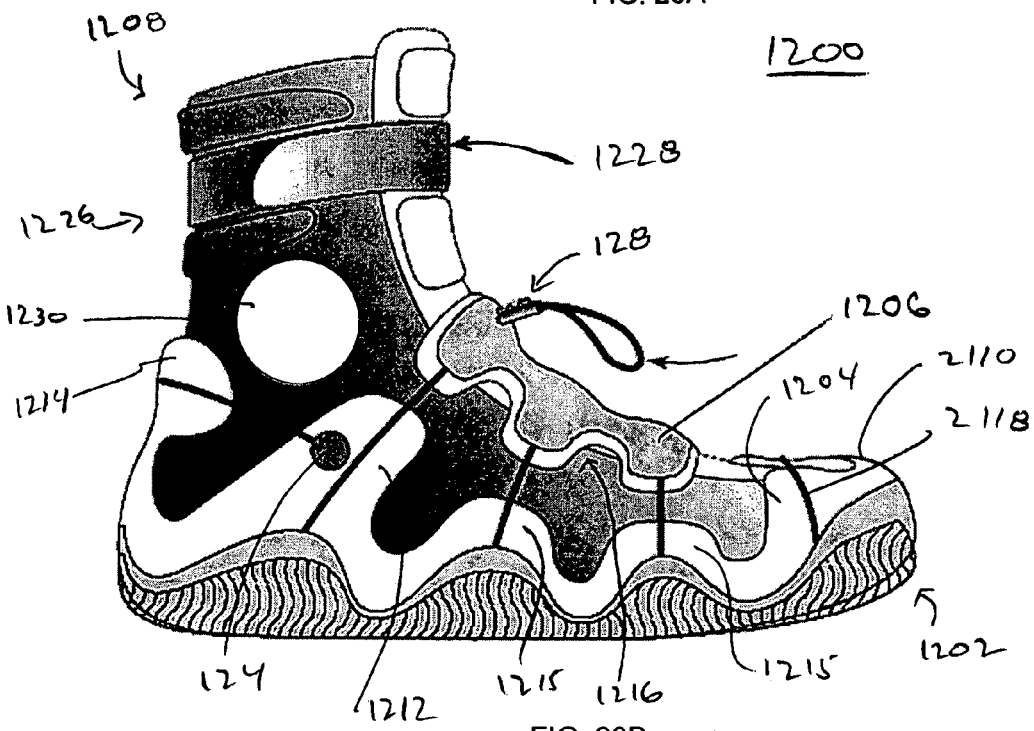
FIGS. 23(*a*)-(*d*) illustrate yet another article of footwear in accordance with aspects of the present invention.
Figure 23B:
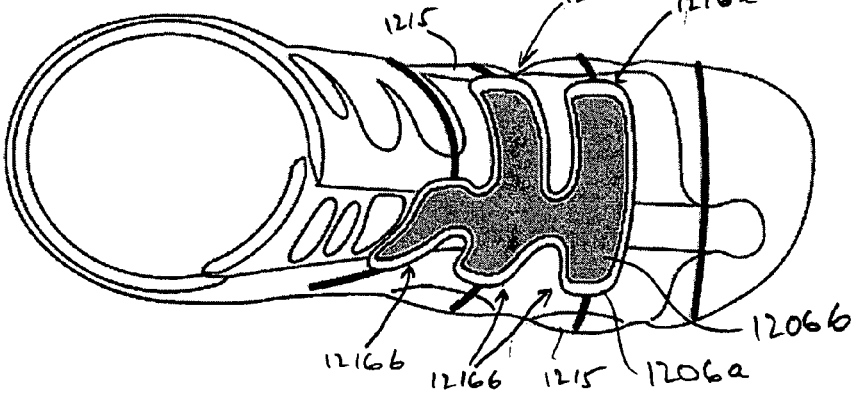
Figure 23C:
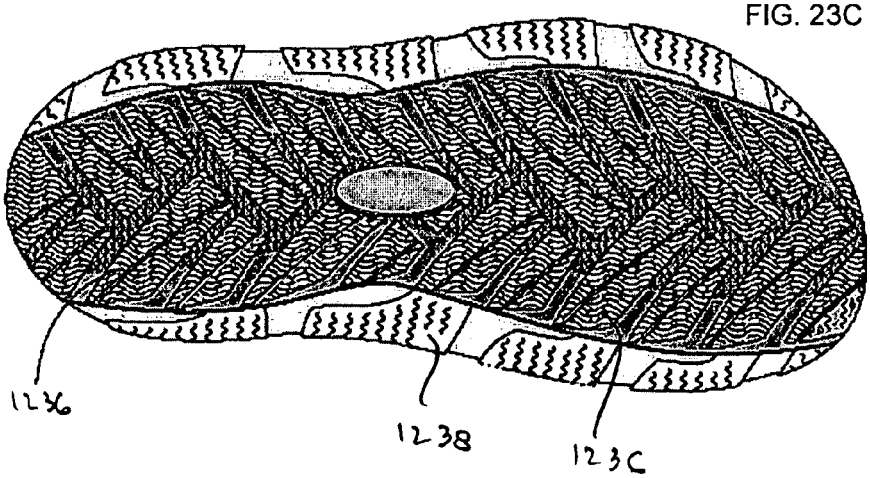
Figure 23D:
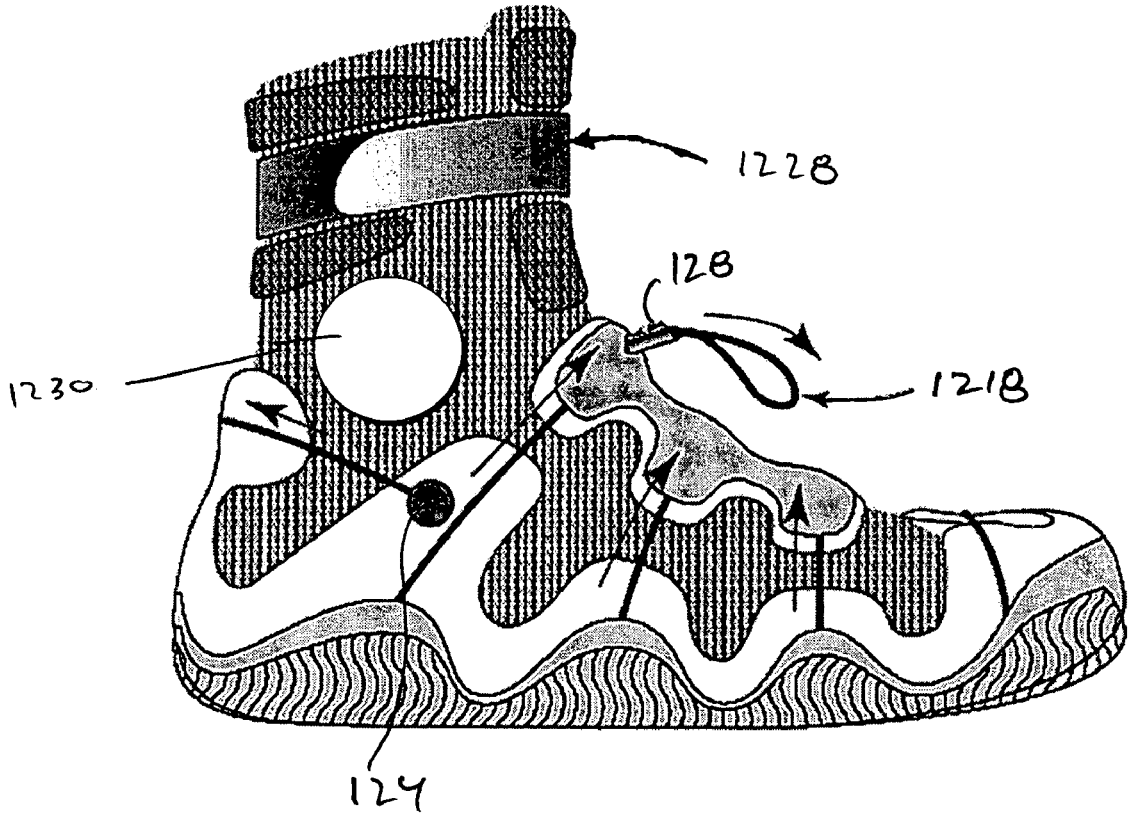

FIG. 22 illustrates an alternative outsole 1102' which includes three regions in the forefoot, namely a frontmost region 1140, a middle region 1142 and a back region 1144. Each region 1140, 1142 and 1144 preferably extends substantially or completely from the medial side to the lateral side of the outsole 1102', although this is not required. As shown, the lugs 1136 in the central portions of the different regions preferably have a lug to space ratio on the order of 50/50. The lugs on the medial side preferably have a lug to space ratio on the order of 90/10. The lugs on the lateral side preferably have a lug to space ratio on the order of 40/60. Of course, these lug to space ratios are merely preferred examples, and in any of the regions of the outsole 1102' the lug to space ratio may vary anywhere from 0/100 to 100/0, for instance 10/90, 20/80, 30/70, 60/40, 70/30, 80/20, etc.

FIGS. 23(*a*)-(*d*) illustrate another article of footwear 1200 which is similar to the articles of footwear 1100 and 1100'. Many of the features of the article of footwear 1200 are the same or similar to the articles of footwear 1100 and 1100', and all of the features of those articles of footwear may be employed with the article of footwear 1200. As seen in the side and top views of FIGS. 23(*a*) and 23(*b*), the article of footwear 1200 preferably includes an outsole 1202, a support structure 1204, a floating anatomical protector 1206 and a bootie 1208. The article of footwear 1200 is adapted for use in water, wet or cold conditions as a "sea boot", "snow boot" or "winter boot," although the features thereof may be used with any article of footwear for many different activities.

The outsole 1202 may be of any of the outsole configurations presented herein. In a preferred example shown in FIG. 23(*c*), the outsole 1202 may include inner lugs 1236 and outer lugs 1238, as well as siping in an "all season" pattern. The siping may be a molded pattern or added after the outsole 1202 is molded. Here, quad cut siping may be provided along the inner lugs 1236 for extra traction.

The superstructure 1204 desirably combines midsole and upper elements in a unitary housing, as with the superstructures of the articles of footwear 1100 and 1100'. The superstructure 1204 may comprise any of the materials used in any of the housing/superstructure variations described elsewhere herein. The superstructure 1104 preferably includes a toe protector 1210, which is designed to provide protection to the wearer's toes. The toe protector 1210 is similar to the toe protector 1110. Ankle guards 1212, which may be the same or similar to the ankle guards 1112, may be provided on the medial and/or lateral sides adjacent to the wearer's ankle. A heel support 1214, which may be the same as heel support 1114, may also be provided. The toe protector 1210, ankle guards 1212 and heel support 1214 may be formed in any of the configurations and from any of the materials disclosed with regard to the other examples herein.

The anatomical protector 1206 may comprise one or more layers or regions of material as with the anatomical protector 1106. For instance, the anatomical protector 1206 may comprise a main layer 1206*a* as well as a cover layer 1206*b*. The main layer 1206*a* desirably comprises a foam-like material such as PU or EVA, more preferably CMEVA. The cover layer 1206*b* may also be a foam-like material, although it preferably is a natural or synthetic rubber. More preferably, the cover layer 1206*b* includes an exterior layer of traction rubber such as the kind used as the ground contacting layer of the outsole 1202. The cover layer 1206*b* may be integrally formed with the main layer 1206*a*, or may be glued, stitched or otherwise affixed to the main layer 1206*a* during manufacture.

The superstructure 1204 may be considered a hybrid between the housing 104 and the superstructure 1104. Similarly, the anatomical protector 1206 may be considered a modified version of the anatomical protector 1106. As shown in FIGS. 23(*a*)-(*b*), the superstructure 1204 preferably includes a plurality of medial and/or lateral fingers 1215 that are positioned adjacent to the wearer's forefoot. The fingers 1215 desirably do not extend as far upward as the fingers 112 of the article of footwear 100.

The fingers 1216 of the floating anatomical protector 1206 are preferably not symmetrical about the medial and lateral sides thereof. For instance, as best seen in the top view of FIG. 23(*b*), there may be two medial fingers 1216*a* and three lateral fingers 1216*b* that are part of anatomical protector 1206. Of course, it should be understood that in other variations there may be no fingers 1216 on either the medial or the lateral sides, there may be the same number of fingers 1216 on either side, and/or the fingers may be symmetrical.

The anatomical protector 1206 may be used in conjunction with one or more lace securing features such as the lace end keeper or end cap 124, the lace pull 126, and/or the lace locking mechanism 128, or any of the other lace securing features utilized with any of the articles of footwear of the instant application.

Lace 1218, as with the lace 1118, preferably runs through one or more lacing channels (not shown) in the anatomical protector 1206. For instance, in a preferred example there are preferably three lacing channels which run medially/laterally across the anatomical protector 1206. The lacing channels of the anatomical protector 1206 may be of any of the configurations of lacing channels described elsewhere herein. For instance, each lacing channel may be formed at least partly by a recess in the main layer 1206*a*, a recess in the cover layer 1206*b*, or as a combination of both. One or more lacing channels are also preferably supplied with the superstructure 1204 and/or the outsole 1202 in any of the configurations described elsewhere herein. Directional arrows in FIG. 23(*d*)

illustrate how the lace 1218 may be tightened. The figure also illustrates that an endcap 124 and a lace locking mechanism 128 may also be employed. Additional lacing or other fastening mechanisms may be used in conjunction with the lace 1218.

In the embodiment of the article of footwear 1200, it is desirable to utilize the anatomical protector 1206 with the bootie 1208. The bootie 1208 may be permanently attached to the article of footwear 1200 or may be removable. In the former case, the bootie 1208 may be stitched, glued or otherwise affixed to the superstructure 1204. The bootie 1208 may be of any of the configurations and materials discussed herein with regard to bootie construction, such as with the booties 608, $\mathbf{608}_1$, $\mathbf{608}_2$, $\mathbf{608}_3$, $\mathbf{608}_4$, and 1108. Preferably the bootie 1208 has at least one layer of neoprene or similar waterproof material suitable for use in wet environments.

The bootie 1208 preferably includes a collar 1226, which may have at least one closure 1228 comprising, for example, a hook and loop fastener system, claps, snaps, zipper, bungees, lacing or other type of securing connection. In this case, the lacing of the closure 1228 may be wraparound lacing as described elsewhere herein, a traditional crossover-type configuration, or other configuration. Thus, multiple laces or series of laces may be used with the article of footwear 1200. The collar 1226 may, depending upon the style of footwear, be at or below the wearer's ankle, or inches above the wearer's ankle. For instance, in a boot type configuration, the collar 1226 may extend anywhere from 1 to 12 inches or higher above the wearer's ankle.

The closure 1228 preferably closed securely about a portion of the wearer's leg so that unwanted material such as dirt, pebbles, sand, etc. is kept out of the bootie 1208. The closure 1228 is preferably complementary to the lacing 1218 and any fastening or securing features described herein. Ankle protection member 1230 may be disposed on the medial and/or lateral sides of the footwear to provide additional protection for the ankle. The ankle protection member 1230 may be part of the bootie 1208. In this case, the ankle protection member 1230 may be an integral part of the bootie 1208, for instance either as padding or a protective member. Alternatively, the ankle protection member 1230 may be a separate component that is stitched, glued or otherwise secured to the bootie 1208. In another case, the ankle protection member 1230 may be part of the anatomical protector 1206. For instance, a medial or lateral finger of the anatomical protector 1206 may extend rearward to cover some or all of the ankle. Here, the ankle protection section of the anatomical protector 1206 may be integral with the rest of the anatomical protector 1206, or may be a separate member that is secured to the rest of the anatomical protector 1206 by the lacing 1218 or other types of fasteners or connection members. In yet another variation, the ankle protector 1230 and/or the anatomical protector 1206 may be integrated with the lacing or other fastening system.

The present invention provides sturdy articles of footwear that include a wraparound lacing system for superior stability and comfort. The footwear is breathable, and yet may also include an insulated bootie for cold environments. Quad cut siped outsoles provide improved traction. The footwear is suitable for use in all types of environments and with all types of activities, particularly water sports.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants. Any of the features in any of the embodiments can be combined or interchanged with any other features in any of the other embodiments. For instance, recessed cavities may be positioned along one or more lacing channels in any of the embodiments herein to promote easy gripping and adjustment of the lace. The shell structure and/or the tube structure may also be used alone or in combination with any or all of the embodiments and variations herein. The floating protection can be used with or without a bootie, and with superstructures or housings that include or omit projections thereon. Lace supports may also be used with any of the embodiments herein. The invention can be used in combination with new or uncommon materials in addition to the materials specified above, as well as with new or uncommon manufacturing techniques.

The invention claimed is:

1. An article of footwear, comprising:

a superstructure at least partly defining an enclosure for receiving a wearer's foot;

a floating anatomical protector operatively coupled to the superstructure so that the anatomical protector does not directly contact the superstructure during wear; and a lace adapted to couple the floating anatomical protector to the superstructure;

wherein the superstructure and the floating anatomical protector each include at least one lacing channel therein for receiving the lace, and the lace is wound in a generally spiral pattern about the superstructure and the floating anatomical protector.

2. The article of footwear of claim 1, further comprising:

an outsole having a first surface for contacting the ground and a second surface remote from the first surface;

wherein the superstructure is affixed to the second surface of the outsole.

3. The article of footwear of claim 1, wherein the floating anatomical protector has a base layer and a cover layer, the base layer having a first surface adapted to face the wearer's foot during wear and a second surface opposite the first surface, and the cover layer being connected to the second surface of the base layer.

4. The article of footwear of claim 3, wherein the cover layer includes a traction material overlying at least part of the second surface of the base layer.

5. The article of footwear of claim 3, wherein the superstructure includes a toe protector for covering at least a portion of the wearer's toes, the toe protector being spaced apart from the floating anatomical protector by a gap.

6. The article of footwear of claim 1, wherein the floating anatomical protector includes a plurality of projections thereon, at least one of the plurality of projections extending medially or laterally away from a central region of the floating anatomical protector.

7. The article of footwear of claim 1, wherein the lacing channel of the floating anatomical protector runs between two layers of the floating anatomical protector.

8. The article of footwear of claim 1, further comprising a bootie at least partly received within the superstructure, wherein the floating anatomical protector overlies a portion of the bootie during wear.

9. The article of footwear of claim 8, wherein the bootie includes a collar having closure means for securing the collar about a portion of the wearer's leg.

10. The article of footwear of claim 8, further comprising a footbed removably disposed within the bootie.

11. An article of footwear, comprising:

a superstructure at least partly defining an enclosure for receiving a wearer's foot; and a floating anatomical protector operatively coupled to the superstructure, the floating anatomical protector having at least one medial side projection and at least one lateral side projection extending therefrom; and a lace adapted to couple the floating anatomical protector to the superstructure;

wherein the superstructure and the floating anatomical protector each include at least one lacing channel therein for receiving the lace, and the lace is wound in a generally spiral pattern about the superstructure and the floating anatomical protector.

12. The article of footwear of claim 11, wherein the superstructure has at least one medial side projection and at least one lateral side projection extending therefrom.

13. The article of footwear of claim 12, wherein the floating anatomical protector is positionable so that the at least one medial side projection of the floating anatomical protector generally aligns with the at least one medial side projection of the superstructure, and the at least one lateral side projection of the floating anatomical protector generally aligns with the at least one lateral side projection of the superstructure.

14. The article of footwear of claim 11, wherein the at least one lacing channel of the floating anatomical protector is disposed along the at least one medial side projection and the at least one lateral side projection thereof.

15. The article of footwear of claim 11, further comprising a bootie connected to the superstructure, the bootie including a lace support thereon for guiding the lace between the at least one lacing channel of the floating anatomical protector and the at least one lacing channel of the superstructure.

16. The article of footwear of claim 15, wherein the bootie includes a collar having closure means for securing the collar about a portion of the wearer's leg.

17. An article of footwear, comprising:

a superstructure at least partly defining an enclosure for receiving a wearer's foot, the superstructure including a plurality of lacing channels therein for receiving a lace;

a floating anatomical protector operatively coupled to the superstructure by the lace, the floating anatomical protector including a plurality of lacing channels therein for receiving the lace; and a bootie at least partly received in the superstructure, wherein the floating anatomical protector overlies a portion of the bootie during wear;

wherein the lacing channels are arranged so that the lace is wound in a generally spiral pattern about the superstructure and the floating anatomical protector.

18. The article of footwear of claim 17, wherein the bootie is removably engaged to the superstructure.

* * * * *